United States Patent [19]

Ino

[11] Patent Number: 5,052,267

[45] Date of Patent: Oct. 1, 1991

[54] APPARATUS FOR PRODUCING A CHORD PROGRESSION BY CONNECTING CHORD PATTERNS

[75] Inventor: Mayumi Ino, Akishima, Japan

[73] Assignee: Casio Computer Co., Ltd., Tokyo, Japan

[21] Appl. No.: 411,541

[22] Filed: Sep. 22, 1989

[30] Foreign Application Priority Data

Sep. 28, 1988 [JP] Japan ..... 63-240660

[51] Int. Cl.[5] ..... G10H 1/38; G10H 7/00

[52] U.S. Cl. ..... 84/613; 84/637; 84/DIG. 22

[58] Field of Search ..... 84/613, 637, 650, 669, 84/715, DIG. 22

[56] References Cited

U.S. PATENT DOCUMENTS

| | | | |
|---|---|---|---|
| 4,433,601 | 2/1984 | Hall et al. | 84/DIG. 22 |
| 4,468,998 | 9/1984 | Baggi | 84/DIG. 22 |
| 4,926,737 | 5/1990 | Minamitaka | 84/613 X |
| 4,951,544 | 8/1990 | Minamitaka | 84/613 |

FOREIGN PATENT DOCUMENTS 1-262595 10/1989 Japan .

*Primary Examiner*—Stanley J. Witkowski

*Attorney, Agent, or Firm*—Frishauf, Holtz, Goodman & Woodward

[57] ABSTRACT

An apparatus for producing a chord progression by connecting or chaining chord patterns. In a preferred embodiment, the apparatus includes as a source of musical knowledge, a database of musical structure of various music pieces and a database of chord patterns. In operation, from the musical structure database, a multi-leveled structural feature of a music piece is selected and determined level by level, either automatically, semi-automatically, or manually, through a dialogue conducted between the apparatus and the user. Thereafter, chord patterns are chosen one at a time from the chord pattern database in a similar dialogue manner. A concatenating module controls the concatenation of the chosen chord patterns to be commensurate with the characteristic musical structure previously determined, thereby to provide a chord progression with musicality, naturalness and well-balanced unity and variety. The produced chord progression may be utilized as a musical material from which an automatic composer synthesizes a melody of a music piece.

26 Claims, 57 Drawing Sheets

| ADDRESS | DATA | f |
|---|---|---|
| LIST. dt FILE | START ADDRESS OF PHRASE STURUCTURE FILE | 1 |
| | START ADDRESS OF PHRASE STARTING FUNCTION FILE | 2 |
| | START ADDRESS OF PHRASE ENDING FUNCTION FILE | 3 |
| | START ADDRESS OF FUNCTIONAL CHORD PATTERN FILE | 4 |
| | START ADDRESS OF MAJOR CHORD PATTERN FILE | 5 |
| | START ADDRESS OF MINOR CHORD PATTERN FILE | 6 |
| | START ADDRESS OF RHYTHM PATTERN FILE | 7 |
| | EOF | |

FIG.7 A

DATA FILE (a) FILE ----- GROUP i, 'No' GROUP(i+1), --- EOF (b) GROUP ----- ROW j, '/n' ROW(j+1), '/n' ROW(j+2) ---

(C) ROW ----- COLUMN k, '' COLUMN(k+1), '' COLUMN (k+2) ---

FIG.7B

NOTE :

auting [I]=1 WHEN ITEM I IS AUTOMATICALLY SELECTED, auting [I] =0 WHEN ITEM I IS SELECTED BY USER Print[0]="1. TONALITY"
Print[1]="2. MUSICAL FORM"
Print[2]="3. PHRASE STRUCTURE"
Print[3]="4. START/END FUNCTION"
Print[4]="5. GENERATIVE METHOD"
Print[5]="6. CHORD PATTERN"
Print[6]="7. RHYTHM PATTERN"

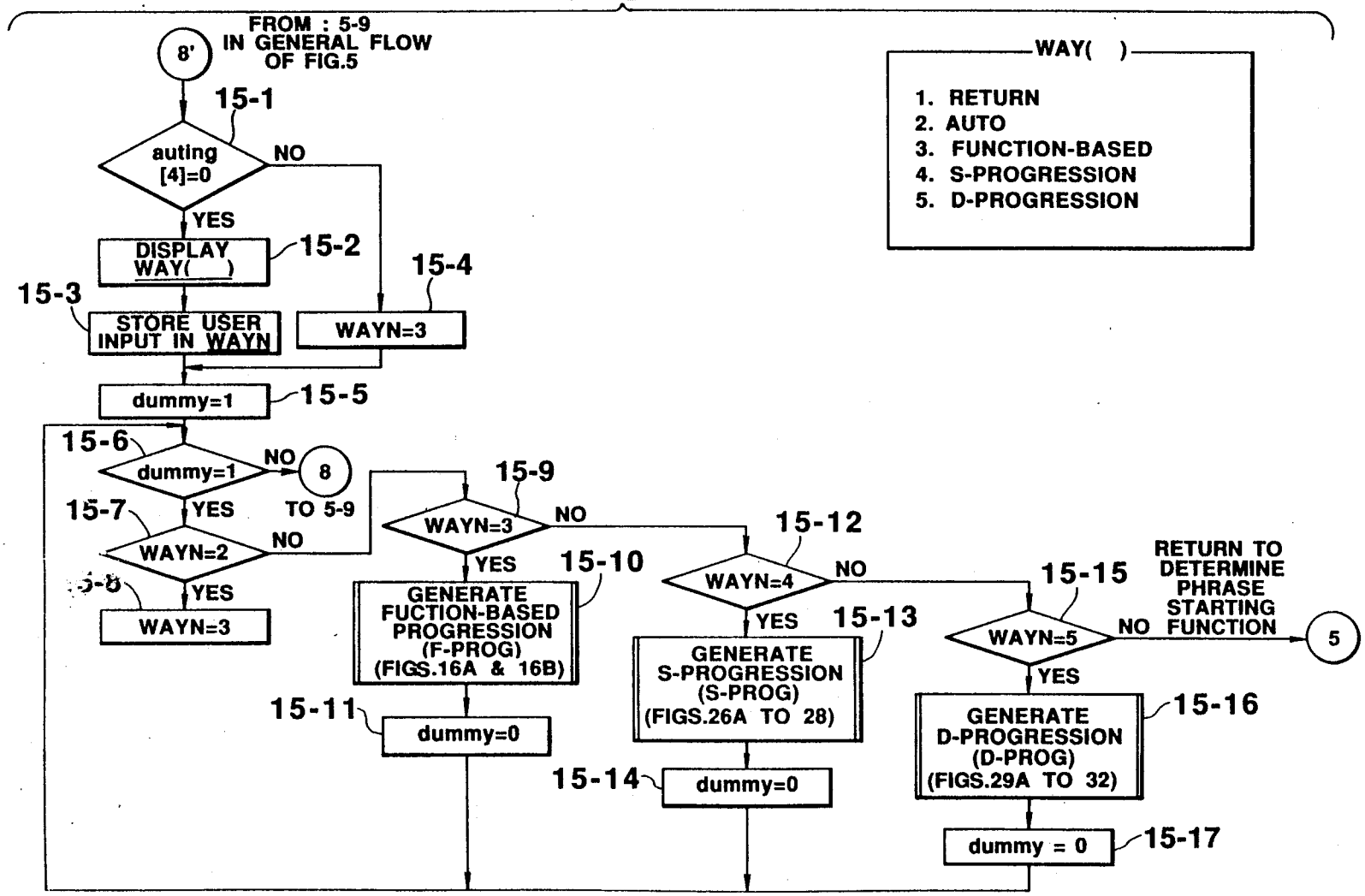
FIG.15
FROM : 5-9 IN GENERAL FLOW OF FIG.5
8'
15-1
auting [4]=0
NO
YES
15-2
DISPLAY WAY( )
15-3
STORE USER INPUT IN WAYN
15-4
WAYN=3
15-5
dummy=1
15-6
dummy=1
NO
8
TO 5-9
YES
15-7
WAYN=2
NO
YES
WAYN=3
15-9
WAYN=3
NO
YES
15-10
GENERATE FUCTION-BASED PROGRESSION (F-PROG) (FIGS.16A & 16B)
15-11
dummy=0
15-12
WAYN=4
NO
YES
15-13
GENERATE S-PROGRESSION (S-PROG) (FIGS.26A TO 28)
15-14
dummy=0
15-15
WAYN=5
NO
YES
RETURN TO DETERMINE PHRASE STARTING FUNCTION
5
15-16
GENERATE D-PROGRESSION (D-PROG) (FIGS.29A TO 32)
15-17
dummy = 0
WAY( )
1. RETURN
2. AUTO
3. FUNCTION-BASED
4. S-PROGRESSION
5. D-PROGRESSION MESSAGE A : DO YOU USE IV-TH DEGREE
AS THE ROOT OF THE FIRST CHORD?(YES=1,NO=0)
MESSAGE B : DO YOU USE V-TH DEGREE
AS THE ROOT OF THE FIRST CHORD?(YES=1,NO=0)
MESSAGE C : DO YOU USE I-ST DEGREE
AS THE ROOT OF THE FIRST CHORD?(YES=1,NO=0)
MESSAGE D : PLEASE INPUT THE DEGREE OF THE ROOT YOU WANT TO USE

APPARATUS FOR PRODUCING A CHORD PROGRESSION BY CONNECTING CHORD PATTERNS

BACKGROUND OF THE INVENTION

The present invention relates in general to music systems and in particular to an apparatus for producing a chord progression.

Apparatus for providing a progression or succession of chords available for a given melody are known. Examples are disclosed in Japanese patent application laid open to public as Sho 58-87593, and U.S. Pat. No. 4,539,882.

Such apparatus have been commonly built in musical instruments such as keyboard instruments. In a typical operation, melody information is provided by playing (operating) a keyboard, and recorded into a memory in the instrument. The recorded melody information is then analyzed for each segment (e.g., measure) thereof to determine a harmony or chord progression implied by the melody. The chord progression thus obtained may be utilized to provide an automatic accompaniment to the melody in a synchronous relation while the melody is being played again from the keyboard.

Because of their principles, the chord progression apparatus described above need a melody of a music piece to obtain a chord progression, and may be better referred to as melody harmonization apparatus.

Apparatus for producing or creating a chord progression of a music piece in an environment without any melody or melodic contents must take quite a different approach from that of the melody harmonization apparatus. An apparatus for producing a chord progression without requiring any melodic information was proposed by the present inventor in Japanese patent application Sho 63-90226, filed on Apr. 14, 1988 and assigned to the same assignee as the present application. This Japanese application discloses an apparatus comprising means for collecting chord progressions of many existing music pieces. For each two-chord order or permutation in the collected chord progressions, a frequency measurement device evaluates a number of transitions from the first to the second chord to provide a frequency table of two-chord transitions. In operation, a chord progression is developed on a one-chord-after-another basis according to the frequency table in combination with a random number generator. Given a current chord, the next chord is determined by a chord with the maximum value obtained from combining the value of the frequency of the chord in the frequency table with the value of a number generated at random. A relative weight of the random component is made adjustable by the user.

While the above-mentioned apparatus can produce a chord progression by a chain of chords without requiring any melody, it has several disadvantages as follows:

(1) The apparatus significantly relies on the frequency table which is a statistic parameter of collected or sampled chord progressions. Therefore, chord progression generated from the same frequency table in a number of times will be made similar to one other, though depending on the relative weight of the random component affecting the next chord determination. Hence, new collection of chord progressions, from which a new frequency table is derived, is required to obtain a substantially different chord progression.

(2) The full automatic production of a chord progression leaves no or little room for the user to take active participation or the initiative in creating a chord progression.

(3) The next succeeding chord is essentially determined by the most likelihood of the transition from the current chord. This is a short-term (i.e., two-chord length) control of the chord progression generation, lacking in a long-term or structural control to assure musicality in the generated chord progression.

SUMMARY OF THE INVENTION

It is, therefore, an object of the invention to provide an improved apparatus for producing a chord progression before any melody is composed therefor.

Another object of the invention is to provide an apparatus capable of producing a chord progression with musicality such as naturalness, unity and variety.

Another object of the invention is to provide an apparatus capable of producing a chord progression from structural features of an intended music piece.

Still another object of the invention is to provide an apparatus capable of producing a chord progression by a database-oriented approach.

A further object of the invention is to provide an apparatus for producing a chord progression which can provide an environment to users where a degree of their active participation in producing or creating a chord progression may be varied in a wide range depending on their preference, taste, musical skill, experience, knowledge and so on.

Another object of the invention is to provide an apparatus capable of producing a chord progression by way of interactions or conversations conducted between the apparatus and the user.

A further object of the invention is to provide an automatic composer for synthesizing or composing a melody by utilizing a chord progression apparatus of the invention.

A further object of the invention is to provide an apparatus capable of producing a chord progression by utilizing chord patterns.

Still another object of the invention is to provide an apparatus capable of determining a chord pattern for use in a chord progression as part thereof according to the user's best judgement on the chord pattern by way of an aural test thereof.

In accordance with an illustrative aspect of the present invention, there is provided an apparatus for producing a chord progression for a music piece which comprises chord pattern database means (3D in FIG. 2; 440 450 in FIG. 35) for storing a database representative of a collection of chord patterns, chord pattern selecting means (F6 in FIG. 3; 410, 420, 460 in FIG. 34; 36-4 in FIG. 36) operatively coupled to the chord pattern database means for selecting a plurality of chord patterns, one pattern at a time from the chord pattern database means, and concatenating means (F8 in FIG. 3; 410, 420, 480 in FIG. 34; 36-9 in FIG. 36) operatively coupled to the chord pattern selecting means for concatenating the plurality of chord patterns thereby to produce a chord progression for a music piece.

With this arrangement, a chord progression for a music piece can be produced without requiring any melody. To state it another way, instead of a melody, the chord progression produced by this apparatus may provide a musical basis or material from which either a user of the apparatus or an automatic composer can compose a melody suited therefor. In addition, the apparatus can produce a chord progression by connecting or chaining chord patterns. The database serves as a source of chord patterns from which suitable chord patterns are selected for concatenation into a chord progression. Therefore, there is no need for the user to learn, as a preparatory training, a number of chord patterns (which may be relatively large and will require a considerable time to memorize) to obtain the desired chord progression.

The chord pattern detabase or file means may take various forms in terms of physical data structures, logical chord pattern organization, and/or storage medium type (e.g., internal or external ROM, RAM, various memory cards).

In a simple version, the chord pattern database means contains a single file of chord patterns each of which is arranged such that it can come after any (including the same) chord pattern in the file without violating musical rules of connecting chords. Such a file may be implemented, for example, by utilizing a theory of tonal-harmony, which states that a chord pattern ending with a chord having a tonic(T) function can be followed by any or substantially any chord without impairing a characteristic of the tonal music. This version of the chord pattern database means is useful for the chord pattern selecting means of a manual type because any user's choice of a chord pattern from the database is given musical validity in making connection to the previous chord pattern so that he does not worry about choosing a chord pattern. The chord pattern database of this type is also effective to simplify the structure of the chord pattern selecting means of an automatic type, which may readily be implemented by the use of an electronic random number generator.

Another version of the chord pattern database means comprises a plurality of files each containing a collection of chord patterns but semantic level of which is different for each file. For example, a first file is for an abstractive or functional level of chord pattern defined by a succession of functional chords such as tonic(T), dominant(D) and subdominat (S), while a second file deals with a more specific (concrete) level or representation of chord pattern in which each chord may be specified by a root and type (e.g., C major, G seventh, D minor). Each functional chord pattern in the first file preferably corresponds to a different group of specific chord patterns in the second file. Each group comprises at least one and preferably many chord patterns. Using the database terminology, the first file (object) has a one-to-many relationship, hierarchical relationship with the second file (object), or these files constitute a hierarchical database (of multi-leveled chord patterns). Such multi-leveled chord pattern database means has an advantage over a single-leveled chord pattern file such as the simple version described above in that a relatively small subset of chord patterns will suffice for selecting one chord pattern therefrom at a time for development of a chord progression while assuring a vast number of possible combinations of a plurality of chord patterns, each combination of which forms a chord progression; remember that the second file is segmented or classified into a plurality of groups each corresponding to a different one of functional chord patterns in the first file.

A further version of the chord pattern database means may comprise a chord pattern network means (FIG. 45; 440, 450 in FIG. 34) for storing a hierarchical network of chord patterns comprising a plurality of nodes and a plurality of links connecting between the nodes so as to define hierarchical relationships therebetween in which each node in the hierarchical network contains at least one chord pattern and in which each chord pattern in the each node in the hierarchical network is connected by an associated one of the plurality of links to another node in the hierarchical network. In this case, the combination of the chord pattern selecting means and the concatenating means may take the form of network exploring means (410, 420 in FIG. 34; FIG. 36) for exploring the chord pattern network means according to a guidance of the links in the hierarchical network while concatenating chord patterns thus explored one after another thereby to develop a chord progression. While the chord pattern network means can be regarded as a hierarchical database, it is different from the above-mentioned abstractive/specific leveled database in respect of the direction of the hierarchy; the chord pattern network means is hierarchically organized in the direction of time or in terms of linking one chord pattern after another and after still another and so on rather than semantic levels (abstractive or specific ones) of chord pattern. Such temporal hierarchy of chord patterns is defined by the plurality of the links or pointers between the chord pattern nodes. Therefore, a chain of chord patterns, which forms a chord progression, will be encountered when exploring the hierarchical network through a line of the links.

In connection with this aspect of the invention, there is provided an apparatus for producing a chord progression which comprises chord pattern file means for (440 in FIG. 34) storing a file of chord patterns, next candidate set defining means (450 in FIG. 34) for defining, with respect to each chord pattern in the chord pattern file means, a set of next chord pattern candidates each of which can succeed the chord pattern, concatenating means (410, 420, 460, 480 in FIG. 34; 36-3 to 36-9 in FIG. 36) for concatenating chord patterns from the chord pattern file means based on the next candidate set defining means to produce a chord progression (CPA in FIG. 37B).

The combination of the chord pattern file means and the next candidate set defining means may be considered an embodiment of the chord pattern network means described above. The next chord pattern candidate set defining means may take the form of a table of pointers implemented on a memory in which each pointer locates a chord pattern preferably residing in the same chord pattern file means. This arrangement greatly saves storage capacities because no additional chord pattern file is required.

A preferred version of the concatenating means comprises prompting means (36-3 in FIG. 36) operable each time when a chord pattern from the chord pattern file means is determined to be a current chord pattern in a chord progression being produced for retrieving from the chord pattern file means a set of next chord pattern candidates defined by the next candidate set defining means with respect to the current chord pattern and for displaying the set on a display unit (470 in FIG. 34), next chord pattern determining means (36-4 to 36-7 in FIG. 36) including user-operable input means (460 in FIG. 34) adapted to select an alternative from the set retrieved and displayed by the prompting means for determining the alternative to be a next chord pattern which is to succeed the current chord pattern, and chord progression extending means (36-9 in FIG. 36) for concatenating the next chord pattern determined by the next chord pattern determining means into the chord progression so that the next chord pattern will be determined to be a current chord pattern in the chord pattern after the concatenation.

In accordance with a further aspect of the invention, there is provided an apparatus for producing a chord progression which comprises a plurality of chord pattern generating means (15-10, 15-13, 15-16 in FIG. 15) each for generating variable chord patterns belonging to a class which is different from a class of variable chord patterns generated by each other of the plurality of chord pattern generating means, class selecting means (15-1 to 15-3 in FIG. 15) for variably selecting one chord pattern generating means at a time from the plurality of chord pattern generating means, and instance selecting means (FIGS. 18A and 18B; FIGS. 26A to 27; FIGS. 29A to 31B) for variably selecting chord patterns one at a time from the chord pattern generating means selected by the class selecting means thereby to provide a chord progression which is formed by a succession of chord patterns specified according to a series of selections by the class selection means and the instance selection means.

With this arrangement, a chord progression may be constructed by a selected and mixed chain of different class chord patterns, and therefore, it is given much greater variety than can be achieved with a single class chord pattern generator. The term "instance" refers here to a chord pattern example or instance of or belonging to a chord pattern class. Each class chord pattern generator is arranged to generate variable chord patterns; a set of such variable chord patterns constitutes a class of chord patterns.

Preferably the plurality of chord pattern generating means comprise means (15-10 in FIG. 15) for generating a progression of chords of a relatively short length in which each chord functions as a tonic, dominant or subdominant chord relative to the next succeeding chord. They may further include dominant progression means (15-16 in FIG. 15) for generating a dominant progression of chords in which each chord serves as a dominant chord relative to the next succeeding chord, and may further comprise subdominant progression means (15-13 in FIG. 15) for generating a subdominant progression of chords in which each chord serves as a subdominant chord relative to the next succeeding chord.

Each of the plurality of chord pattern generator means may take the form of a file memory for storing a file of chord patterns constituting an associated class. In the alternative it may be implemented by an algorithmic or rule-based pattern generator which functions with a processor unit to variably compute or create chord patterns according to an algorithm or rule contained therein. For example, a dominant (D) progression class of chord pattern can readily be created by such automatic pattern generator from its initial chord, which may be supplied by the user, and a rule in the generator which defines the relationship between any two successive chords in D-progression.

The class selecting means may include a user-operable input means for designating a new class of chord patterns (i.e., for changing the choice of the active generator in the plurality of chord pattern generators) when needed in the course of developing a chord progression.

Valid and effective determination of a new chord pattern is most desirable when developing a chord progression by chaining chord patterns with chord progression apparatus such as those described in this section.

In accordance with this aspect of the present invention, there is provided an apparatus for determining a chord pattern to be used in a chord progression as part thereof, which comprises chord pattern database means (3D in FIG. 2; 440, 450 in FIG. 35; FIG. 45) for storing a database of chord patterns, chord pattern choosing means (F6 in FIG. 3; 410, 420, 460 in FIG. 34; 36-4 in FIG. 36) for choosing a chord pattern from the chord pattern database means, sound test means (410, 420, 510, 520 in FIG. 34; 36-5 in FIG. 36) for automatically playing a performance of the chord pattern chosen by the chord pattern choosing means, user-operable input means (460 in FIG. 34) for providing a user's response to the play by the sound test means, the user's response being indicative of either acceptance or rejection of the chord pattern played by the sound test means, and determining means (410, 420 in FIG. 34; 36-7, 36-9 in FIG. 36) for determining the chord pattern played by the sound test means to be part of a chord progression when the user's response from the user-operable input means indicates the acceptance.

With this arrangement, the user can make the best judgement on whether to use a chosen chord pattern as part of a chord progression through an aural test thereof. Because the chosen chord pattern is automatically played, the user can concentrate on listening to the performance for evaluating the chord pattern played in the context of a chord progression being developed.

The chord pattern choosing means may be of either a manual type or an automatic type. The manual version employs a user-operable input unit for manually choosing a chord pattern from the chord pattern database while the automatic type may comprise an electronically operated random generator which randomly generates a number specifying a chord pattern in the chord pattern database.

The chord pattern database means may be omitted in a modification in which a full manual chord pattern choosing means in the form of an input unit is employed to input chord patterns one at a time chosen by the user according to his or her own knowledge of chord patterns.

Preferably, the sound test means is arranged to automatically play a performance of a chord progression in advance of (preferably immediatly before) the performance of the chosen chord pattern. This will allow direct and continuous comparison of the user between the chord pattern and the preceding part of the chord progression of interest for better judgement on whether to join the chord pattern into the chord progression.

Another feature of the invention is directed to an apparatus which takes a structural approach to the production of a chord progression for a music piece.

In accordance with this aspect of the invention, there is provided an apparatus for producing a chord progression which comprises musical structure setting means (F1, F2, F3 in FIG. 3) for setting a musical structure at least one level in a music piece, chord pattern generating means (3D in FIG. 2; F6 in FIG. 3) for generating variable chord patterns, and chord progression forming means (F8, F9, F10 in FIG. 3) for selectively concatenating the chord patterns generated by the chord pattern generating means based on the musical structure set by the musical structure setting means to provide a chord progression of the music piece.

With this arrangement, the musical structure information set by the musical structure setting means serves as a control signal to the chord progression forming means so that the set musical structure will be reflected in a chord progression produced by the chord progression forming means.

The musical structure setting means may be either an automatic type or a manual type so far as it sets a musical structure at least one level or dimension in a musical piece (e.g., essential musical structure at the largest dimension, musical structure or framework at a middle dimension such as a phrase level etc).

An embodiment of the apparatus for producing a chord progression in a structural approach comprises repeating block selecting means (F2, F3, in FIG. 3) for selecting a plurality of blocks in a music piece, each of which is to have the same chord progression as each other of the plurality of blocks, chord pattern generating means (3D in FIG. 2; F6 in FIG. 3) for generating variable chord patterns, concatenating means (F8 in FIG. 3) for selectively concatenating the chord patterns generated by the chord pattern generating means to produce a chord progression of the music piece, and repeat control means (F10 in FIG. 3) for controlling the concatenating means in such a manner that the chord progression of the music piece produced by the concatenating means contains the same chord progression with respect to each of the plurality of blocks selected by the repeating block selecting means.

The repeating block selecting means can be regarded as an example of the musical structure setting means stated above while the concatenating means and the repeat control means constitute an embodiment of the chord progression forming means. The repeating block selecting means may take the form of a phrase structure setting means (F2 in FIG. 3) for setting a phrase structure representative of a type of each phrase of the music piece. In this connection, the repeat control means is arranged to control the concatenating means such that the chord progression produced by the concatenating means has, when the phrase structure set by the phrase structure setting means contains a plurality of phrases similar in type to one another, the same chord progression with respect to the plurality of phrases similar in type.

Another embodiment of the apparatus for producing a chord progression of a music piece in a structural approach comprises phrase characterizing means (F3 in FIG. 3) for characterizing each phrase of the music piece by setting, for each phrase, a starting musical function with which the phrase is to begin and an ending musical function with which the phrase is to end, mini-pattern generating means (3D in FIG. 2; F6 in FIG. 3) for generating variable mini-patterns of chords, concatenating means (F8 in FIG. 3) for concatenating the mini-patterns generated by the mini-pattern generating means to produce a chord progression of the music piece and start/end control means (F9 in FIG. 3) for controlling the concatenating means such that the chord progression produced by the concatenating means has, with respect to the each phrase of the music piece, a chord progression which begins with a musical function identical to the starting musical function set by the phrase characterizing means and ends with a musical function identical to the ending musical function set by the phrase characterizing means. The phrase characterizing means in this arrangement is another example of the musical structure setting means described above, while the concatenating means and the start/end control means embodies the chord progression forming means for producing a chord progression according to the set musical structure.

In the structure-based chord progression apparatus, the musical structure setting means may preferably comprise database means for storing a database of musical structures with respect to various music pieces and selecting means of either automatic or manual type for selecting from the database a musical structure of any particular or desired music piece. This will make it easier for the user to determine a musical structure as a basis of a chord progression; knowledge about musical structures in music is not required at the user's end. In addition, this arrangement can provide various musical structures as needed because a large collection of musical structures can be stored in the database means.

A preferred embodiment of the musical structure database means comprises a database of musical structures at a plurality of hierarchical levels with respect to various music pieces. In the database, each of musical structures at a hierarchical level has a one-to-many correspondence to or hierarchical relationship with musical structures at the immediately lower hierarchical level. In other words, musical structures at one level are arranged in groups according to each of musical structures at the directly higher hierarchic level in music. Structure selecting means useful for such musical database means (musical structure knowledge storage means) may be arranged to select from the musical structure database means musical structures at each of the plurality of hierarchical levels with respect to any particular one of the various music pieces as a music piece instance. The selection of such a music piece instance preferably starts with the highest level in the musical hierarchy concerning the broadest structure in music and is followed by the second highest, then the third highest and so on. This is an efficient way of selecting a desired hierarchical structure of a music piece from the database containing a large amount of information. As noted, this advantage stems from the organization of the musical structure database in which a set of musical structures at each hierarchic level (except the highest level) are segmented or classified into subsets or groups each corresponding to a different one of the immediately higher leveled musical structures so that there is no need to access the whole database for selecting a desired musical structure.

A version of the musical structure database means comprises phrase structure file storage means (3A in FIG. 2) for storing a file of musical phrase structures, arranged in groups by musical forms, and phrase characteristic file storage means (3B in FIG. 2) for storing a file of phrase-starting and phrase-ending musical structures for each musical phrase, arranged in groups by the phrase structures.

In accordance with another feature of the invention, there is provided a chord progression apparatus which comprises chord setting means for setting chords designated by a user for at least one portion of a music piece, leaving at least one blank portion thereof in which chords are to be filled, chord pattern generating means for generating variable chord patterns, and filling means for filling chords in the at least one blank portion by selectively applying the variable chord patterns thereto so that a chord progression will be completed with respect to the music piece.

This arrangement permits the production of a chord progression in two phases or stages. In the first phase, the user-operable chord setting means is used to set chords at least one portion of a music piece, preferable at those portions which is thought or felt conspicuous, fundamental or important. Here, the user may allocate his or her favourite chord patterns to these fundamental portions. In the second phase, the filling means is utilized to fill chords in the remaining blank portions of a music piece by selectively applying to the blanks variable chord patterns from the chord pattern generating means, which may be of a database type such as described before.

If desired, the chord setting means may take the form of a phrase characterizing means for charactering each phrase of a music piece by setting, for each phrase, a starting chord or pattern of chords with which the phrase is to begin and an ending chord or pattern of chords with which the phrase is to end.

A further aspect of the present invention is directed to an apparatus for producing a chord progression based on dialogues or conversations between the apparatus and the user.

This is primarily achieved by an apparatus for producing a chord progression which comprises prompting means (6 in FIG. 1; 12-19 to 12-26 in FIG. 12B; 13-16 to 13-23 in FIG. 13B; 16-6 to 16-13 in FIG. 16A; 110 in FIG. 33; etc.) for presenting a user with a list of choices from which the user selects an alternative, user-operable input means (5 in FIG. 1; 12-27 in FIG. 12B; 13-24 in FIG. 13B; 16-14 in FIG. 16A; 120 in FIG. 33; etc.) for inputting the alternative selected from the presented list of choices, job performing means (13-1 to 13-3 in FIG. 13A; 14-1 to 14-13, in FIG. 14; 16-16 to 16-29 in FIG. 16B; 130 in FIG. 33; etc.) in response to the user-operable input means for performing a job specified by the alternative in order that a cycle of a dialogue action is completed, and dialogue continuing means (13-14 in FIG. 13A; 16-1 to 16-4 in FIG. 16A; 18-1 to 18-4 in FIG. 18A; 140 in FIG. 33; etc.) in response to the job performing means for initiating a cycle of the next dialogue action by creating a list of choices and causing the prompting means to present the user with the latter mentioned list of choices in the cycle of the next dialogue actions, whereby a sequence of dialogue actions are performed which involves a sequence of jobs done by repeated operations of the job performing means in cycles of dialogue actions, the sequence of jobs resulting in production of a chord progression.

This dialogue-based arrangement may be combined with any of the chord progression apparatus described before. As a preferred embodiment, there is provided an apparatus for producing a chord progression which comprises musical structure database means (3A, 3B in FIG. 2; 150 in FIG. 33) for storing a database representing musical hierarchical structures at a plurality of structural levels with respect to a variety of music pieces, chord pattern database means (3C, 3D in FIG. 2; 160 in FIG. 33) for storing a database of chord patterns, and menu-driven interactive means (1,2,5,6 in FIG. 1; 100 in FIG. 33) for conducting a dialogue with a user in a sequence of dialogue actions which involves data retrieval from the musical structure database means and the chord pattern database means and results in production of a chord progression. The menu-driven interactive means comprises prompting means (6 in FIG. 1; 12-19 to 12-26 in FIG. 12B; 13-16 to 13-23 in FIG. 13B; 16-6 to 16-13 in FIG. 16A; 110 in FIG. 33; etc.) for presenting the user with a list of choices (Prisca ( ) in FIG. 9; form ( ) in FIG. 11; way ( ) in FIG. 15; etc.) from which the user selects an alternative, user-operable input means (5 in FIG. 1; 12-27 in FIG. 12B; 13-24 FIG. 13B; 16-14 in FIG. 16A; 120 in FIG. 33; etc.) for inputting the alternative selected from the presented list of choices, job performing means (1, 2 in FIG. 1; 13-1 to 13-3 in FIG. 13A; 14-1 to 14-13 in FIG. 14; 16-16 to 16-29 in FIG. 16B; 130 in FIG. 33; etc.) in response to the user-operable input means for performing a job corresponding to the alternative, thus completing a cycle of a dialogue action, and dialogue continuing means (1,2 in FIG. 1; 13-14 in FIG. 13A; 16-1 to 16-4 in FIG. 16A; 18-1 to 18-4 in FIG. 18A; 140 in FIG. 33; etc.) in response to the job performing means for initiating a cycle of the next dialogue action by creating a list of choices and causing the prompting means to present the user with that list of choices in the cycle of the next dialogue in order that a sequence of dialogue actions are performed by the combination of the prompting means, the user-operable input means, the job performing means and the dialogue continuing means, whereby a chord progression is produced which comprises a concatenation of chord patterns selected from the chord pattern database means and bears a compatible relationship with a musical hierarchical structure selected from the musical structure database means.

For preference, a typical instance of the list of choices comprises a choice of return ("1.RETURN" in: 12-19 in FIG. 12B; 13-16 in FIG. 13B; 16-6 in FIG. 16A; etc.) to a cycle of a dialogue action corresponding to the one that was performed before as well as a group of data items or records selected from the musical structure database means or the chord pattern database means, whereby a dialogue will be conducted in a to-and-fro manner between the user and the menu-driven interactive means.

It is also preferred that a typical instance of the list of choices comprises a choice of automating ("2.AUTO" in: 12-19 in FIG. 12B; 13-16 in FIG. 13b; 16-6 in FIG. 16A; etc.) as well as a group of data items or records selected from the musical structure database means or the chord pattern database means such that when the user selects and inputs the choice of automating by the user-operable input means, the job performing means automatically selects a data item (13-4 to 13-7 in FIG. 13A; 14-4 to 14-7 in FIG. 14; 16-19 to 16-22 in FIG. 16B; etc.) from the group of the data items for the user and performs a job (13-8 to 13-13 in FIG. 13A; 14-8 to 14-13 in FIG. 14; 16-23 to 16-29 in FIG. 16B; etc.) corresponding thereto whereby the user can make variable contributions to the production of a chord progression.

A user-driven interactive means may be provided in place of or in combination with the menu-driven interactive means. In a combination version, the list of choices further includes a choice of a user-driven mode. Having selected the choice of the user-driven mode, a second user-operable input means, which may share the same input hardware as the above-mentioned user-operable input means for selecting an alternative from the list of choice, is used to directly enter a data item (e.g., a chord pattern) or a command (e.g., for jumping to any desired cycle of a dialogue action). This causes the job performing means to execute a job or process corresponding to the entered data item or command.

Any of the chord progression apparatus described in this section may be applied to a musical composer system for composing a music piece. A preferred embodiment of such musical composer apparatus may comprise musical structure setting means (F1 F2, F3 in FIG. 3) for setting a musical structure at one or more structural levels in a music piece, chord pattern generating means (3D in FIG. 2; F6 in FIG. 3) for generating variable chord patterns, chord progression generating means (F8, F9, F10 in FIG. 3) for selectively concatenating the chord patterns generated by the chord pattern generating means based on the musical structure set by the musical structure setting means to provide a chord progression of the music piece, and melody synthesizing means (200 in FIG. 33) for synthesizing a melody of the music piece based on the chord progression from the chord progression generating means.

In the above and in the appended claims, reference characters recited in the drawing are used and enclosed within parentheses in conjunction with associated elements. They are to enable the reader to ascertain quickly the character of the subject matter. However, they are not intended nor designed for use in interpreting the scope or meaning in the claims.

BRIEF DESCRIPTION OF THE DRAWINGS

The above and other objects, features and advantages of the present invention will become more apparent as the description proceeds with reference to the drawings in which:

FIG. 7 shows data formats of list and data files;

FIG. 15 is a flowchart for choosing a method of chord progression generation;

DETAILED DESCRIPTION OF THE PREFERRED EMBODIMENTS

Figure 1:
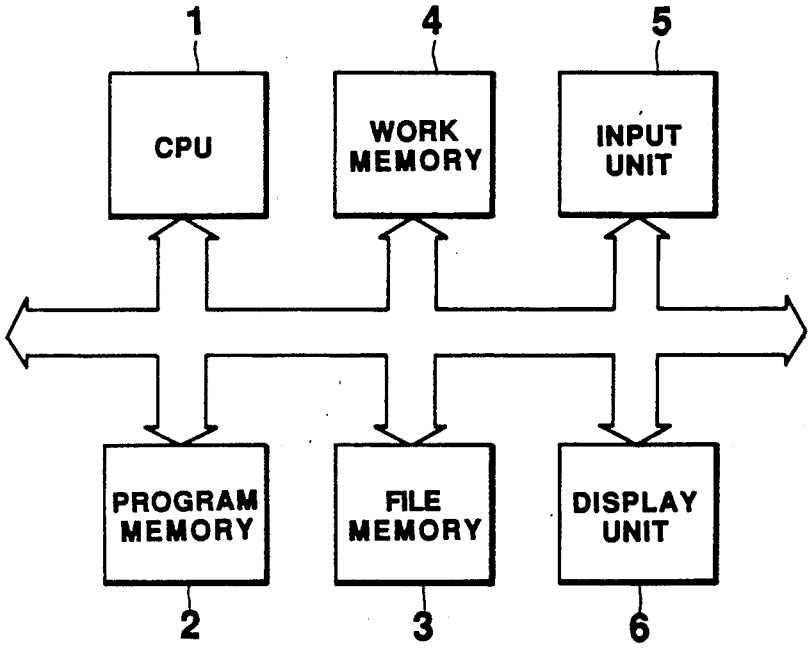
FIG. 1 is a block diagram showing an apparatus for producing a chord progression in accordance with an embodiment of the invention.

In the following, the present invention will be discribed in more detail by way of preferred embodiments. For convenience, headings are indicated at the beginning of respective sections. The first section defines several terms used herein as an aid to facilitate better understanding of the invention.

Terminology

The term "musical structure (in general)" is used herein to mean a hierarchical or multileveled structure in music derived from musical processes and actions which induce comparable cognitions in human mind through perception and experience. The same term is also used to refer to data representative of such a musical structure, when used within a physical system such as the present apparatus. The term "musical form" is typically used to refer to a musical structure (part of the musical structure in general stated above) at the broadest or highest level in music. The term "phrase structure" is used to mean a musical structure at a phrase level. A phrase structure may be represented by a succession or chain of types of respective phrases in a music piece. An example or instance of a phrase structure in music is symborized by A-B-A-B' which means that the first phrase is called type A, the second phrase is different from the first phrase and is thus called B, the third phrase is the same as the first phrase and is called A, the fourth or last phrase is similar to the second phrase and is therefore called B'. At a form or highest level, the music of A-B-A-B' can be said to belong to a two-part or binary form.

The first two phrases A-B may be regarded as a super-phrase or a larger phrase which may be called X. The second super-phrase of A-B' is distinct from the first super-phrase X (=A-B), and may be called Y. Using X, Y symbols, the music of A-B-A-B' is rewritten or reduced into X-Y. Now, there are formed two parts of X and Y from which the music may be called a binary form music. Another example of a phrase structure is symbolized by A-B-C-D-A-B. This may be reduced into three parts of X-Y-X wherein X=A-B, and Y=C-D. Thus, the music of A-B-C-D-A-B can be said to belong to a three-part or ternary form music.

In the embodiment of the invention, music is classified into three categories at a form level of music, i.e., one-part, two-part and three-part forms. It is possible, however, to adopt any other suitable classification of music at a form level. For example music may be classified into two classes of form, i.e., single (or simple) form which is not divisible into smaller, self-contained and complete forms, and compound (or composite) form which contains a plurality of single forms (e.g., movements)

The term "phrase" or "musical phrase" is used to refer to a unit of musical syntax. A super-phrase is a phrase which is relatively large and contains two or more smaller phrases while a sub-phrase is also a phrase which is, however, relatively short and included in a larger phrase as part thereof. It is often that pairs of phrases are joined to form a hierarchical structure. In the above example of the music of A-B-A-B', a pair of phrases A-B (each having, for example, four-measure duration) forms a single eight-measure phrase.

The term "phrase-starting musical function" is a musical function (e.g., tonal-harmonic function) with which a phrase begins while "phrase-ending musical function" is a musical function with which the phrase ends. A pair of phrase-starting and ending functions of a phrase may be regarded as a musical element characterizing the phrase, or as indicative of an essential or fundamental musical structure or progression in the phrase. A set of phrase-starting/ending musical functions for respective phrases of a music piece can, thus, be called a phrase-characterising structure of the music piece.

The term "chord pattern" is used herein to mean a pattern of chords which may be represented at an abstractive or functional level or levels and/or at a more specific level or levels. A functional chord pattern may be described by a combination of at least one of three chordal or harmonic functions of tonic (T), dominant (D) and subdominant (S). Another functional chord pattern may be described by a succession of Roman-letter symbols such as IV-V-I, V(V-I) and II(II-V-I). In accordance with an aspect of the present invention, variable chord patterns are selected one at a time and are concatenated with one another to form a chord progression for a music piece. Thus, each chord pattern is utilized or serves as a unit of a longer chord progression. A more concrete or specific chord pattern may be described by a succession of root-type specifying symbles such as Dmin-$G_7$-Cmaj wherein Dmin indicates a chord with the type of minor triad and the root of D (thus having chord members of D, F, A), $G_7$ indicates a chord with the type of seventh and the root of G (chord members of G, B, D, F) and Cmaj indicates a chord with the type of major triad and the root of C (chord members of C, E, G).

Overall Construction

FIG. 1 shows the overall arrangement of an apparatus for producing a chord progression in accordance with an embodiment of the invention. In FIG. 1, a CPU 1 is operable to generate a chord progression according to a program stored in a program memory 2. A file memory 3 stores hierarchical structure files or database for chord progression generation. A work memory 4 is used by CPU 1 for storage of flags, intermediate data as well as generated chord progression data. An input unit 5 provides user's responses such as selection of data in various files in the file memory 3. A display unit 6 is used to provide a visual presentation of various menus for data selection, data of various files in the file memory 3, a generated chord progression, etc.

File Organization

Now, various files stored in the file memory shown in FIG. 1 will be described with reference to FIG. 2. A phrase structure file 3A comprises a plurality of subfiles or groups of phrase structures for respective musical forms. In the illustrated case, there are three subfiles or groups respectively for one-part, two-part and three-part musical forms. Each subfile is selected according to a selected musical form which is shown externally. In other words, the selected musical form serves as a pointer to a corresponding subfile or group of phrase structures in the phrase structure file 3A. Each phrase structure subfile or group comprises one or more phrase structures. In the illustration, an x-th phrase structure is shown as A-B-A'-B', and an (x+1)-th phrase structure as A-A-B-B.

A selected phrase structure in the phrase structure file 3A serves in turn as a pointer to a phrase starting-/ending function file 3B. The phrase starting/ending function file 3B has data of functions of starting and ending each phrase arranged in groups according to the phrase structures in which each group corresponding to a phrase structure comprises one or more selectable series or strings of phrase starting functions and one or more selectable strings of phrase ending functions. For example, for the phrase structure of A-B-C-A, there are two alternatives of phrase starting strings of T-S-D-T and T-T-T-T. The string of T-S-D-T indicates that the musical function of starting the first phrase is T (tonic), the function of starting the second phrase is S (subdominant), the function of starting the third phrase is D (dominant), and the function of starting the fourth phrase is T, while T-T-T-T indicates that every phrase starts with a musical function of tonic. Thus, for the phrase structure of A-B-C-A either the string of starting functions T-S-D-T or the string of starting functions T-T-T-T can be selected.

A functional chord pattern file 3C stores data of functional chord patterns (functional representation of mini-chord patterns) as units of chord progression of a music piece. This file 3C is divided into two subfiles, one for major music and the other for minor, each subfile being accessible according to an externally selected mode (i.e., either major or minor mode). In the illustrated case, for major music, data T-D-T is shown as functional chord pattern No. 1, and data T-S-T as No. 2.

A selected functional chord pattern in the functional chord pattern file 3C permits access to data of corresponding chord pattern and rhythm pattern (chord time durational series) respectively stored in a chord pattern file 3D and in a rhythm pattern file 3E. The chord and rhythm pattern files 3D and 3E each comprise two subfiles for major and minor. The chord pattern file 3D has one or more specific chord patterns for each functional chord pattern. For example, as specific chord patterns for functional chord pattern T-D-T there are provided CMAJ-G7-CMAJ (first candidate), CMAJ-C#7-CMAJ (second candidate), etc. In an example to be described later, however, the rhythm pattern file 3E has rhythm patterns in one-to-one correspondence to functional chord patterns.

Functions for Producing Chord Progression

Figure 2:
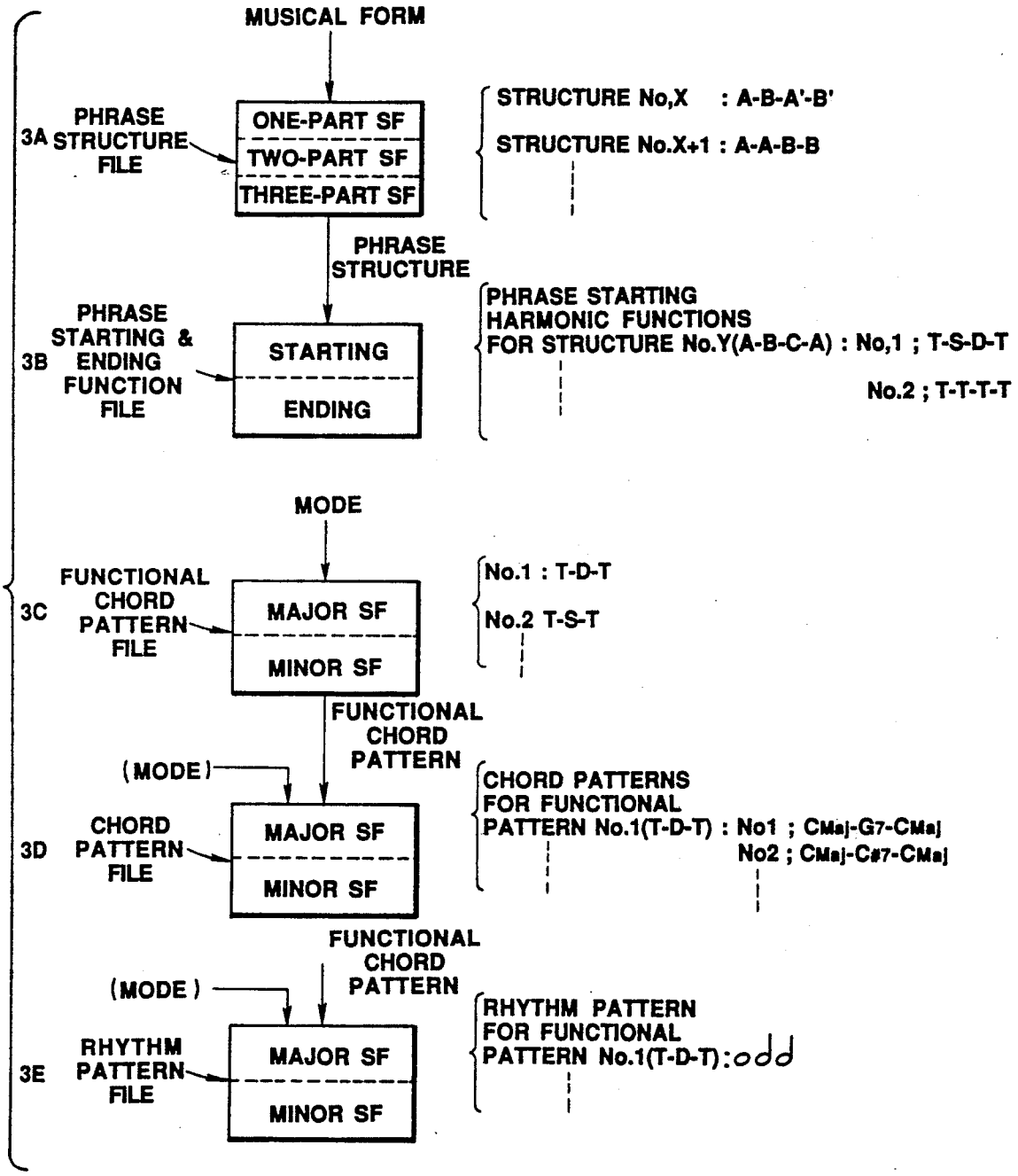
FIG. 2 illustrates a file organizaion in the file memory 3 in FIG. 1.
Figure 3:
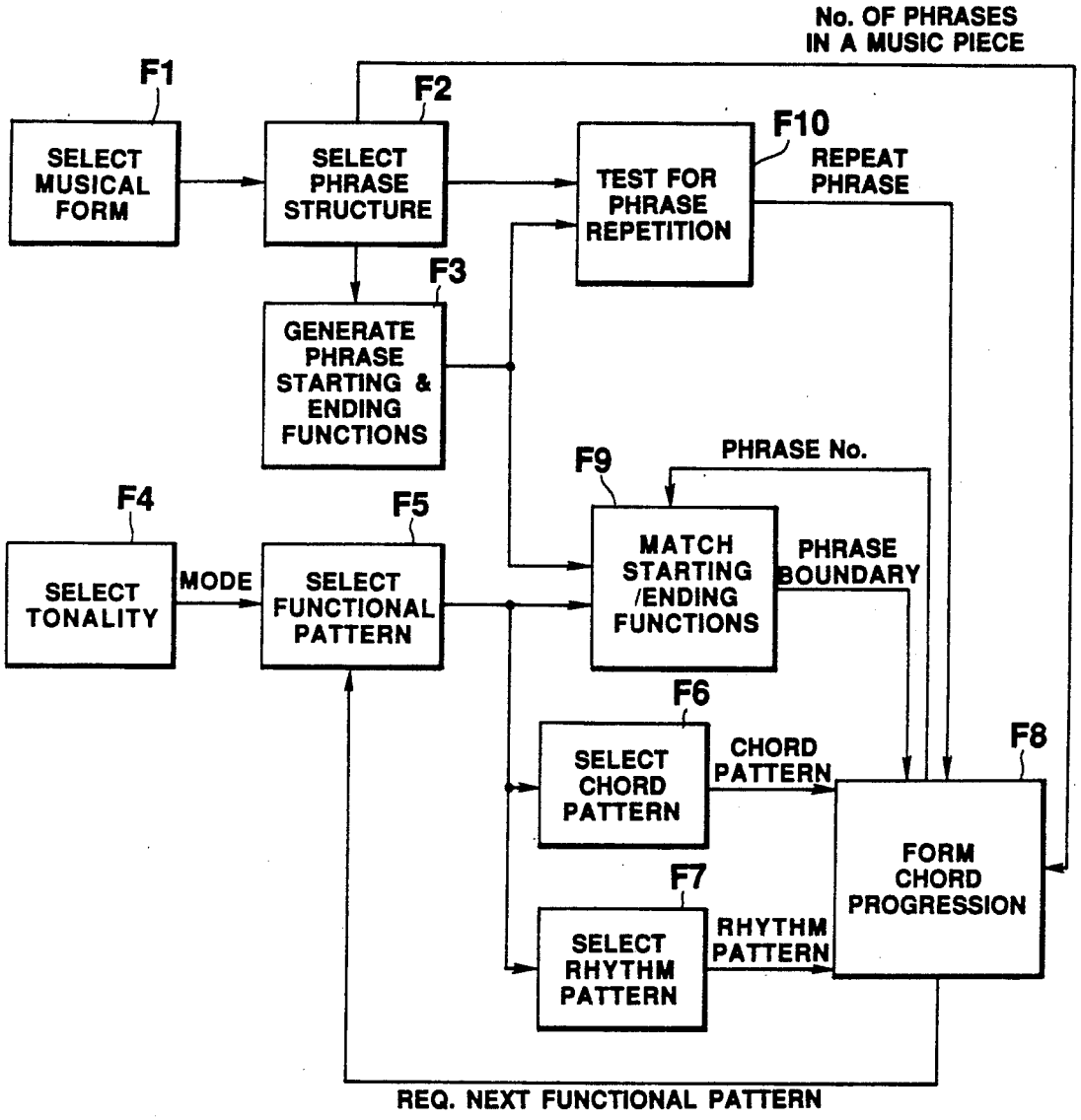
FIG. 3 is a functional block diagram showing main functions of chord progression generation built in the embodiment of FIG. 1.

FIG. 3 shows main functions for the production of a chord progression in this embodiment. A musical form selection section F1 selects a musical form. The selection may be done according to a user's designation via the input unit 5, or it may be done automatically by the chord progression production apparatus. (The same applies to other selection sections F3 to F6, so that it is possible to greatly vary a degree of the user's participation in the chord progression production.) Data of the selected musical form is supplied to a phrase structure selection section F2 which selects a phrase structure from a group or subfile of phrase structures belonging to the selected musical form (see FIG. 2). More specifically, the phrase structure selection section F2 picks out a phrase structure subfile or group in the file 3A pertaining to the selected musical form and presents the user with the subfile on the display unit 6 (FIG. 1) as a list of choices from which the user selects a phrase structure by means of the input unit 5. In the alternative a phrase structure is automatically selected from the phrase structure subfile under the user's choice of automatic mode. The data of the phrase structure selected by the phrase structure selection section F2 is supplied to a phrase structure starting/ending function generation section F3. The section F3 retrieves from the file 3B a subfile or group of phrase starting/ending functions belonging to the selected phrase structure and provides selection of functions of starting and ending each phrase.

A tonality selection section F4 selects tonality (i.e., mode and keynote). The data of the selected mode (i.e., either major or minor mode) is supplied to a functional chord pattern selection section F5 and specifies a functional chord pattern subfile or group in the functional chord pattern file 3C. In the course of producing a chord progression, every time a functional chord pattern request is provided by a chord progression formation section F8, the functional chord pattern selection section F5 selects a new functional chord pattern. Accordingly, the functional chord pattern selection section F5 provides a series of variable functional chord pattern. The data of the functional chord pattern selected by the functional chord pattern selection section F5 is delivered to a chord pattern selection section F6 which selects from the chord pattern file 3D a chord pattern in a chord pattern subfile or group pertaining to the delivered functional chord pattern. The data of the selected chord pattern is supplied to the chord progression formation section F8. The selected functional chord pattern data from the functional chord pattern selection section F6 is also supplied to a rhythm pattern selection section F7 for conversion to a rhythm pattern. The rhythm pattern data thus obtained is supplied to the chord progression formation section F8.

The chord progression formation section F8 forms a chord progression of an intended music piece for each phrase thereof. It concatenates chord patterns from the chord pattern selection section F6 to produce a series of chord names in the chord progression, and also it concatenates rhythm patterns from the rhythm pattern selection section F7 to produce a chord time durational series in the chord progression. Since the chord progression is formed for a phrase after another, the chord progression formation section F8 receives, at the start of chord progression formation, data of the number of phrases in the music piece from the phrase structure selection section F2, and during formation it supplies the ordinal number of the prevailing or current phrase in the chord progression to a phrase-starting/ending function matching section F9. In response to a signal from the starting/ending function matching section F9, indicative of a borderline of the current phrase, the section F8 terminates the current phrase in the chord progression and starts formation of a chord progression for the next phrase.

In order to detect a borderline or boundary between phrases in a chord progression, the phrase starting/ending function matching section F9 receives data of functions of starting and ending each phrase from the phrase starting/ending function section F3 and monitors a stream of functional chord patterns (functional chord series) from the functional chord pattern selection section F5. If it finds a functional chord pair with the first chord function identical to the function of ending the current phrase, and the second chord function identical to the function of starting the next phrase, the section F9 regards the first chord function as being indicative of the end of the current phrase chord progression and the second chord function as indicative of the start of the next phrase chord progression, thus detecting the borderline between phrases. The check of the start chord of the first phrase of music and check of the end chord of the last phrase are simplified.

With the above structure, the chord progression formation section F8 forms a chord progression which bears a compatible relationship with the functions of starting and ending each phrase designated by the phrase starting/ending function generation section F3.

Figure 4:
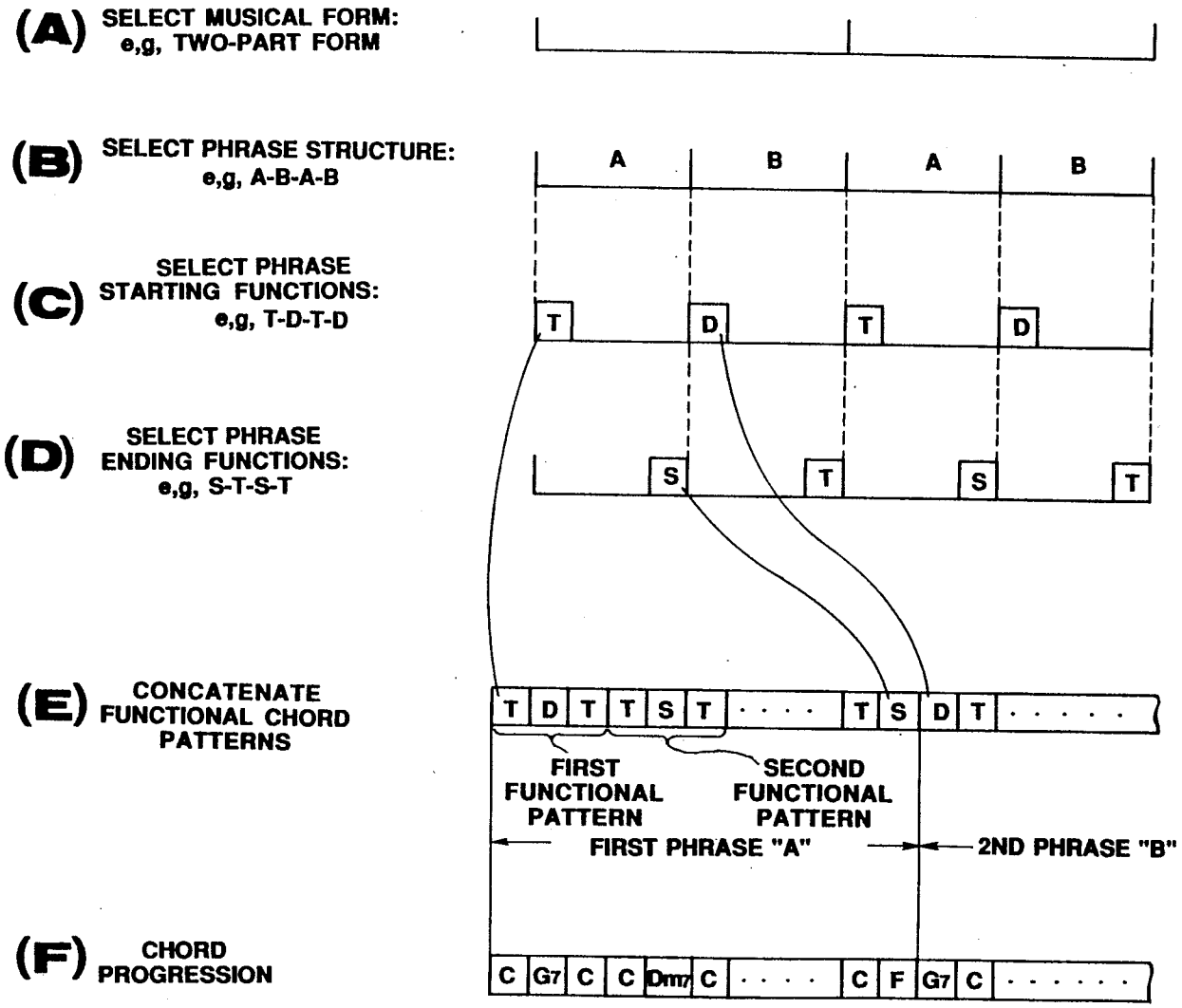
FIGS. 4A–F is a graphic representation showing an example of chord progression generation useful for understanding the operation of the embodiment.

FIG. 4 shows an example of a chord progression produced by the functions described above. In this example, a two-part form is selected as a musical form, phrase structure of A-B-A-B is selected from a phrase structure subfile or group pertaining to the two-part form, and starting function series of T-D-T-D and ending function series of S-T-S-T are selected from respective starting and ending function subfiles or groups pertaining to the selected phrase structure A-B-A-B. As shown in part (E), the functional pattern concatenation (i.e., formation of a chord progression at a functional level) is executed according to the above musical structural features. More specifically, the first functional pattern of T-D-T in the first phrase A starts with tonic (T) identical to the preselected function of starting the first phrase A. In the functional pattern series subsequent to the first functional pattern a pair of functional chords, comprising a first chord function of subdominent (S) identical to the structurally predetermined function of ending the first phrase A, and a second chord function of dominant (D) identical to the preselected function of starting the second phrase B, defines a borderline between the first phrase A and the second phrase B of the functional pattern chord progression.

Likewise, a functional pattern chord progression is formed for the other phrases. Shown in (F) in FIG. 4 are specific chord patterns converted from corresponding functional level chord patterns (E) (assuming C major in the illustrated case).

In the above, the conversion to a specific chord pattern is effected by the chord pattern selection section F6 every time a new functional pattern is selected by the functional pattern selection section F5. However, as is obvious from (E) and (F) in FIG. 4, it is made possible to first complete a chord progression of music at a functional or abstractive level and then convert the completed functional chord progression to a more specific chord progression. In the alternative, completion of a chord progression at the functional level may terminate the entire process. FIG. 4 does not show any chord durational series (rhythm) of the chord progression. This is because the rhythm pattern selection section F7 in FIG. 3 may be omitted.

The chord progression production system shown in FIG. 3 further comprises a phrase-repeating function in addition to the functions described above. This function is provided by a phrase repetition test section F10. This section F10 receives phrase structure data from the phrase structure selection section F2 and phrase starting/ending function data from the phrase starting/ending function generation section F3 and checks if there is any phrase, the chord progression of which is to be repeated. A repetition phrase may be defined by a phrase whose type, and starting and ending functions coincide with those of a previous or past phrase. For example, in the phrase structure of A-B-A-B shown in FIG. 4, the third phrase is of the same type A as the first phrase, and the fourth phrase is of the same type B as the second phrase. Further, regarding the starting and ending functions, the third phrase is of the same T-S as the first phrase, and the fourth phrase is the same D-T as the second phrase. Thus, the third phrase is a repetition of the first phrase, and the fourth phrase is a repetition of the second phrase. This information is delivered from the phrase-repeating test section F10 to the chord progression formation section F8. Receiving this information, the section F8 forms the chord progression for the repetition phrase by repeating the chord progression of the designated previous phrase.

In flowcharts to be described later, however, the immediately preceding phrase alone is considered to be the previous phrase. Therefore, in the case of the phrase structure of A-B-A-B as shown in FIG. 4, no repetition of chord progression occurs The chord progression production system shown in FIG. 3 does not cover all functions described later with reference to flowcharts. Among the missing functions are a function of creating an S (subdominant) progression and a function of creating a D (dominant) progression. An S-progression is a chain or succession of chords in which a preceding chord functions as a subdominant with respect to a succeeding chord. A D-progression is a chain or succession of chords in which preceding chord functions as a dominant with respect to a succeeding chord. In the flowcharts to follow, the S- and D-progressions as well as a progression formed by a chain or succession of functional patterns noted above (F-progression) are all within the user's option of chord progression generative methods so that the user may suitably change or select a chord generation method out of these three methods during the operation to obtain a chord progression which has a natural sense of music and wide variations with insertions of D-and/or S-progressions in F-progressions.

Details

Now, a process of producing a chord progression will be described in detail with reference to the flowcharts.

(General Flow)

Figure 5:
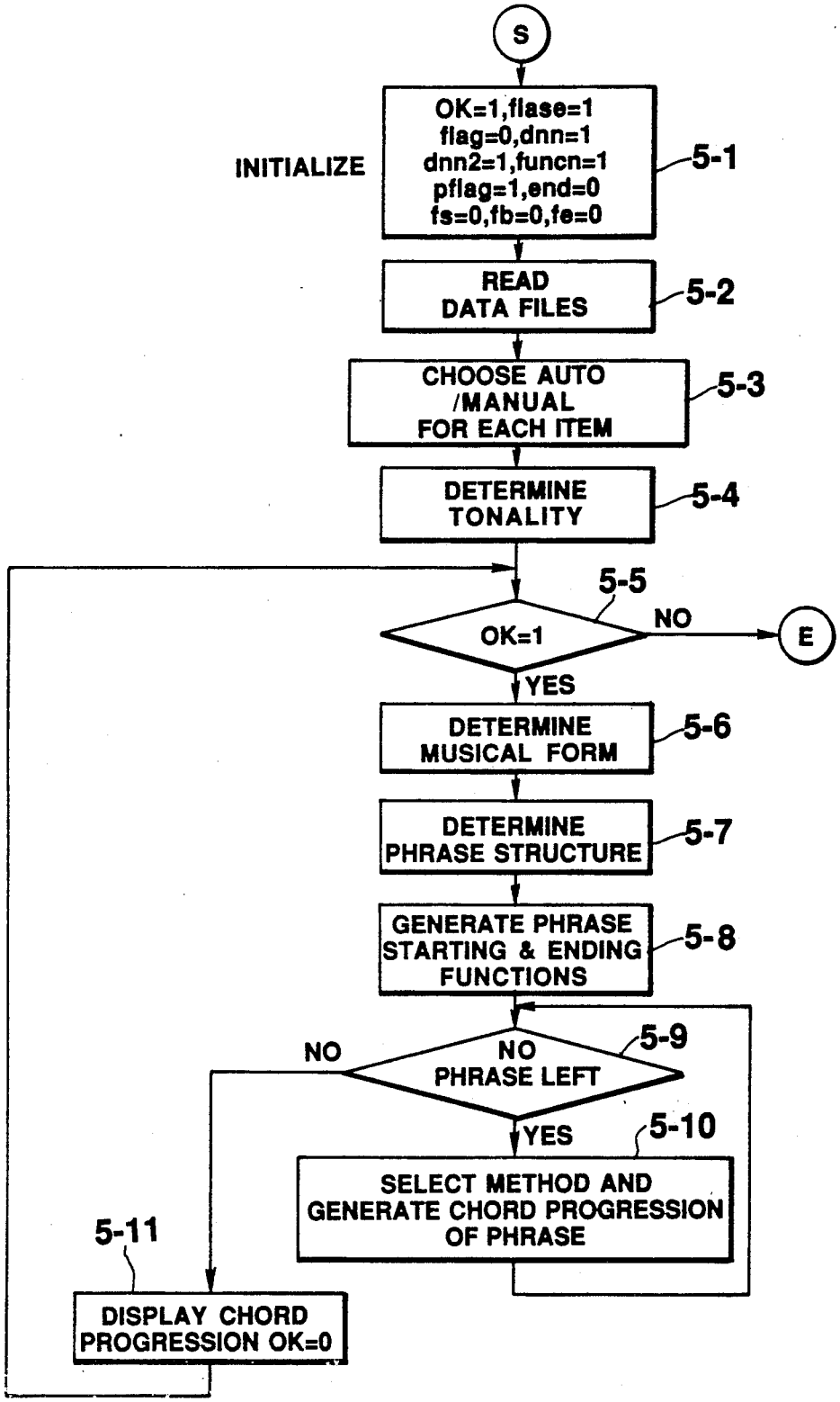
FIG. 5 is a general flowchart of the operation of the embodiment.

FIG. 5 shows a general flow of producing a chord progression. In block 5-1, the system is initialized under the control of CPU 1. Block 5-2 reads from the file memory 3 data files into the work memory 4. Block 5-3 allows the user to make a choice as to whether various items or processes in the production of a chord progression are to be executed automatically or according to user's decisions. Block 5-7 determines a tonality of music. Block 5-6 determines a musical form. Block 5-7 determines a phrase structure. Block 5-8 determines a string of phrase starting and ending functions. Block 5-10 selects a generative method of chord progression from three choices of function-based progression (F-progression), subdominant progression (S-progression) and dominant progression (D-progression), and generates a chord progression by the selected production method on a phrase-after-phrase basis. Block 5-9 checks as to whether there is any phrase remaining for production of a chord progression. If there is no such phrase, the produced chord progression is displayed on the display unit 6 in block 5-11. In response to the displayed information, the user provides an answer to the input unit 5. If the user's answer means satisfaction, OK=1 is met in block 5-5, thus terminating the chord progression production process.

Although not shown in FIG. 5, an actual program is arranged to implement a function of returning to a previous stage or phase in the course of producing a chord progression. By utilizing this function, the user can cancel what was selected and re-select what is desired.

(Reading Data Files)

Figure 6:
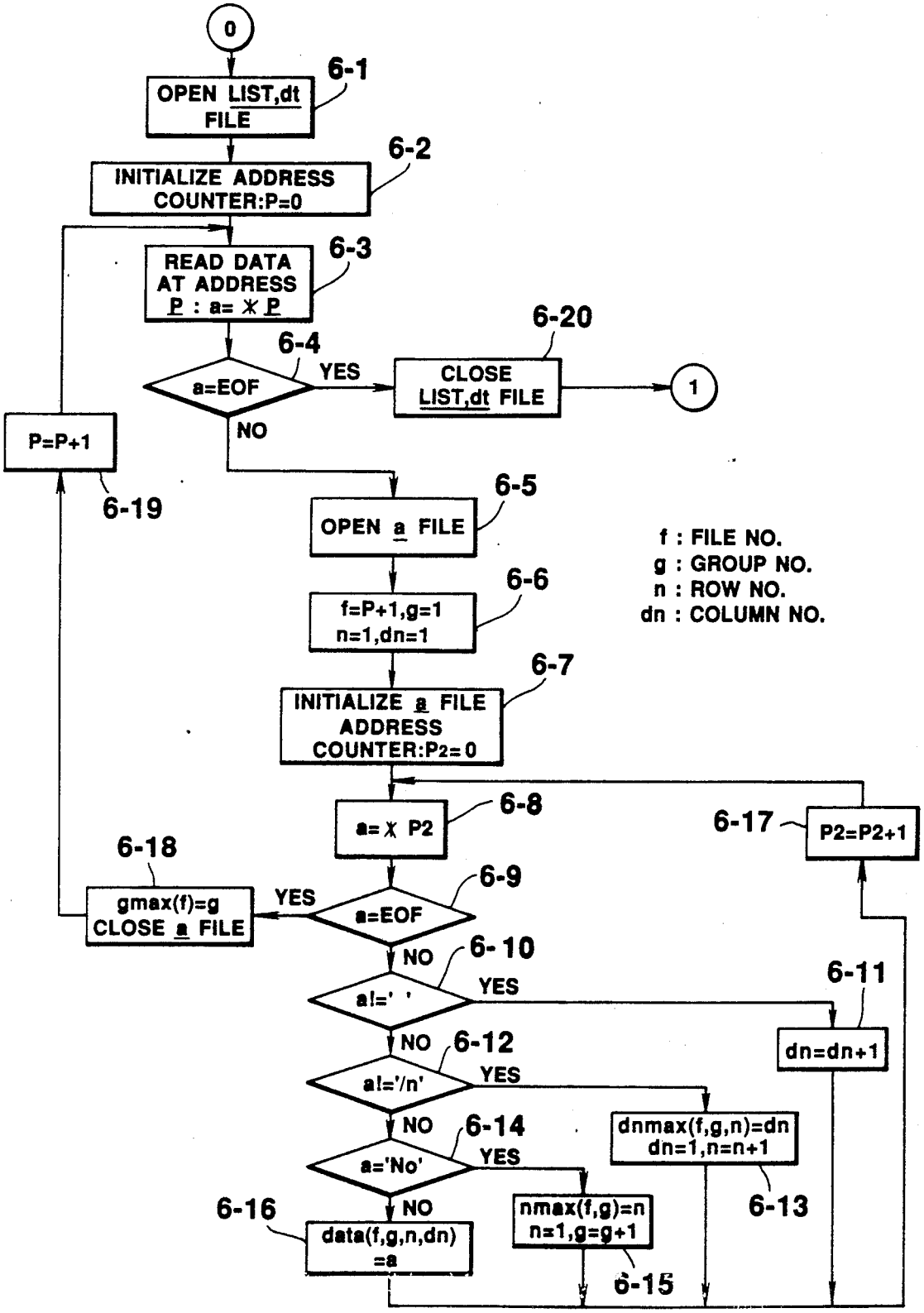
FIG. 6 is a flowchart for reading data files.

FIG. 6 shows details of the block 5-2 in the general flow for reading data files. In the flow of FIG. 6, block 6-1 opens a LIST dt file in the file memory 3. The LIST dt file is illustrated in part (A) of FIG. 7. As is shown, this file contains in each address thereof a pointer of the first address of a data file. More specifically, there is a pointer to the phrase structure file in the first address, and in the following addresses there are pointers respectively to the phrase starting function file, phrase ending function file, functional chord pattern file, major chord pattern file, minor chord pattern file and rhythm pattern file. An end-of-file code EOF is provided in the last address. Each of the data files has a format as shown in part (B) of FIG. 7. According to the format, each file has one or more groups. A group partitioning mark "No" is provided between adjacent groups. Each group has one or more rows. A row-partitioning mark "/n" is inserted between adjacent rows. Each row has one or more columns. A column-partitioning mark " " is provided between adjacent columns. Block 6-2 in FIG. 6 initializes a LIST dt file address pointer P, and block 6-3 through 6-20 copies the stored data at respective addresses of the data files into data(f,g,n,dn) specified by file number f, group number g, row number n and column number dn by stepping through the data file addresses while scanning LIST data file addresses.

More specifically, block 6-3 reads data in an address of the LIST data file indicated by the pointer P. Unless the read-out data is the end-of-file code EOF (No in block 6-4), the data points to a data file. Block 6-5 thus opens this data file. Block 6-6 sets the file number f thereof, while initializing the group number, row number and column number of the file, and block 6-7 initializes the data file address pointer P2. The program then loads data from the address of data file indicated by the pointer P2 (6-8), and executes subsequent part of the routine while incrementing the pointer P2 (6-17) until the end-of-file code EOF of the data file is found (6-4). More specifically, when the program reads data other than any column-partitioning mark " ", any row-partitioning mark "/n" or any group-partitioning mark "No" (i.e., when NO is provided in each of check blocks 6-10, 6-12 and 6-14), it sets that data in data(f,g,n,dn) (6-16). When the program reads a column-partitioning mark" ", it increments the column number dn (6-11). When reading a row-partitioning mark "/n", the program sets dnmax(f,g,n) to the number of column data contained in the preceding row and restores the column number dn to that of a first column and incrementes the row number n (6-13). When it reads a group-partitioning mark "No", it sets nmax(f,g) to the number of rows contained in the preceding group, restores the row number n to that of a first row, and increments the group number g (6-15). When it reads the end-of-file code EOF of data file in block 6-9, it sets gmax(f) to the number of groups contained in the data file, closes the data file (6-18), increments the LIST dt file address pointer P(6-19) and goes back to the block 6-3. When the program reads the end-of-file code EOF of the LIST dt file (6-4), it closes the LIST dt file (6-20), thus completing the process of reading data files.

The data(f,g,n,dn) obtained in the reading process are data each specified by the file number f, group number g, row number n and column number dn, each dnmax(f,g,n) represents the number of pieces of data contained in the file f, group g and row n, each nmax(f,g) represents the number of rows contained in the file f and group g, and each gmax(f) represents the number of groups contained in the file f.

In the following description, the information in data files will be referred to in a convenient manner. For example, a file of f=1, which represents the phrase structure data file, will be referred to as phrase structure data file f1, and a combination of f=1, g=1, which represents the one-part musical form group in the phrase structure data file, will be referred to as one-part musical form group g1 in phrase structure data file f1.

Auto/Manual Choosing

Figure 8:
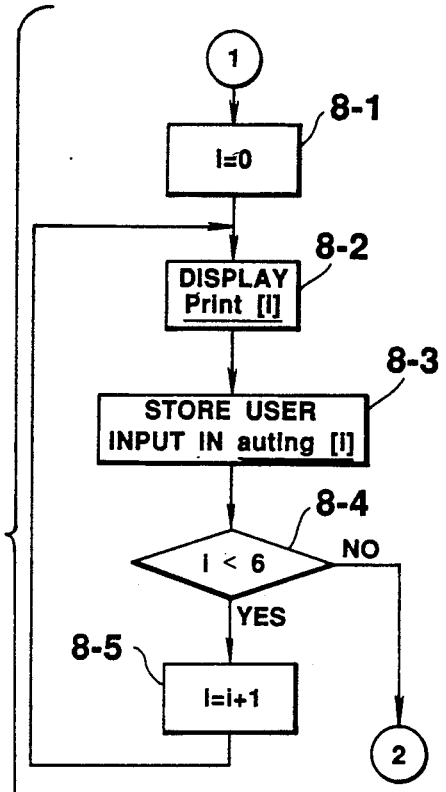
FIG. 8 is a flowchart for choosing an auto/manual mode with respect to each process item.

FIG. 8 shows details of the process 5-3 in the general flow for auto/manual choosing.

The items or domains, for which the auto/manual choice can be made, include (1) tonality, (2) musical form, (3) phrase structure, (4) phrase starting/ending functions, (5) chord generation method, (6) chord pattern and (7) rhythm pattern. The flowchart of FIG. 8 is arranged to allow the user to input an auto/manual choice for each of the items noted above. More specifically, block 8-2 displays an item on the display unit 6 to ask the user about the auto/manual choice for that item. When a user's answer is provided to the input unit 5, it is set in auting(i) in a block 8-3. The state of auting(i)=0 indicates that a manual mode has been chosen for the i-th item while auting(i)=1 indicates that an automatic mode has been chosen for the i-th item. It should be noted, however, that the choice here is not a final choice, but can be changed later by using a returning function.

(Tonality)

The process 5-4 (FIG. 5) of determining a tonality will now be described in detail.

Figure 9:
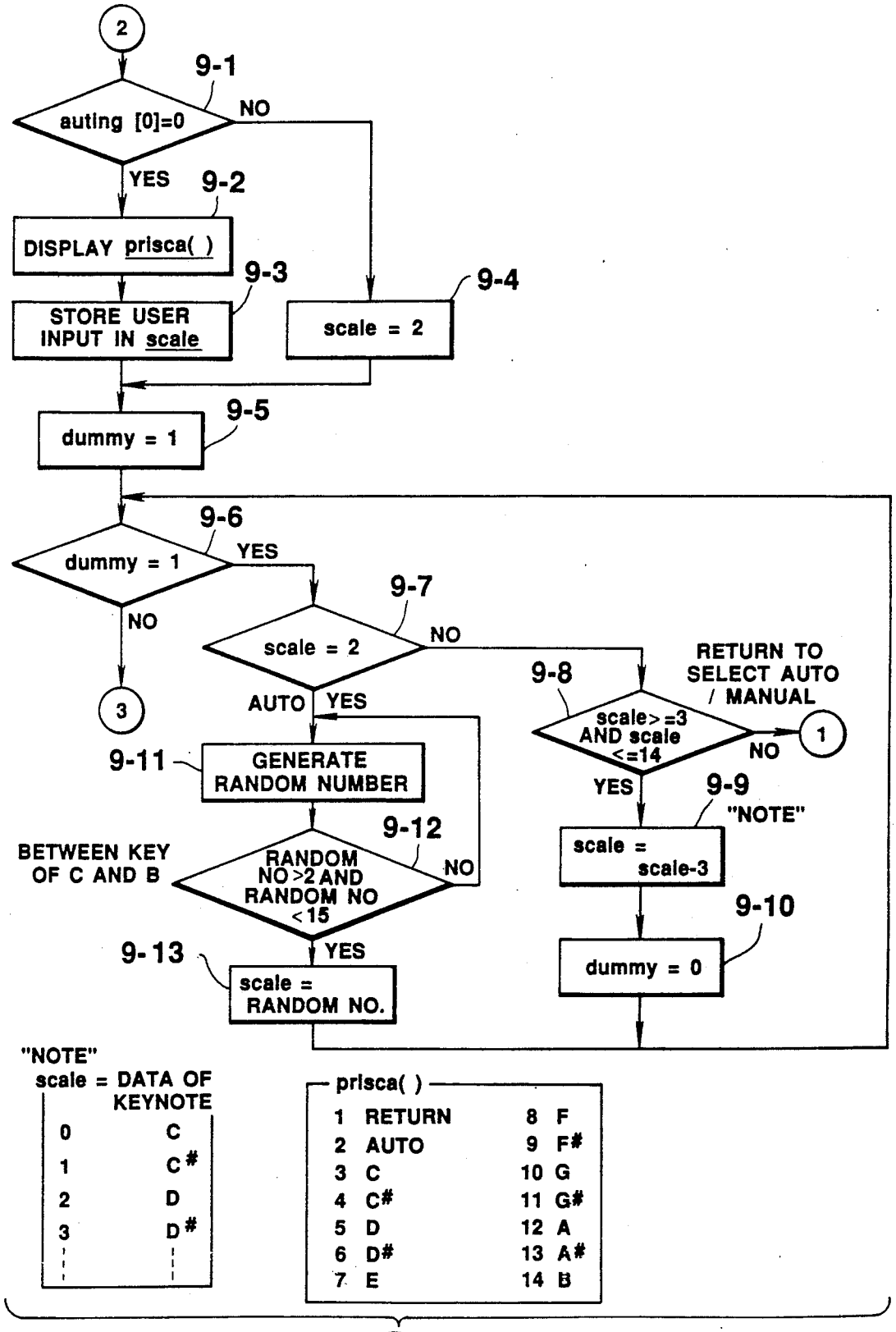
FIG. 9 is a flowchart for determining a keynote of tonality.
Figure 10:
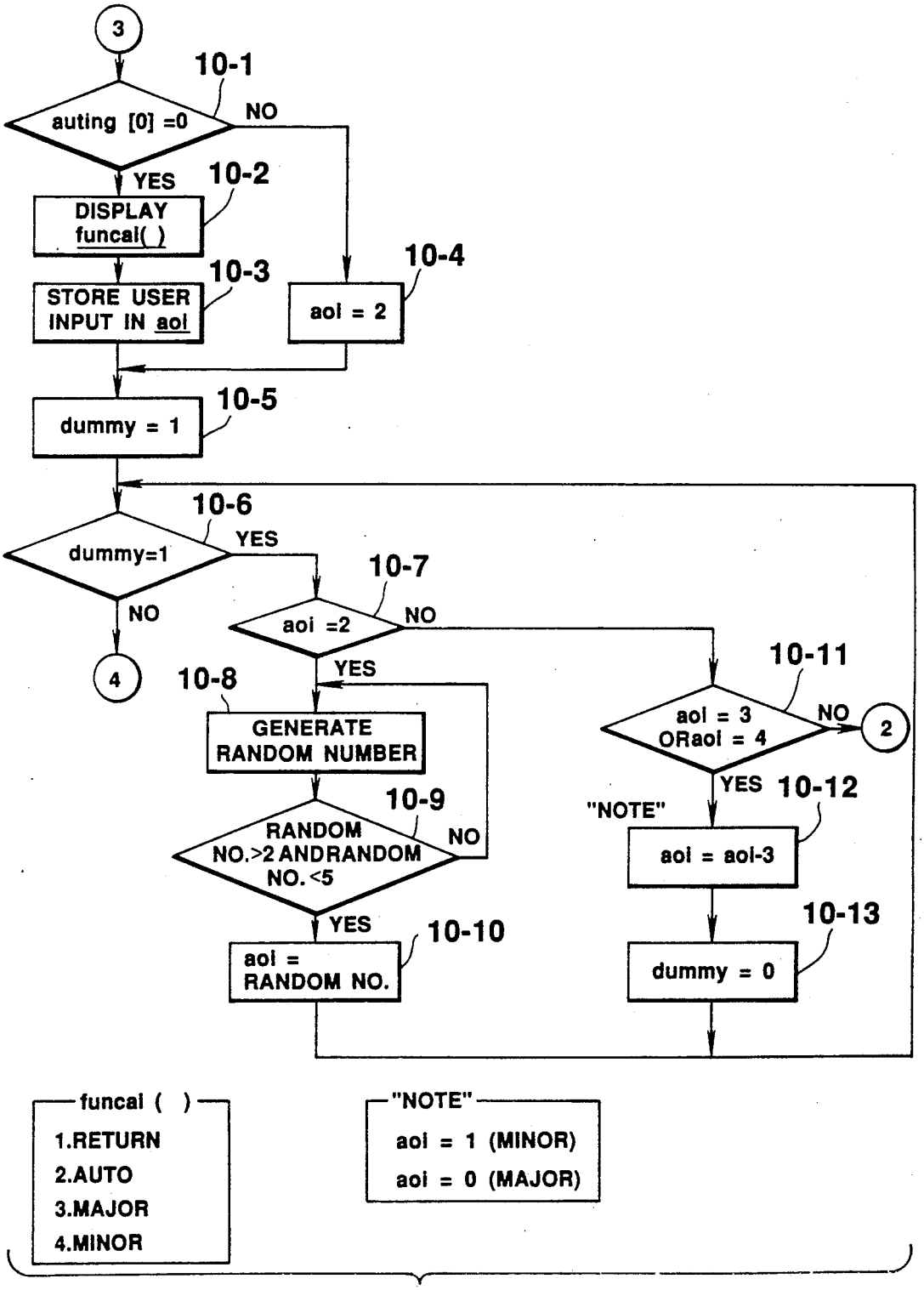
FIG. 10 is a flowchart for determining or selecting a tonality mode.

A tonality is specified by determining both keynote and mode (i.e., either major or minor mode). The flowchart of FIG. 9 is for determining a keynote, and the flowchart of FIG. 10 is for determining a mode.

In the determination of a keynote (FIG. 9), the first block 9-1 tests the content of auting(O) to see whether automatic or manual mode of tonality determination has been chosen in the auto/manual process (FIG. 8). In the case of manual determination, a keynote selection menu Prisca( ) such as shown in the bottom right of FIG. 9 is displayed. In this menu, No. 3 to No. 14 correspond to respective keynotes C to B, No. 1 to "RETURN", and No. 2 to "AUTO". The user selects an intended No. in the menu which is stored into "scale" (9-3). When automatic tonality determination has been chosen, No. 2 ("AUTO") is set in the scale (blocks 9-1 and 9-4).

In a block 9-5, a job request flag "dummy" is set to "1", and keynote data is determined in blocks 9-6 through 9-13. The keynote data format is arranged such that the value of "0" represents C, "1" represents C#, and so forth, with "11" representing B. This numerical expression is obtained by subtracting 3 from a number selected in the keynote selection menu Prisca( ). To this end, when the user selects an keynote, the program passes through blocks 9-8 and 9-9 in which the value of the scale is decremented by 3. The next block 9-10 sets the dummy to "0" to indicate completion of the keynote determination. When the automatic determination has been chosen, block 9-7 finds scale=2. In this case, blocks 9-11 and 9-12 generate a random number for a keynote number, and block 9-13 sets this number in the scale. The program then goes back to the block 9-6 and then through the blocks 9-7 and 9-8 to the block 9-9 in which the scale data is converted to the final keynote numerical value expression. When No. 1 ("RETURN") is selected in the keynote selection menu Prisca( ), the program will return to the previous process of auto/manual choosing (FIG. 8) via block 9-8. When block 9-6 finds from dummy=0 that a keynote has been determined, the program advances to the mode determinaion flow (FIG. 10).

It is to be understood that the keynote determination is performed depending on the auto/manual choice, that is, in the case of the manual choice the keynote menu is displayed for prompting the user to select a keynote, while in the case of the automatic choice a keynote is automatically determined according to a random number. The menu further includes "RETURN" and "AUTO" options. When the "RETURN" is chosen, the program returns to the immediately preceding process of auto/manual choice. In addition, even when the user has chosen the manual option in the auto/manual choice step, he can change that choice to the automatic mode when presented with the keynote menu. The processes to follow also have similar functions of returning to the previous process and changing to an automatic mode.

The musical mode (major/minor) determination flow (FIG. 10) resembles the tonality determination flow, so it will be described briefly. First, a check is done as to whether the tonality is determined automatically or manually. When the keynote is determined manually, a mode menu funcai( ) is displayed, and what is manually selected from the menu, i.e., (1)"RETURN", (2)"AUTO", (3)"MAJOR" or (4)"MINOR" is set in aoi (blocks 10-1 to 10-3). In the case when an automatic option has been chosen for the determination of the tonality, the mode aoi is automatically determined according to a random number (10-1, 10-4 and 7-10 through 7-10). The major mode is represented by "0", and the minor mode by "1". Blocks 10-11 through 10-13 are thus provided for aoi data conversion. When the "RETURN" is selected in the menu, the program goes back to the keynote determination flow (FIG. 9).

(Determination of Musical Form)

The process 5-6 of determining a musical form, shown in the general flow will now be described in more detail. A musical form is determined in blocks 11-1 through 11-11 in FIG. 11.

First, auting(1) is checked to see whether a musical form is to be determined automatically or manually (11-1). In the case of the manual option, a musical form menu form( ) is displayed (11-2). The form( ) has choices of (1)"RETURN", (2)"AUTO", (3)"ONE-PART", (4)"TWO-PART" and (5)"THREE-PART". The user selected No. in the menu is set in cmn (11-3). In the case of the automatic option, No.2 ("AUTO") is set in cmn (11-1 and 11-4).

When the "RETURN" is selected form the menu, cmn=1, so that the program goes back to the mode determination routine (FIG. 10) by way of blocks 11-5 through 11-8. When a musical form is selected from the menu, cmn=3 to 5, so that the program goes through blocks 11-5 through 11-7 and to a phrase structure selection process in a block 11-12 and following steps. When automatic determination is chosen, cmn=2, so that the program goes from the block 11-6 through blocks 11-7 and 11-8 to blocks 11-9 to 11-11 in which a musical form is selected according to a random number and set in cmn. The program then goes back to the block 11-7 and then to the phrase structure selection flow in the block 11-12 and the following blocks. It is noted that in the instant embodiment, there are three available musical forms, i.e., one-part, two-part and three-part forms, and the musical form selected either automatically or manually as described above is set in cmn.

(Determination of Phrase Structure)

Now, the process 5-7 in the general flow for determining phrase sructure will be described in more detail. This process comprises blocks 11-12 to 11-25 and 11-6 in FIG. 11, and blocks 12-1 to 12-7 and 12-8 to 12-12 in FIG. 12A.

As noted above, the phrase structure data file f1 contains phrase structure data arranged in groups according to the musical forms. A group g pertaining to a selected musical form is called by setting g register to a musical form number (cmn-2) obtained in the above musical form determination process and setting f=1 (blocks 11-12 and 11-13). Here, n=1 means indicates a number assigned to the first phrase structure in the group g, and dn=1 indicates a number assigned to the first phrase in the first phrase structure. No=3 indicates a menu option number designating the first phrase structure candidate displayed in a phrase structure menu to be described later. A block 11-14 checks the content of auting(2) to see whether the choosing of a phrase structure is to be done automatically or manually. In the case of the manual selection, blocks 11-15 to 11-23 display a phrase structure menu and receives a user's alternative chosen therefrom. The phrase structure menu comprises a choice of "RETURN" as option number 1, a choice of "AUTO" as option number 2, and as the following options a list of phrase structures belonging to the selected musical form group g in the phrase structure data file f1. Specifically, the block 11-15 displays "1.RETURN" and "2.AUTO". The block 11-16 displays No. and data(f,g,n,dn) representative of a type of dn-th phrase in n-th phrase structure data (for instance A-B-A-B) belonging to g-th musical form in the phrase structure data file f1. When the block 11-17 in a loop of blocks 11-6 to 11-18 detects the completion of reading of n-th phrase structure data by referencing the number dnmax(f,g,n) of phrases of that phrase structure, the phrase number dn is re-initialized to that of a first phrase (block 11-19). Then, the block 11-20 tests to see whether all phrase structures contained in the selected musical form g have been read out by referencing the number nmax(f,g) of phrase structures of the form g. If the reading is not over, the menu option No. and phrase structure number n are incremented, and the program goes back to block 11-16. Thus, if the block 11-20 detects that n has reached nmax(f.g), there has been presented on the display unit 5 a list of phrase structures belonging to the selected musical form g. Then the number is restored to n=1 (block 11-22), and if a selected number is supplied from the user by the input unit 5, it is set in frn. The frn is such that 1 represents "RETURN", 2 "AUTO", 3 the identifier of the first phrase structure belonging to form g, 4 the identifier of the second phrase structure of form g and so on.

Figure 12A:
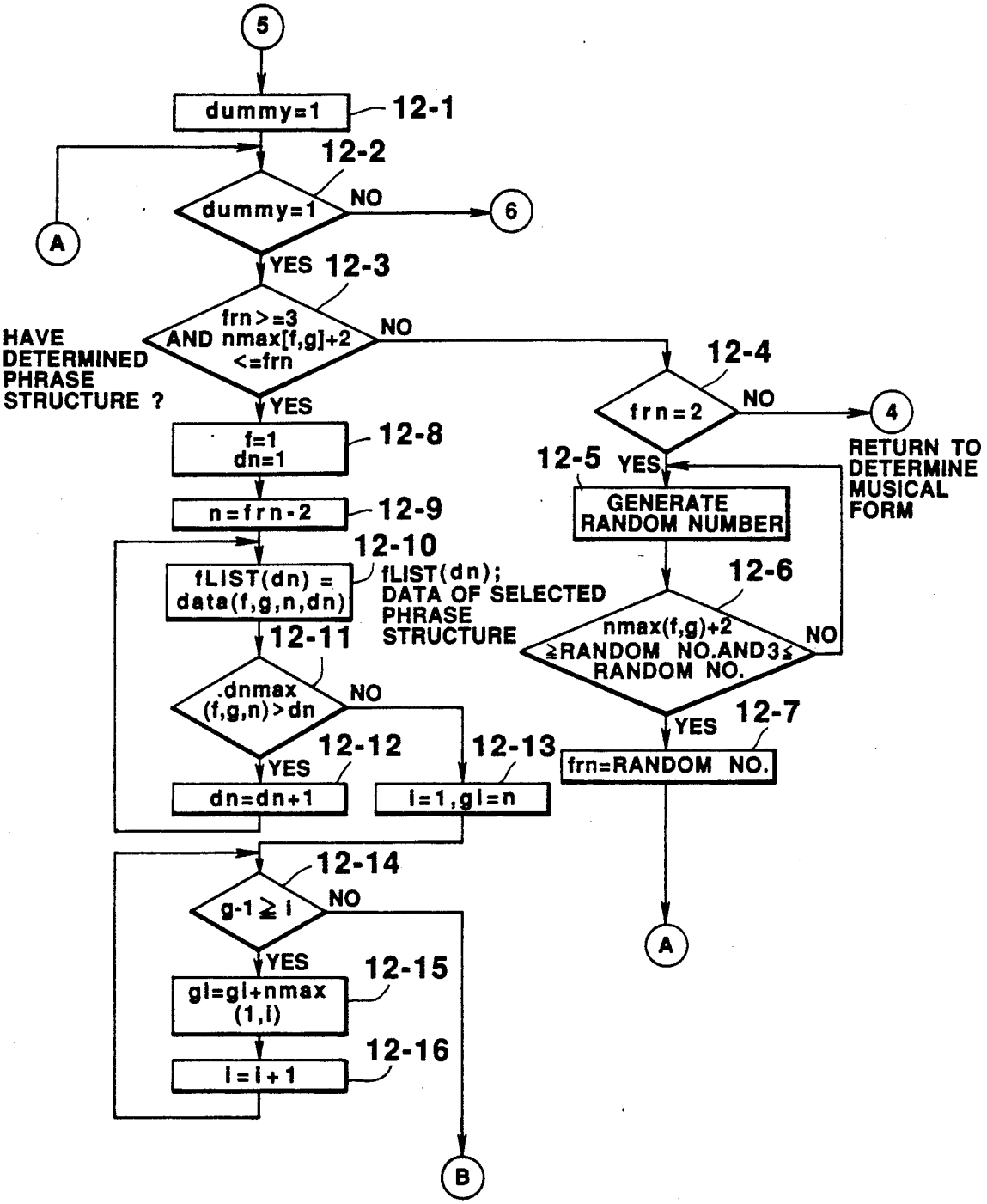
FIGS. 12A and 12B are flowcharts for selecting a phrase structure.

When it is found by the block 11-14 that the choice of a phrase structure is to be done automatically, auto value "2" is set in frn. When frn=2, the block 12-4 in FIG. 12A provides YES, causing the blocks 12-5 to 12-7 to generate a selected phrase number according to a random number and set the generated number in frn.

Figure 11:
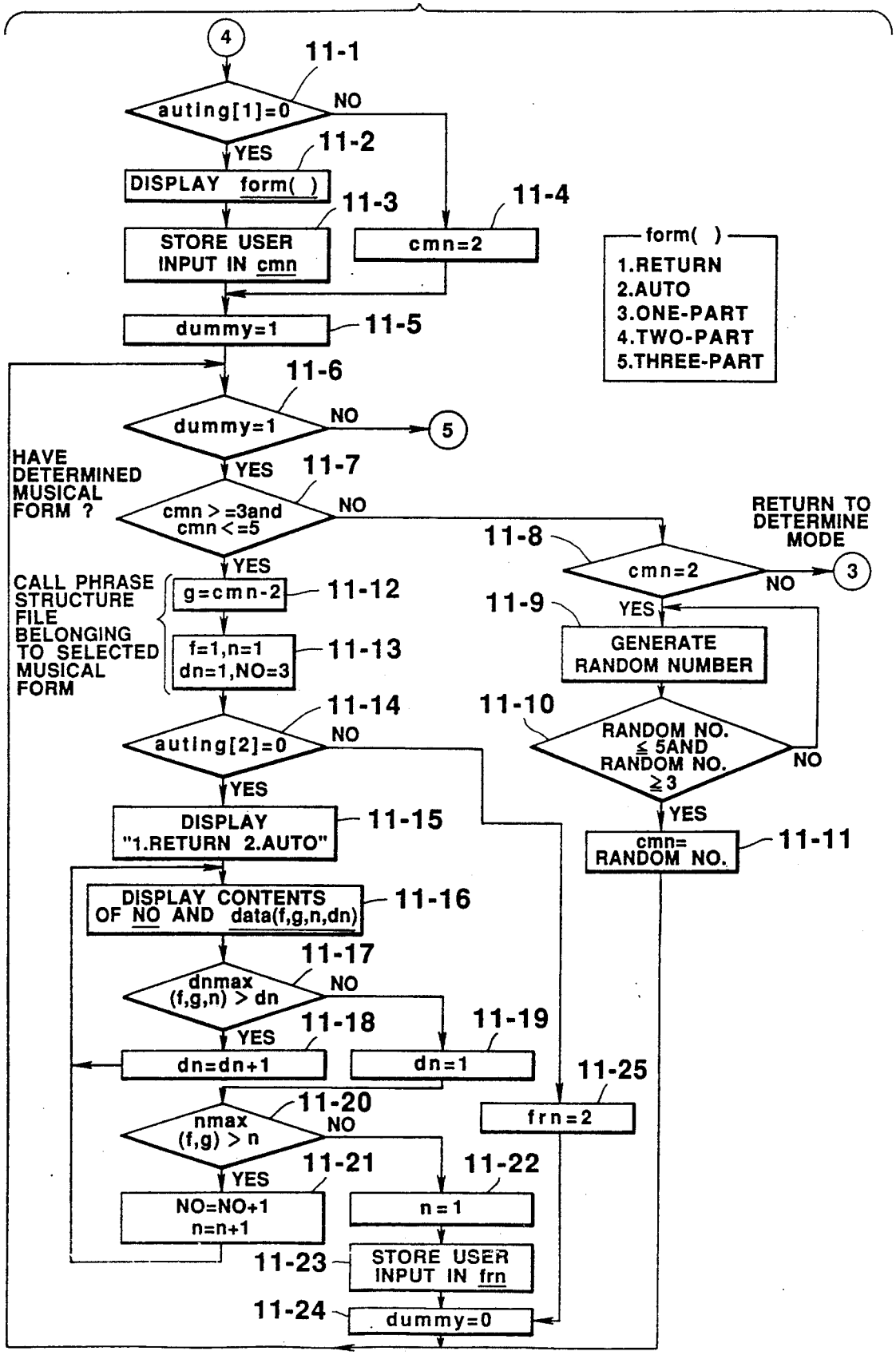
FIG. 11 is a flowchart for determining a musical form.

When frn=1, i.e., "RETURN" has been selected from the menu, the block 12-4 provides NO, causing the program to return to the musical form determination process (block 11-1 in FIG. 11). When the block 12-3 see $3 \leqq frn \leqq nmax(f,g)+2$, this indicates that a phrase structure has already been determined. Thus, the blocks 12-8 and 12-12 store the determined phrase structure data in fLIST(dn) array. This is accomplished by transferring data (f, g, n, dn) of the selected phrase structure n of musical form g from the phrase structure file f1 to the array fLIST (dn) with respect to dn=1 to dnmax(f, g, n).

(Production of Phrase Starting and Ending Functions)

Figure 12B:
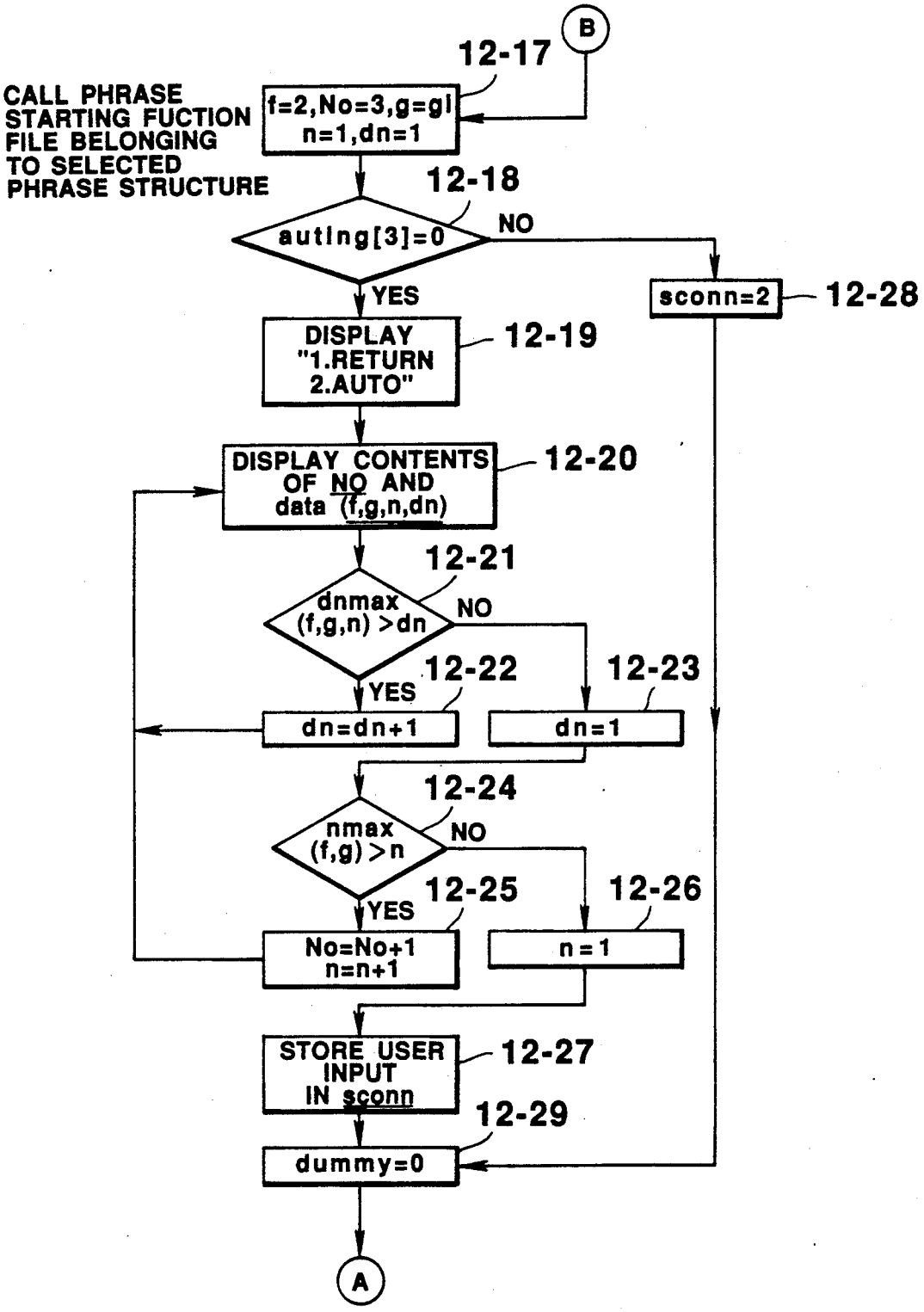
Figure 13A:
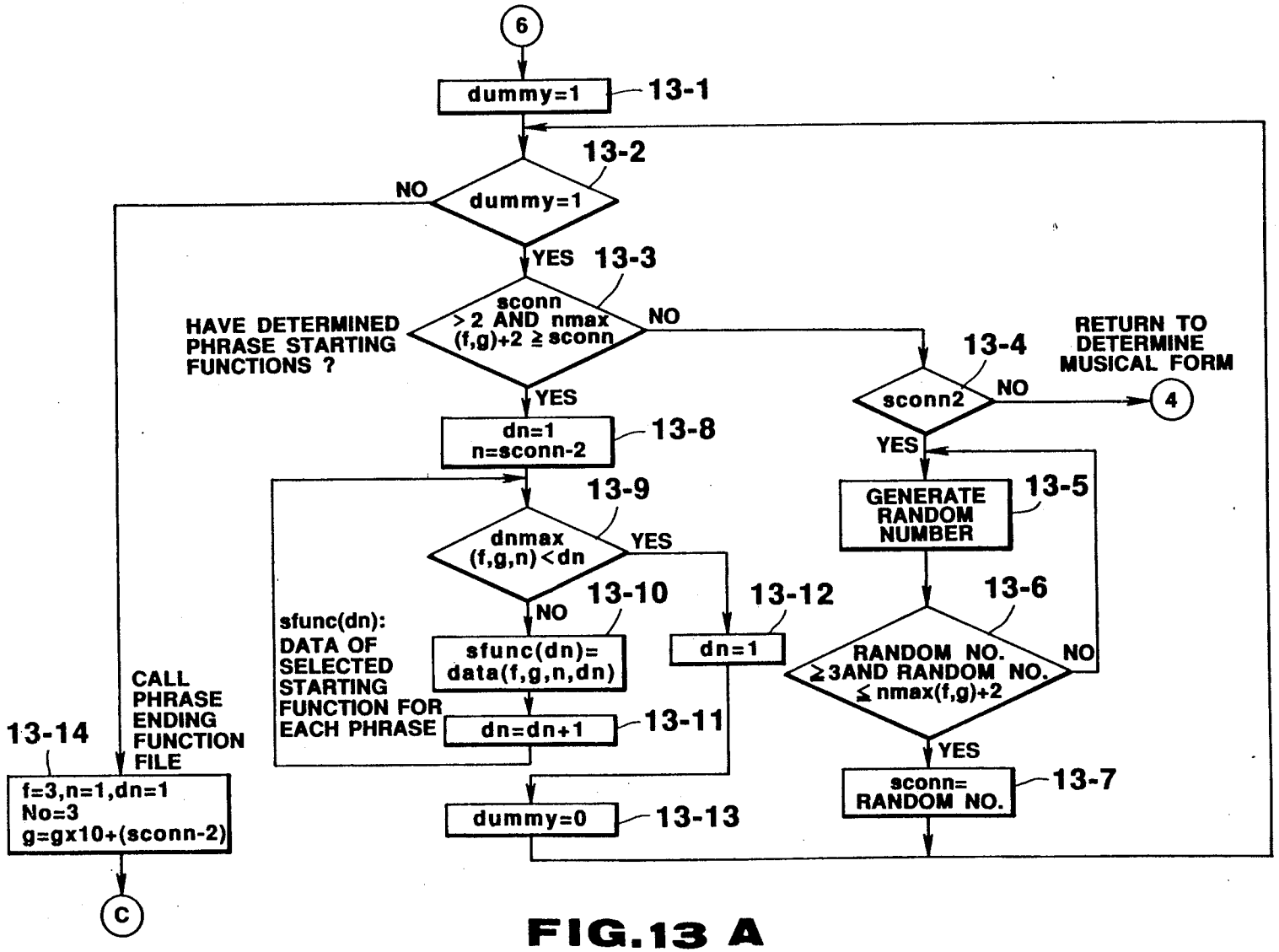
FIGS. 13A, 13B and 14 are flowcharts for determining a phrase starting and ending function.
Figure 13B:
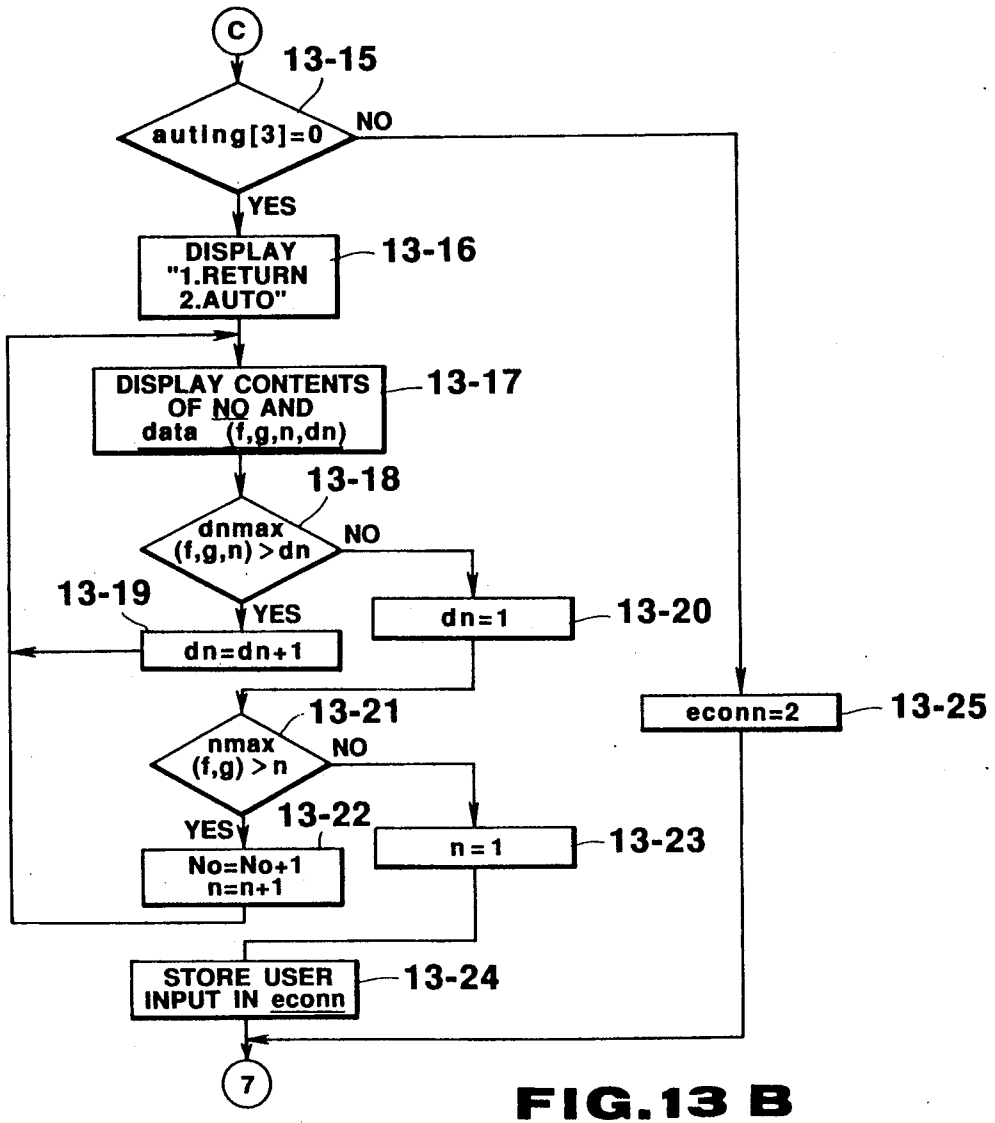
Figure 14:
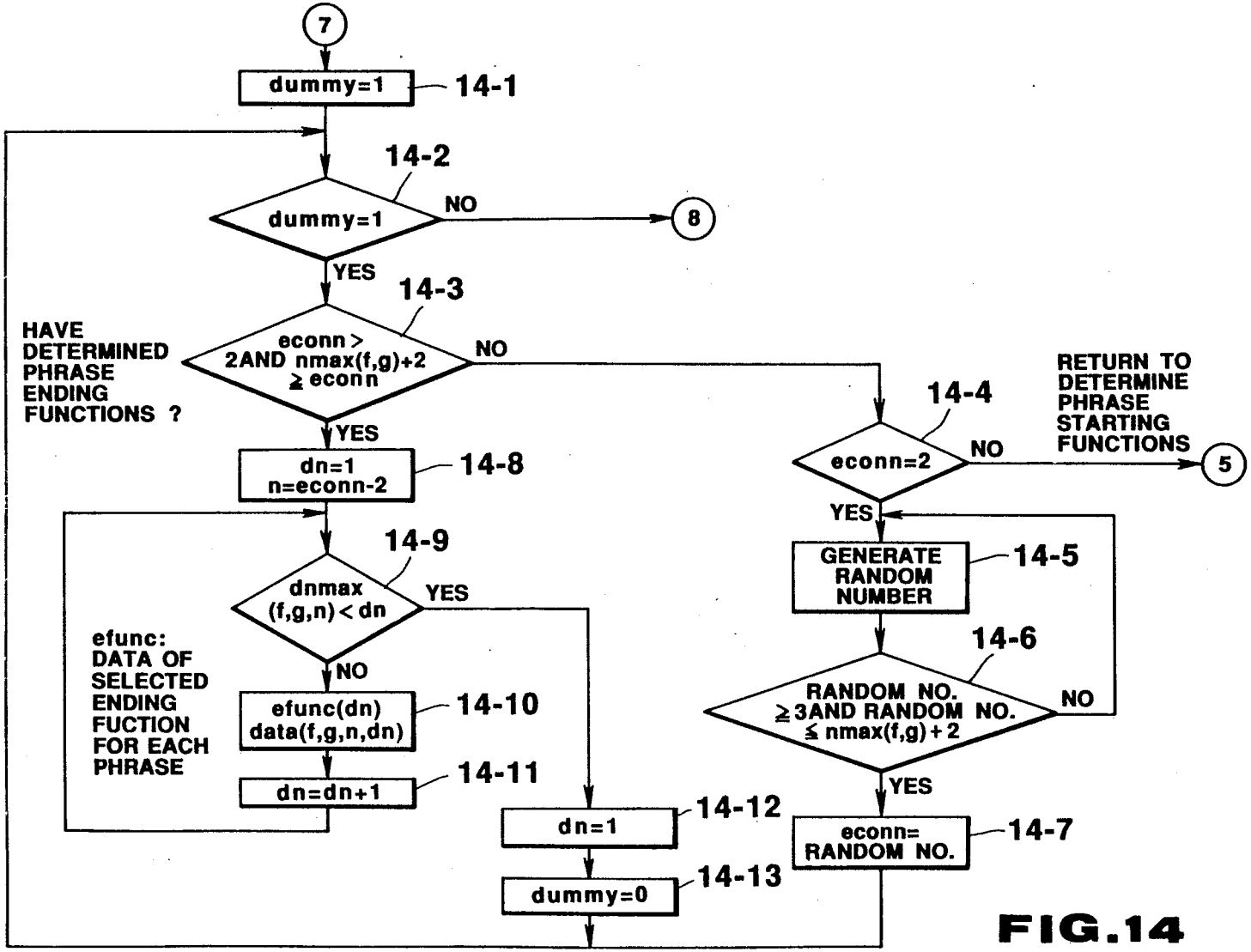

The process 5-8 in the general flow for generating phase starting and ending functions will now be described in detail. This process is subdivided into a phrase starting function generation process and a phase ending function generation process. The former process is implemented by blocks 12-13 to 12-29 and 12-2 in FIGS. 12A and 12B, and blocks 13-1 to 13-13 in FIG. 13A, while the latter process is done by blocks 13-14 to 13-25 in FIGS. 13A and 13B, and the flow of FIG. 14.

As noted before, the phase starting and ending function files f2 and f3 each have subfiles or groups classified according to the phrase structures in the phrase structure data file f1. Thus, a first step in the phrase starting function generation process is to find out a group g in the phrase starting function file f2 pertaining to the selected phrase structure. The address calculation of this group is executed in blocks 12-13 through 12-16 in FIG. 12A. More specifically, the group number g in file f2 pertaining to the n-th phrase structure of musical form x in the phrase structure data file f1 is given by $$g = n + \sum_{i=1}^{x-1} n\max(1,i)$$

where nmax(1,i) represents the number of phrase structures of musical form x in the phrase structure data file f1. The block 12-17 locates from the phrase starting function data file f2 the head of the group g pertaining to the selected phrase structure.

The block 12-18 then checks as to whether the phrase starting/ending function generation is to be effected automatically (auting(3)=1) or manually (auting(3)=0). In the manual case, a menu comprising choices of (1)"RETURN, (2)"AUTO" and a following list of phrase starting functions pertaining to the selected phrase structure (for instance (3) "T-T-T-T", (4) "T-D-T-D", etc.) is displayed on the display unit 6, and the option number in the menu that is selected and supplied by the user is set in sconn (blocks 12-18 to 12-27). Accordingly, when a starting function is selected, a corresponding number between 3 and nmax(f,g)+2 is set in sconn. In the case when the phrase starting/ending function generation is to be done automatically, (2)"AUTO" is set in sconn (blocks 12-18 and 12-28), and the blocks 13-5 to 13-7 in FIG. 13A branching from the block 13-4 generate a phrase starting function number according to a random number and set the generated number in sconn. When sconn=1, i.e., "RETURN", is selected from the menu, the program returns through the block 13-4 to the musical form determination process (block 11-1 in FIG. 11).

When it is confirmed in the block 13-3 that a phrase starting function has been determined, the data of the determined phrase starting function is stored. More specifically, the blocks 13-8 to 13-11 read, from the phrase starting function file f2, data(f,g,n,dn) in row n(n=sconn-2) for the selected phrase starting function from the group g pertaining to selected phrase structure and set the data in sfunc (dn).

The phrase ending function is selected in a manner similar to the selection of the phrase starting function. More specifically, the block 13-14 locates from the phrase ending function data file f3 the head of the group g to be called. The group number g can be calculated from the phrase starting function number (sconn-2) and selected group in the phrase starting function data file f2. It is assumed here that one or more phrase ending functions are available for each phrase starting function. The following process of the phrase ending function generation proceeds in a similar manner to the phrase starting function generation. In the manual mode a list of phrase ending functions (such as D-T-D-T) contained in the phrase function group g is taken out from the file f3 and displayed in a menu together with (1)"RETURN" and (2)"AUTO". One of the choices displayed in the menu is manually selected (blocks 13-17 to 13-24 in FIG. 13B. In the automatic mode, a phrase ending function number econn is generated or determined according to a random number (see blocks 13-15, 13-25 and 14-4 to 14-7). The determined phrase ending function data is set in an array efunc(dn) (blocks 14-8 to 14-11). When the "RETURN" in the menu is selected, the program goes back to the phrase starting function determination process (block 12-1 in FIG. 12).

Where there is one-to-one correspondence between the phrase starting and ending functions, there is no need of separating the process of generating a phrase starting function series from the process of generating a phrase ending function series. For example, a format of phrase starting/ending function data in a phrase starting/ending function data file may be formed by a string of first phrase starting function, first phrase ending function, second phrase starting function, second phrase ending function and so forth in the mentioned order. In this case a group of phrase starting/ending functions belonging to the determined phrase structure may be taken out from the phrase starting/ending function data file for menu-display so that the user can select the desired function data from the displayed group or list.

(Selection of Generative Method of Chord Progression and Generation of Chord Progression)

Now, the process 5-10 in the general flow for selecting a method of chord progression generation and for generating a chord progression by the selected method will be described in detail. FIG. 15 shows details of this process. First, a block 15-1 checks the content of auting (4) to see whether a method of chord progression generation is to be selected automatically or manually. In the manual selection mode, there is displayed a chord progression generation method menu WAY( ) with options (1)"RETURN", (2)"AUTO", (3)F-PROGRESSION", (4)S-PROGRESSION and (5)D-PROGRESSION, and the user's selection input is set in WAYN. When the user's input is WAYN=1, i.e., "RETURN", the program goes from a block 15-5 through blocks 15-6, 15-7, 15-9, 15-12 and 15-15 to the process of determining a phrase starting/ending function (block 13-1 in FIG. 13A). When the "AUTO" in the menu is selected (WAYN=2), the program goes from block 15-7 to block 15-8 to change WAYN=3 indicative of "F-PROGRESSION". Thus, the block 15-9 provides YES, and a block 15-10 generates a function-based chord progression or F-progression. When WAYN=4 "S-PROGRESSION" is selected from the menu, the block 15-12 provides YES, and a block 15-13 generates an S-progression. When WAYN=5 "D-PROGRESSION" is selected, the block 15-15 provies YES, and a block 15-16 generates a D-progression. When it is found in the block 15-1 that a chord progression generation method is to be selected automatically, WAYN=3 "F-PROGRESSION" is set, and a chord progression is generated based on functional chord patterns.

It is noted that there are three options of a method of generating a chord progression; F-progression, S-progression and D-progression. These methods are implemented in the respective blocks 15-10, 15-13 and 15-16.

In the following the respective chord progression generation processes will be discussed in more detail.

(Generation of F-progression)

Figure 16A:
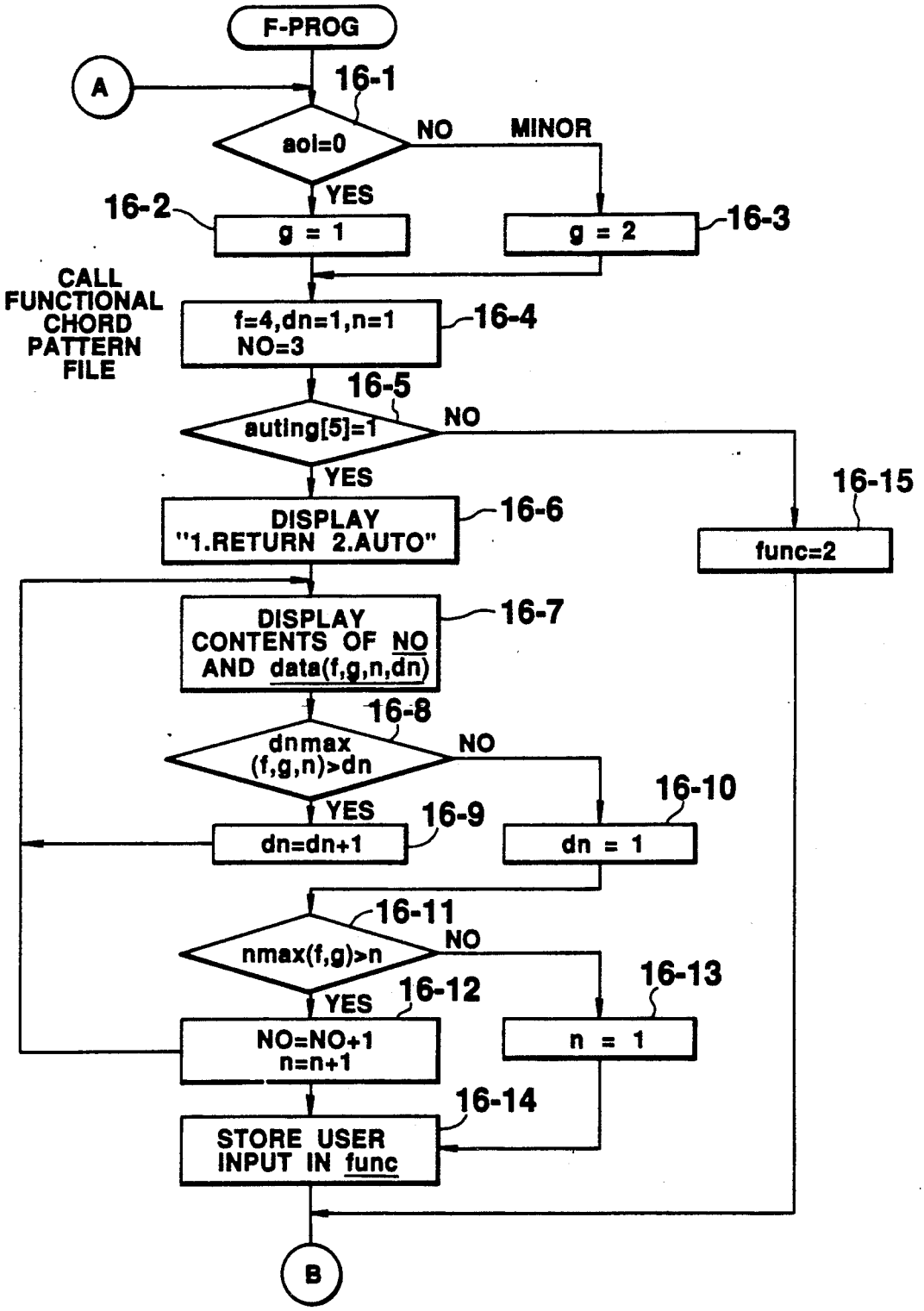
FIGS. 16A and 16B are flowcharts for generating a chord progression based on functional chord patterns.
Figure 16B:
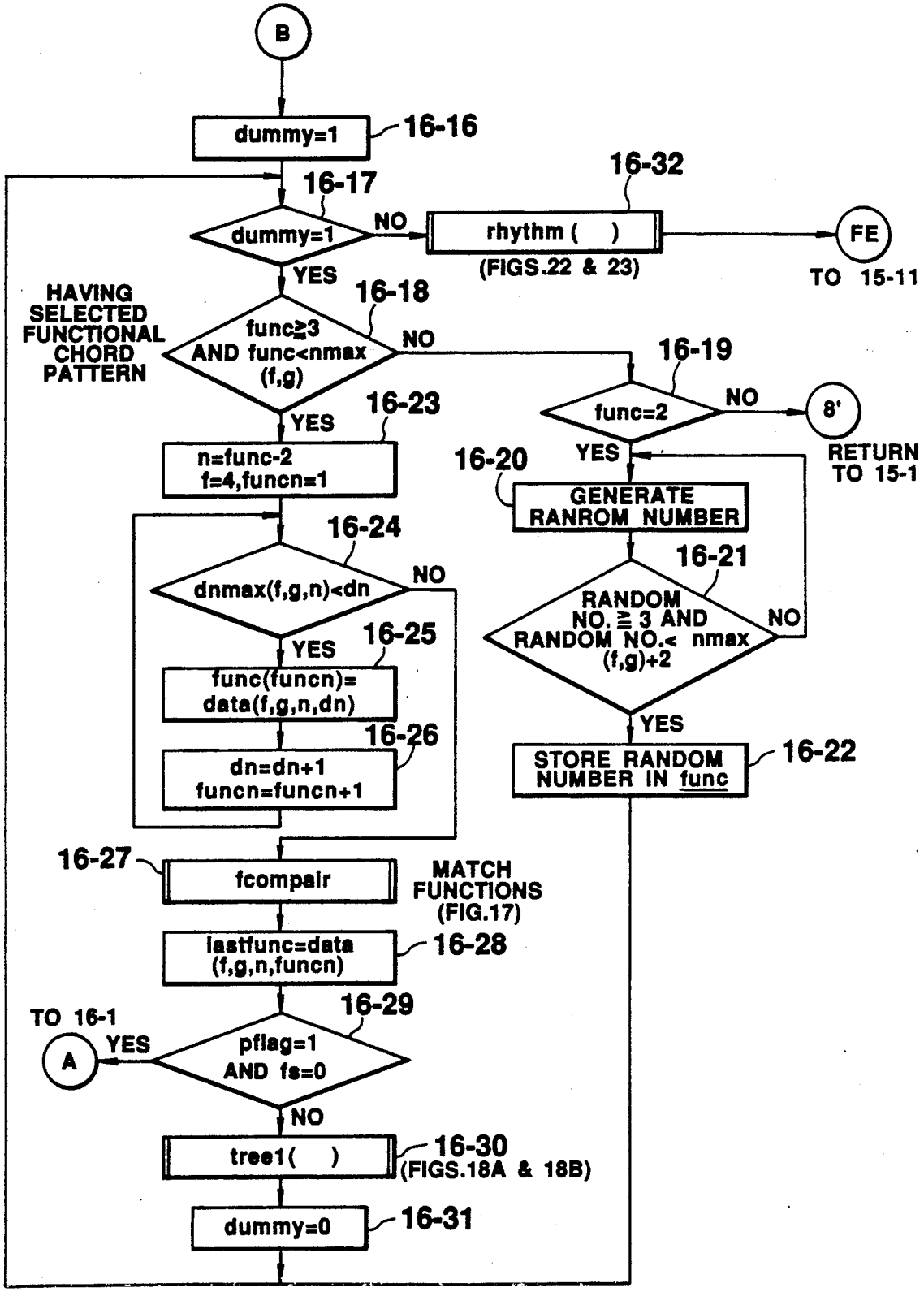

The F-progression block 15-10 generates a chord progression by concatenating functional chord pattern data from the functional chord pattern file f4 according to musical structure data such as musical form, tonality, phrase structure and phrase starting and ending functions, all obtained in the processes described above. FIGS. 16A and 16B show details of F-progression process.

In FIGS. 16A and 16B, blocks 16-1 to 16-22 are for selecting functional chord pattern data from the functional chord pattern data file f4. Blocks 16-23 to 16-25 set the selected functional chord pattern data (for instance T-D-T) in an array func(funcn). A block 16-27 executes a function matching test(fcompair). More specifically, it checks a stream of functional chord patterns against the structually determined phrase starting and ending functions to locate the corresponding phrase start, borderline, phrase end positions in the functional chord pattern stream. In block 16-30 called tree1( ), a specific chord pattern is selected from either file f5 or f6 based on the selected functional chord pattern, and is concatenated into a chord name array mcp(flase, dnn) of the chord progression of music according to the result of the fcompair block 16-26. Further, the routine tree1( ) contains a subroutine called structure ( ) which checks as to whether there is any repetition phrase, and selectively produces a chord progression mcp (flase, dnn) of a phrase satisfying the conditions of repetition. Further, a block 16-32 called rhythm ( ) is provided in which a rhythm pattern corresponding to the selected functional chord pattern is taken out from the rhythm pattern file f7 and is concatenated into an array rhmbox-(flase,dnn) for storing chord durations of the chord progression of music. The rhythm( ) block is arranged to allow the user to freely change the rhythm pattern taken out from the file f7.

Now, the F-progression generation process will be described in more detail.

In the process of selecting a functional chord pattern (blocks 16-1 to 16-22), the block 16-1 checks the content of aoi to see whether the selected musical mode is major or minor. For major group g=0 is selected, while for minor group g=1 is selected (blocks 16-2 and 16-3). Then, block 16-4 sets, f=4, dn=1, n=1 and NO=3 to call the functional chord pattern data file f4 of the mode g selected in the tonality determination block 5-4 (FIG. 5). Then, block 16-5 checks the content of auting (5) set in the auto/manual choosing block 5-3 (FIG. 5) to see whether a functional chord pattern is to be selected automatically or manually. In the manual case, a list of functional chord pattern data (for instance T-S-T) belonging to the selected mode g in the functional chord pattern data file f4 is taken out for display in the form of a functional chord pattern menu comprising (1)"RETURN", (2)"AUTO" and following options constituting a functional chord pattern list (blocks 16-6 to 16-13). The selected menu option No. is set in func (block 16-14). When func=1, or "RETURN" in the menu is selected, the program goes through blocks 16-18 and 16-19, and returns to the chord progression generation method determination process (block 15-1 in FIG. 15). When "AUTO" in the menu is selected or when autin (5) represents "AUTO", func=2 (see block 16-15), and blocks 16-20 to 16-22 from the YES side of the block 16-19 generate or determine a functional chord pattern number according to a random number and set it in func.

When a functional chord pattern has been determined, the block 16-18 yields YES, and blocks 16-23 to 16-26 load the determined functional chord pattern data into func (funcn). For example, when a functional chord pattern of T-S-T is selected, the first functional chord T is set in func (1), the second functional chord S in func (2), and the third or last functional chord T in func (3).

Figure 17:
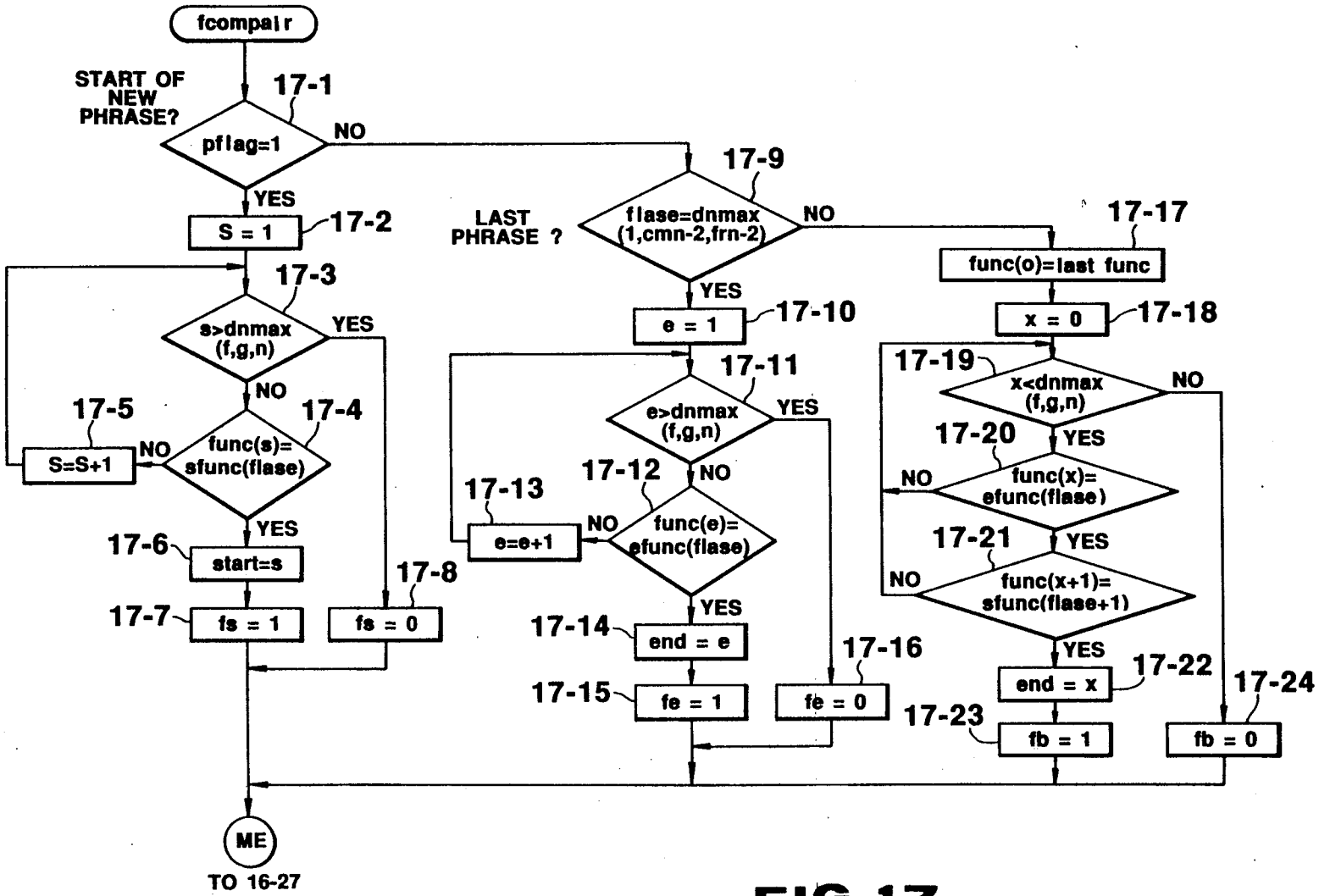
FIGS. 17, 18A, 18B, 19, 20, 21, 22, 23, 24 and 25 are flowcharts showing details of subprocesses involved in the generation of a chord progression based on functional chord patterns.

Thereafter, the block 16-27 executes the routine fcompair. FIG. 17 shows details of this routine. The fcompair is for locating a position in a stream of functional chord patterns satisfying a condition for the start of a music piece, phrase boundary or end of the music. A block 17-1 sees that pflag=1 is true when starting a chord progression for the first phrase of music or when starting a chord progression of a phrase that comes after a repeated phrase, the chord progression of which has been repeated by means of a subroutine called structure( ) to be described later. In short, pflag=1 indicates when a new phrase begins. A block 17-9 sees that flase=dnmax(1,cmn-2, frn-2) is true when the phrase of chord progression being currently generated is the last phrase of music.

When pflag=1 is met (17-1), a check is done as to whether the functional chord pattern data func(funcn) currently selected contains a functional chord identical with a new phrase starting function (for instance dominant D). If such a functional chord is found, its position in the pattern func(funcn) is set in a start register, while a start flag fs is set to "1". When no such functional chord is contained, the start flag fs is reset to "0". In the latter case, a failure of starting a phrase is detected by a block 16-29 in FIG. 16B, and the program goes back to the block 16-1 to select a different functional chord pattern.

When the present phrase is the last phrase (true in block 17-9), a check is done as to whether the currently selected functional chord pattern func(funcn) contains a functional chord identical with the last phrase ending function (for instance tonic T). If such a functional chord is contained, its position in the functional chord pattern is set in an end register, while an end flag fe is set to "1". If no such functional chord is found, the end flag fe is reset to "0". (blocks 17-10 to 17-16).

When both block 17-1 and block 17-2 yield NO, blocks 17-17 to 17-24 perform a phrase boundary check. Last func shown in the block 17-17 is the last functional chord of the functional chord pattern selected last time as is seen from the block 16-28 (FIG. 16B) positioned immediately after the f compair block. This data is provided because a boundary between adjacent phrases can occur not only at an intermediate position in a functional chord pattern but also at an end thereof (i.e., at a borderline between adjacent functional chord patterns). Blocks 17-18 to 17-24 check as to whether the last selected functional chord and the functional chord series of the pattern selected this time contain a pair of functional chords identical with the current phrase ending function and the next phrase starting function, respectively. If such a functional chord pair is found, the position of the heading chord of the pair is set in the end register, while a phrase boundary flag fb is set to "1". If no such a functional chord pair is found, the flag fb is reset to "0".

Data efunc(flase) shown in block 17-20 represents the current phrase ending function, and data sfunc(flase+1) in block 17-21 represents the next phrase starting function. These functions have already been selected from the phrase starting/ending function data files f2 and f3 by the block 5-8 in FIG. 5 (the same being applied to the blocks 17-4 and 17-12).

In summary, the fcompair finds out positions in functional chord pattern or series suited for the start, borderline and end of each phrase on the basis of phrase starting and ending functions for each phrase planned in the chord progression generation scheme.

The tree1( ) block 16-30 selects a root-type specifying chord pattern according to the functional chord pattern selection process (blocks 16-1 to 16-26) and concatenates the selected chord pattern with the chord progression stored in the array cmp(flase,dnn) for each phrase. For the concatenation, the result of the function matching process in the fcompair block 16-27 is utilized. Further, a check is done as to whether the next phrase is a repetition phrase. If the next phrase is a repetition phrase, the chord progression mcp(flase,dnn) of the preceding phrase is repeated as chord progression mcp(flase+1,dnn) of the repetition phrase.

Figure 18A:
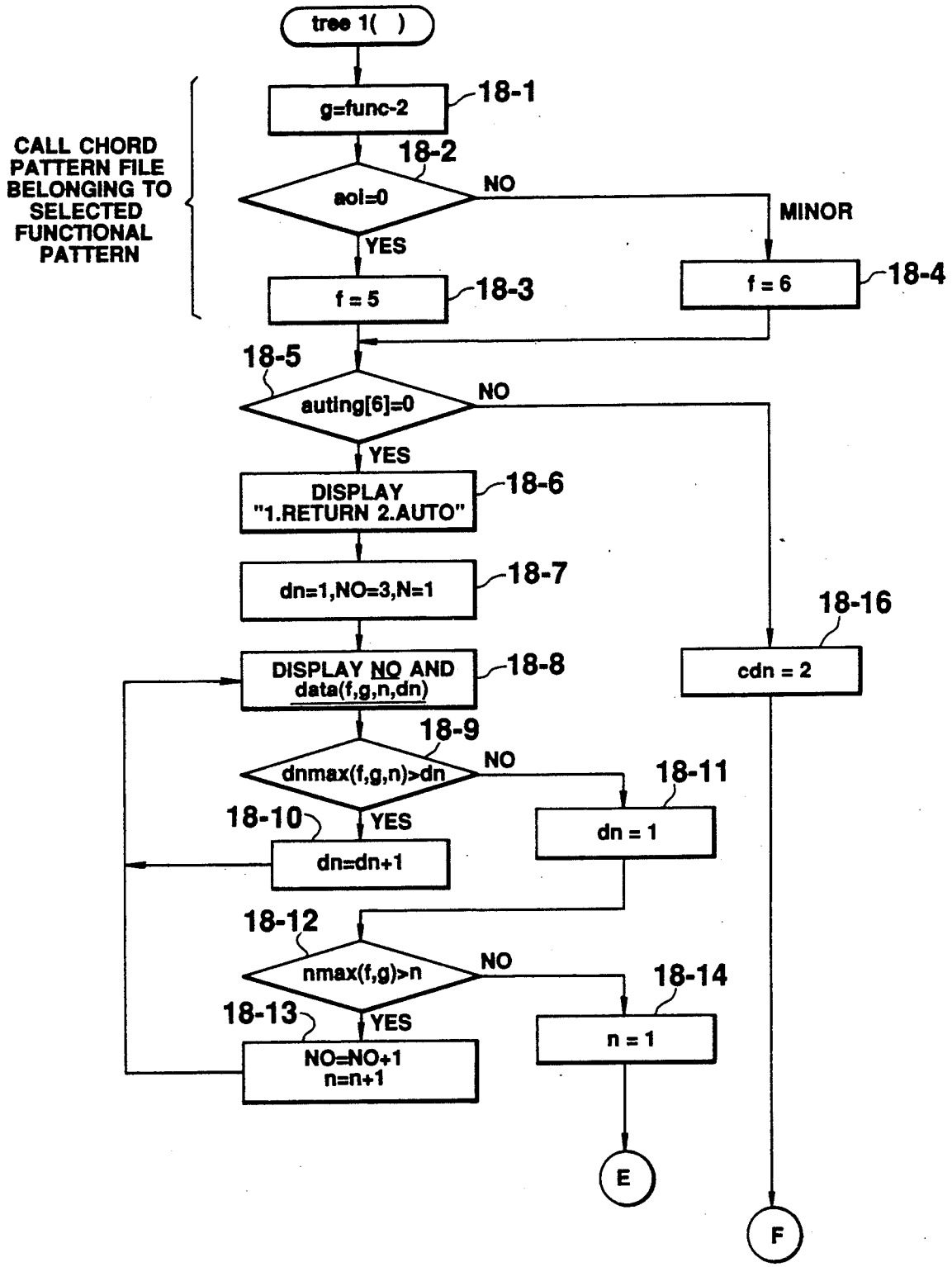
Figure 18B:
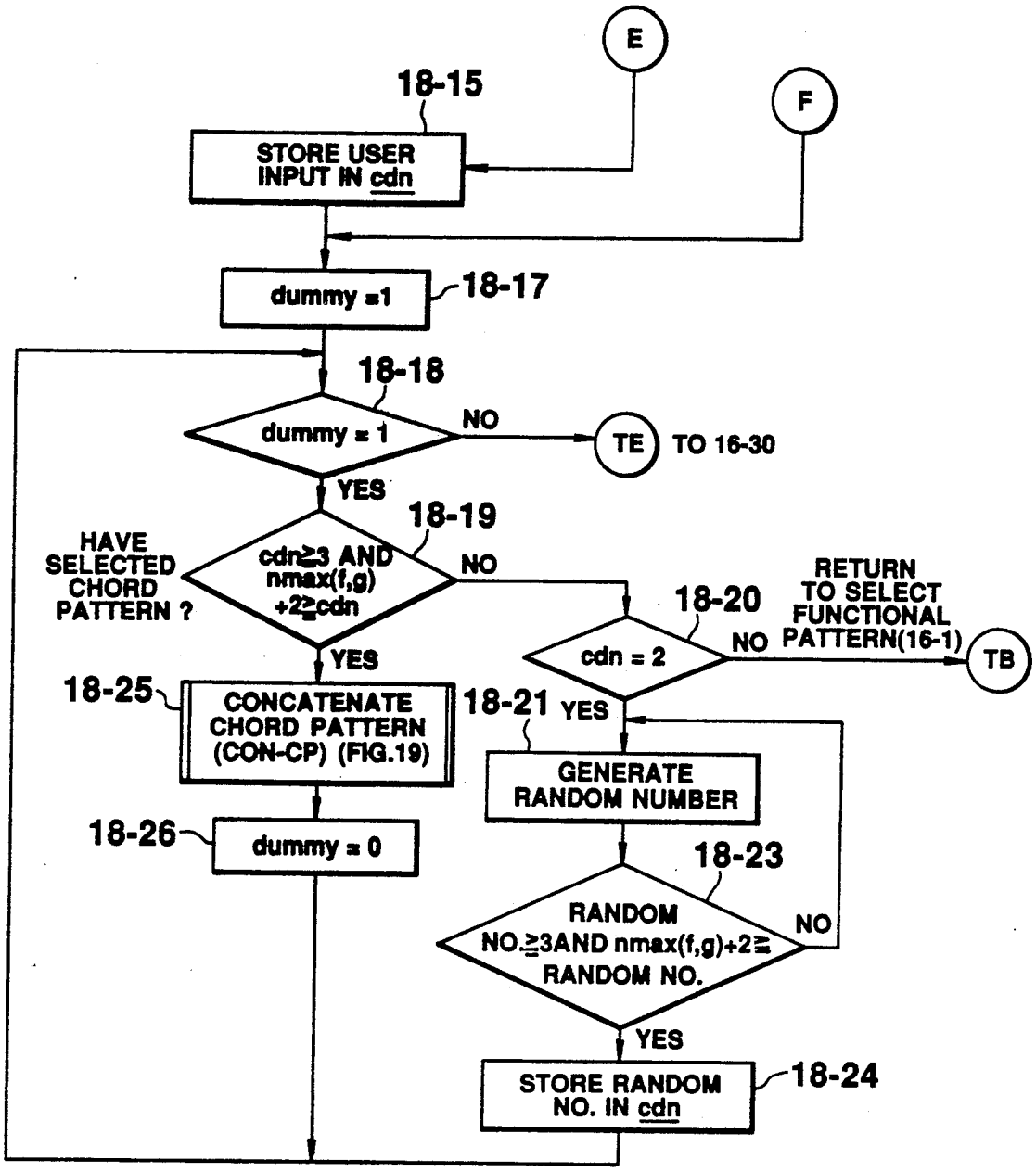

FIGS. 18A and 18B show details of the routine tree1( ). Blocks 18-1 to 18-24 are arranged to select a chord pattern suited for the functional chord pattern selected in the preceding process of FIGS. 16A and 16B. More specifically, the block 18-1 to 18-4 retrieve or locate from the chord pattern data files f5 and f6 a specific chord pattern corresponding to the determined functional chord pattern. The file f5(f=5) is a chord pattern file for major music, and file f6 is a chord pattern file for minor music. The block 18-5 checks auting(6) to see which mode, AUTO (auting(6)=1) or MANUAL has been chosen to generate a chord pattern. In the manual mode a list of chord patterns in the called group g assigned to the selected functional pattern is taken out from the file f5 or f6 and displayed in a chord pattern menu for user's selection (18-6 to 18-15). In the automatic mode, a member of that chord pattern group is selected automatically according to a random number (18-16, 18-20 to 18-24). When "RETURN" in the menu is selected, the program goes back to the functional chord pattern selection process (block 16-1 in FIG. 16A). When a chord pattern (for instance Cmaj-G7-Cmaj) has been selected, a block 18-19 sees $3 \leqq cdn \leqq nmax(f,g)+2$ (where cdn represents the selected chord pattern number, and nmax(f,g) represents the total number of chord patterns contained in the called group g), and a block 18-25 labeled CON-CP performs a process of concatenating chord patterns.

Figure 19:
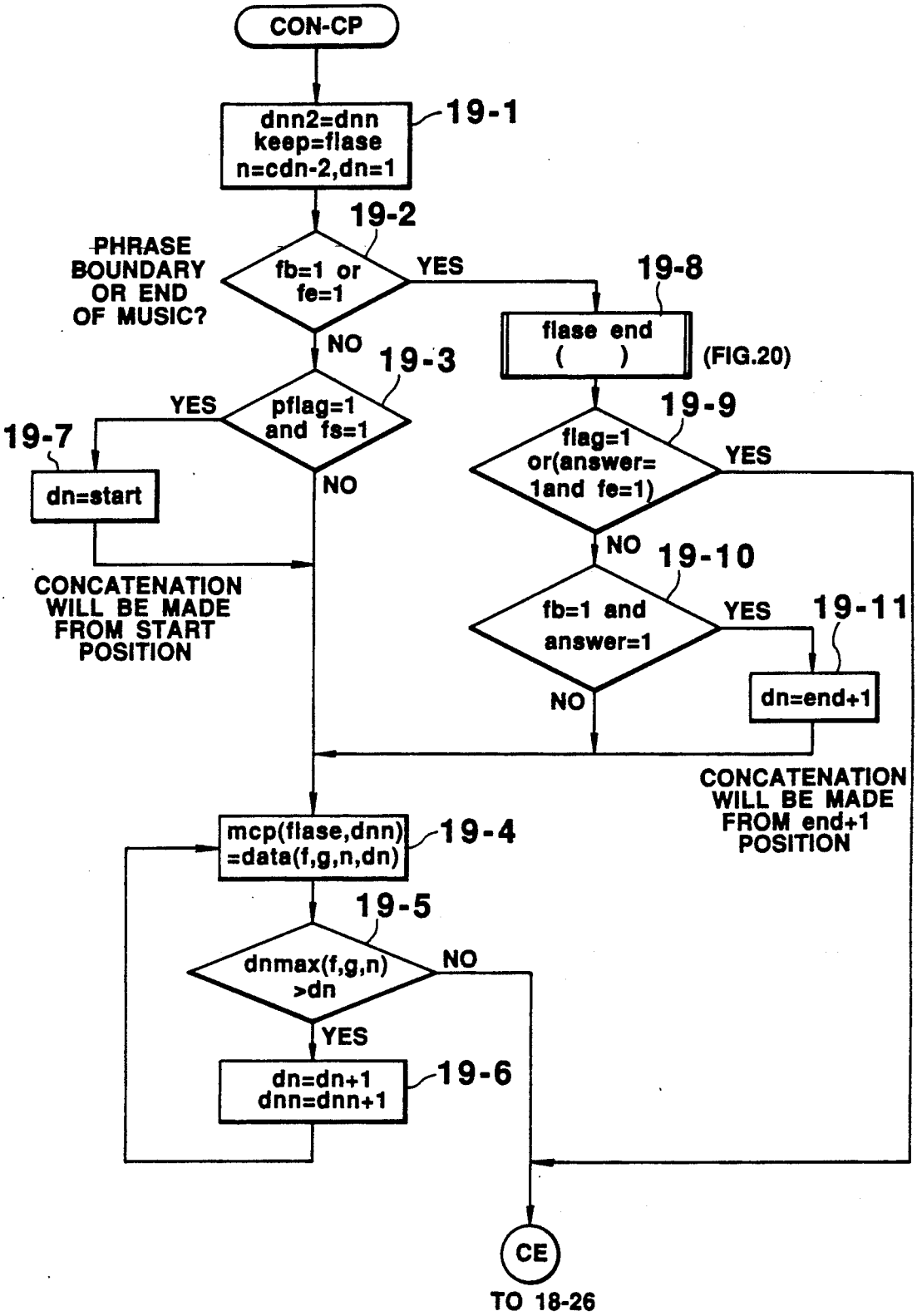

FIG. 19 shows details of the block 18-25. In FIG. 19, mcp(flase,dnn) indicates a chord progression array element for storing a dnn-th chord in a flase-th phrase. The value of flase indicates the current phrase number, and the value of dnn indicates the number of the chord to be generated next in the current phrase. Thus, a chord progression has been developed up to the (dnn-1)-th chord in the flase-th phrase. In a block 19-1, keep represents a phrase number in a chord duration array rhmbox( ) to be used in the routine rhythmn( ) to be executed later, and dnn2 specifies a variable chord number in the phrase in the rhmbox( ). The concatenating process shown in FIG. 19 involves moving the current position in the chord name array mcp(flase,dnn) to further develop a chord progression in terms of chord names. Therefore, before the concatenating operation on the array is effected, values of flase and dnn are saved in keep and dnn2, respectively (19-1). In a block 19-4, data(f,g,n,dn) represents a dn-th chord of the chord pattern selected in the chord pattern selection process described before. In the block 19-1, n=cdn-2 represents the setting of the selected chord pattern number, and dn=1 represents initializing the chord number in the selected chord pattern to "1".

Normally, the routine fcompair (FIG. 17) finds that the selected functional chord pattern satisfies neither new phrase start condition (fs=1), nor phrase boundary (fb=1), nor music end condition(fe=1). In such a normal mode, a block 19-2 confirms no borderline (or end) condition, and a block 19-3 confirms no start condition. Then blocks 19-4 to 19-6 successively set the chord progression array mcp(flase,dnn) to the selected chord pattern data(f,g,n,dn) starting from the first data(f,g,n,1). This accomplishes a direct concatenation of the currently selected chord pattern to the phrase chord progression generated so far before the entry to the block 19-1.

If the routine fcompair has found a phrase starting function chord in the selected functional chord pattern when starting a new phrase, it sets the start flag fs and loads the start register with a new phrase starting position in the functional chord pattern. In this case, the block 19-3 in FIG. 19 confirms the new phrase start condition, and a block 19-7 sets the start position in dn. Thus, the process of the blocks 19-4 to 19-6 loads the chord progression array mcp(flase,dnn) with a chord having the phrase stating function and following chords in the selected chord pattern.

Figure 20:
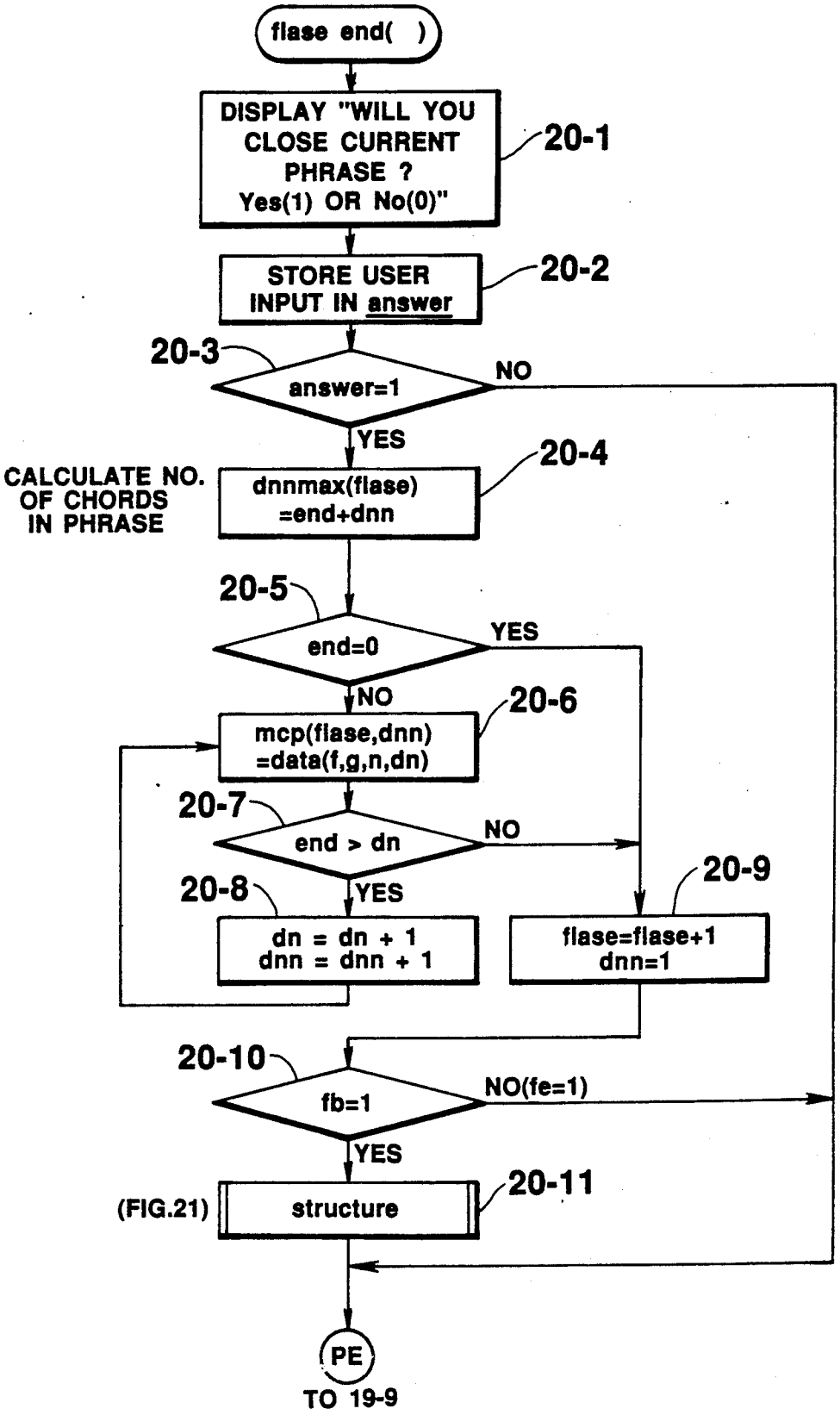

When the f compair block has found in the selected functional chord pattern a chord having a function identical with the last phrase ending function while the last phrase is being generated, end-of-music flag fe is set, and the end-of-music position in the functional chord pattern is set in end. Also when a pair of functional chords identical with the current phrase ending function and next phrase starting function, respectively, is found in a stream of the last function of the immediately preceding functional chord pattern and the current functional chord pattern, a phrase boundary fb is set, and the current phrase end position in the functional chord pattern (end) is set. In these cases, the block 19-2 in FIG. 19 confirms the phrase boundary or music end condition, and a routine flase end ( ) 19-8 to be discussed with reference to FIG. 20 is executed.

The flase end( ) seeks a user's decision on ending a phrase. When a negative answer is given by the user, the flase end( ) regards it as continuation of the normal mode, and allows blocks 19-4 to 19-6 to concatenate every chord in the selected chord pattern to the current phrase chord progression. Accordingly, even if a structural phrase boundary condition or a music end condition is satisfied, the final decision on ending a phrase is made by the user. In the flow of FIG. 20, a block 20-1 queries the user as to whether he or she really wants to end the current phrase. The user's response is set in answer (20-2). When a block 20-3 finds that the user's answer is negative, i.e., answer=0, the program exits from the flase end( ), passing through blocks 19-9 and 19-10 in FIG. 19 to blocks 19-4 to 19-16 for developing the chord progression array. When the user's answer is affirmative, i.e., answer=1, a block 20-4 calculates from end and dnn the number of chords contained in the chord progression of the current phrase and set the calculated number in dnnmax (flase). Then a loop of blocks 20-5 to 20-8 concatenates a portion of the selected chord pattern data(f,g,n,dn) extending between the first (dn=1) and the phrase-ending position(dn=end) thereof to the chord progression array mcp(flase dnn) generated so far for the current phrase. In this way, the chord progression of the current phrase is completed. Afterwards, the current phrase number flase is updated, and the chord number dnn of the phrase is reset to an initial value of "1" (20-9). The block 20-5 sees end=0 when the last chord of the previously selected chord pattern is the last chord of the current phrase. This will skip the current phrase chord progression completing process of blocks 20-6 to 20-8 because the chord progression of the current phrase has already been completed in the array mcp(flase,dnn).

Subsequently, a block 20-10 checks for which condition is met, phrase boundary (fb=1) or music end condition (fe=1). For a phrase boundary condition, a block 20-11, labeled structure( ) and shown in detail in FIG. 21, checks as to whether the next phrase to the current phrase just completed in the blocks 20-5 to 20-8 is a repetition of a prior phrase, and repeats, if met, the prior phrase chord progression for the next phrase. In the case of the end of music, because the chord progression of the last phrase of music has already been completed in the blocks 20-5 to 20-8 there is no need for checking the next phrase for the condition of a repetition phrase, thus exiting from the flase end( ) of FIG. 20. This time, the block 19-9 (FIG. 19) sees answer=1 and fe=1, and terminating the concatenating process of FIG. 19. In this manner, if the f compair routine (FIG. 17) finds in the course of producing the last phrase that the selected functional chord pattern contains a functional chord identical with the last phrase ending function structurally predetermined, it memorizes the music end position in the functional chord pattern and if a user's approval of ending the music is obtained in the subroutine flase end( ) in the concatenating process of FIG. 19, the current phrase chord progression completing blocks 20-6 to 20-8 in the flase end( ) are operated to concatenate a portion of the selected chord pattern covering those chords up to the end-of-music position thereof to array mcp(flase,dnn), thus completing the chord progression of the last phrase of music.

Figure 21:
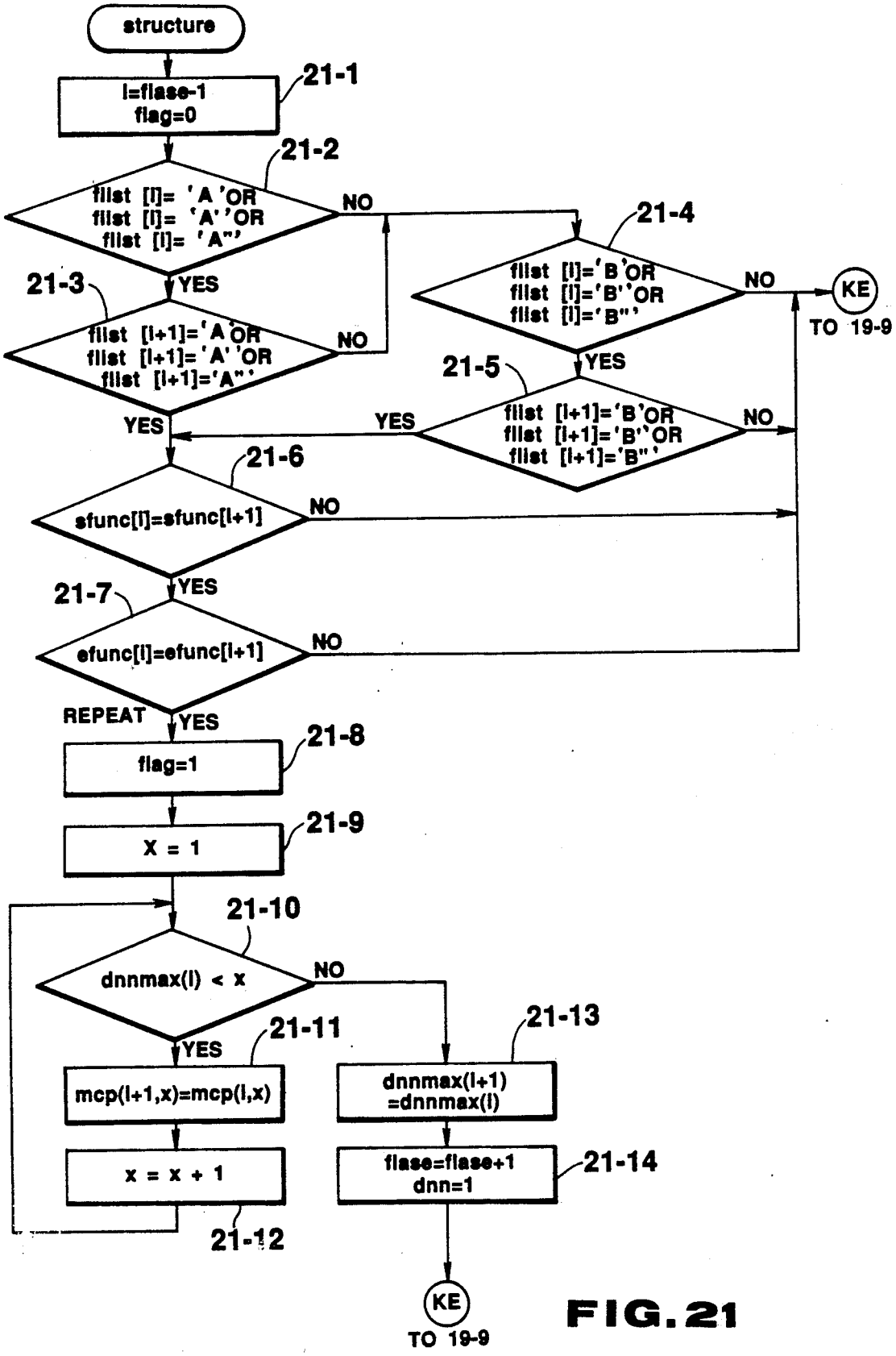

As stated above, when the block 20-10 detects a phrase boundary condition, the phrase-repetition routine structure( ) shown in FIG. 21 is executed. According to FIG. 21 flow, a repetition phrase condition for the next phrase (i+1) (which comes next to the current phrase chord progression completed in the blocks 20-6 to 20-8 and has the same number of flase in processing) is met when the next phrase is of a type similar to that of the current phrase i (with YES provided by blocks 21-2 and 21-3 or by blocks 21-4 and 21-5), has the same phrase starting function with that of the current phrase (block 21-6), and has the same phrase ending function with that of the current phrase (21-7). Here, data flist(x) represents the phrase structure already determined in the phrase structure determination block 5-7 in the general flow (FIG. 5), and data sfun(x) and efunc(x) represent the respective phrase starting and ending functions having determined in the phrase starting/ending function determination block 5-8.

When the repetition phrase condition is met, a repetition flag is set (block 21-8). Then, data mcp(i,x) of the chord progression of the current phrase is copied onto mcp(i+1, x) of the chord progression of the next phrase (blocks 21-9 to 21-12), also the number dnmax(i) of chord contained in the current phrase chord progression is copied to the number dnnmax(i+1) of the next phase chord progression (block 21-13), and then the phrase number flase is updated with initializing the chord number dnn (block 21-14).

In lieu of the flow of FIG. 21, it may be arranged to modify a repeation condition for a flase-th phrase such that the condition is met when the flase-th phase is similar in type to and has the same phrase starting and ending functions as those of either one of the 1-st to (flase-1)-th phrases. This modification may be readily realized.

As discussed above, the repetition phrase check routine structure( ) is executed for the next phrase when the current phrase chord progression is completed as a result of user's approval of a phrase boundary condition (fb=1) after it has been detected.

When the phrase repeating blocks 21-8 to 21-14 have been executed, the block 19-9 in the chord pattern concatenating routine (FIG. 19) sees flag=1 to terminate the flow of FIG. 19. In this case, pflag will be set at the last step (FIG. 25) of the function-based chord progression generating (F-progression) process (FIG. 16A and 16B), so that in the next pass of the F-progression, the function matching routine f compair can check as to whether there is a new phrase starting function in the selected functional chord pattern, assuming that it is requested to start a new phrase (which is next to the repeated phrase).

When the routine structure( ) has found that the next phrase dissatisfies the repetition condition, the check block 19-10 in the chord pattern concatenating routine in FIG. 19 sees fb=1 and answer=1 (i.e., a phrase borderline or boundary condition and a user's approval of ending the current phrase). This causes a block 19-11 to set dn=end+1. It is to be understood that the portion of the chord pattern data(f,g,n,dn) up to the phrase end position has been set in array mcp(flase,dnn) of chord progression of the current phrase by means of the current phrase chord progression completing blocks 20-6 to 20-8 in the routine flaseend( ). Therefore, the blocks 19-4 to 19-6 in FIG. 19 have to set the remaining data of the chord pattern in array mcp(flase,dnn) as a beginning portion of the chord progression of the next phrase. To this end, the block 19-11 has set dn to (end+1) of the chord pattern that stores the start chord of the next phrase.

The routine tree1( ) (FIGS. 18A and 18B) and pertaining operations thereto have been described so far.

The rhythm( ) block 16-32 in F-generation process (FIGS. 16A and 16B) is arranged to provide a time duration to each chord generated in the tree1( ) block 16-30. While the routine tree1( ) is for selecting a chord pattern in terms of chord names and for concatenating the selected chord name data into the chord progression array mcp(flase,dnn) with respect to chord names, the routine rhythm( ) at 16-32 is provided for selecting a rhythm or time durational series for the chord name pattern and for concatenating the durational data into array rhmbox(keep,dnn) of chord progression with respect to chord durations.

Figure 22:
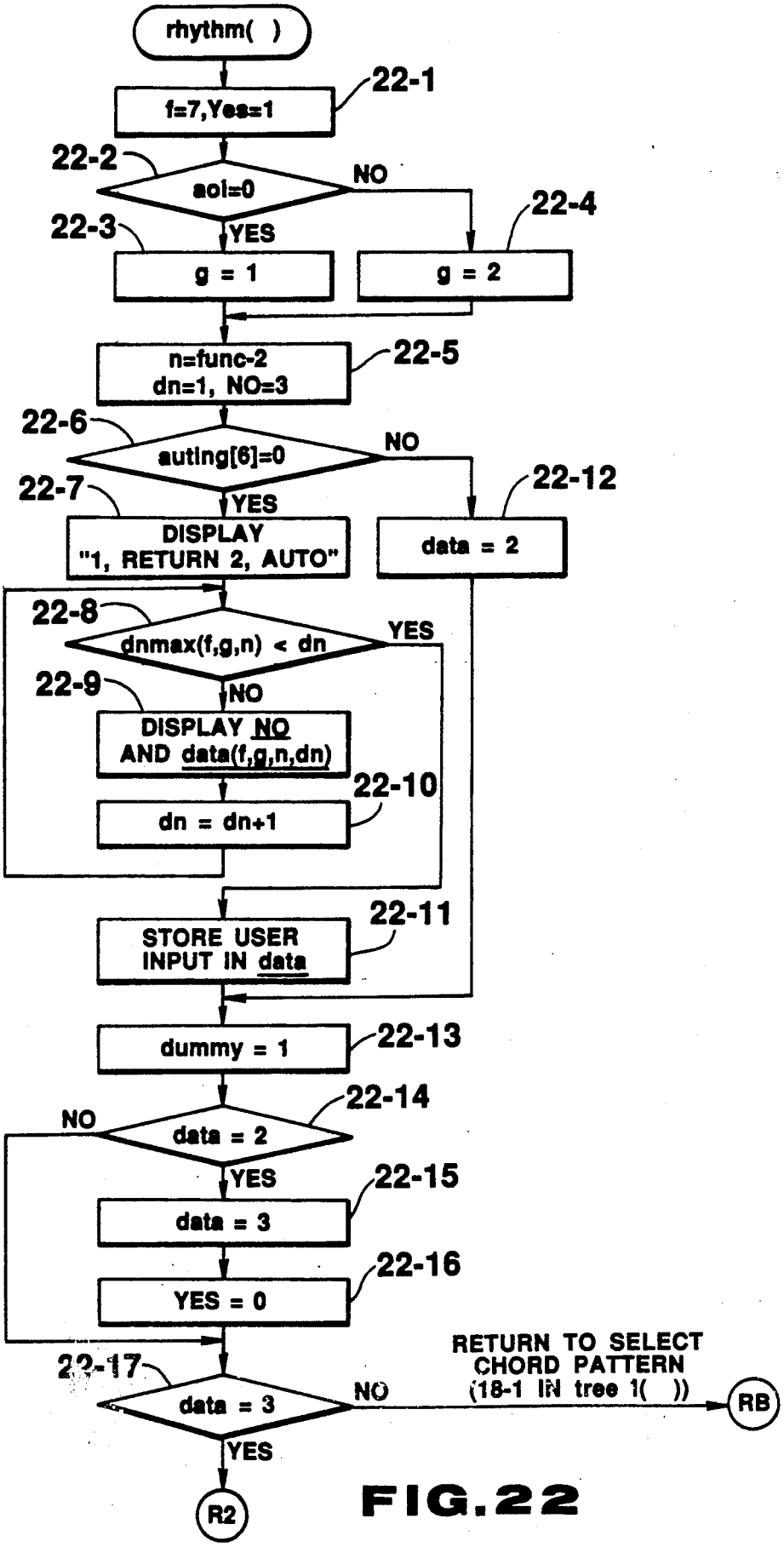
Figure 23:
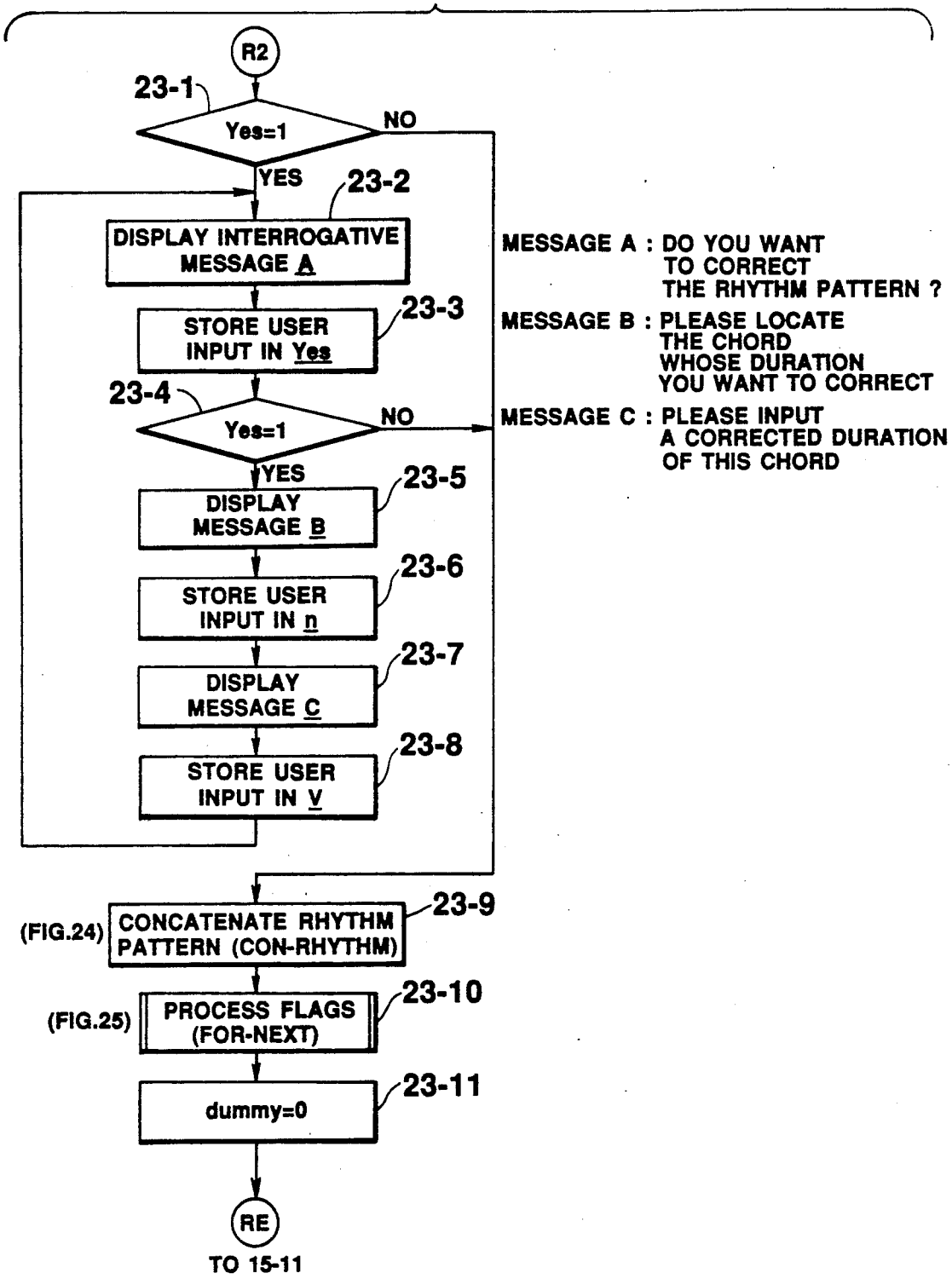

FIGS. 22 and 23 show details of the routine rhythm( ). The process begins with the flow of FIG. 22 for selecting from the rhythm pattern data file f7 a rhythm pattern corresponding to a determined functional chord pattern. Blocks 22-1 to 22-5 call or locate such a rhythm pattern. The rhythm pattern data file f7 comprises one rhythm pattern for each functional chord pattern. Unlike the other selection process, this routine rhythm does not include any manual selection of a rhythm pattern from a plurality of rhythm patterns or automatic selection of a rhythm pattern therefrom according to a random number. More specifically, a menu that is displayed when a rhythm pattern is to be selected manually, i.e., when auting(6)=0, presents choices of only (1)"RETURN", (2)"AUTO" and (3)a rhythm pattern (for instance odd) corresponding to the determined functional chord pattern (blocks 22-6 to 22-10). When a rhythm pattern is to be selected automatically (auting(6)=1), or when (2)"AUTO" in the menu is selected, a block 22-14 sees data=2. This is changed to data=3 indicative of an option of rhythm pattern, and also the flag YES is set to 0. The YES=0 is used to skip a manual rhythm pattern correction process shown in FIG. 23. When (1)"RETURN" is selected, data=1, and the program returns to the chord pattern selection routine (block 18-1 in FIG. 18A).

If the user has picked out the rhythm pattern option in the menu, a check block 23-1 in FIG. 23 detects YES=1 (see block 22-1), and blocks 23-2 to 23-8 allows the user to correct the rhythm pattern on a dialogue basis. More specifically, the dialogue system asks the user as to whether there is any rhythm (chord duration) to be corrected in the rhythm pattern retrieved from the rhythm pattern data file f7. If the user provides a correction request, (YES=1) the system inquires a position of correction. Upon receipt of user's positional input for correction, it prompts the user to input the desired rhythm (blocks 23-2 to 23-8).

Figure 24:
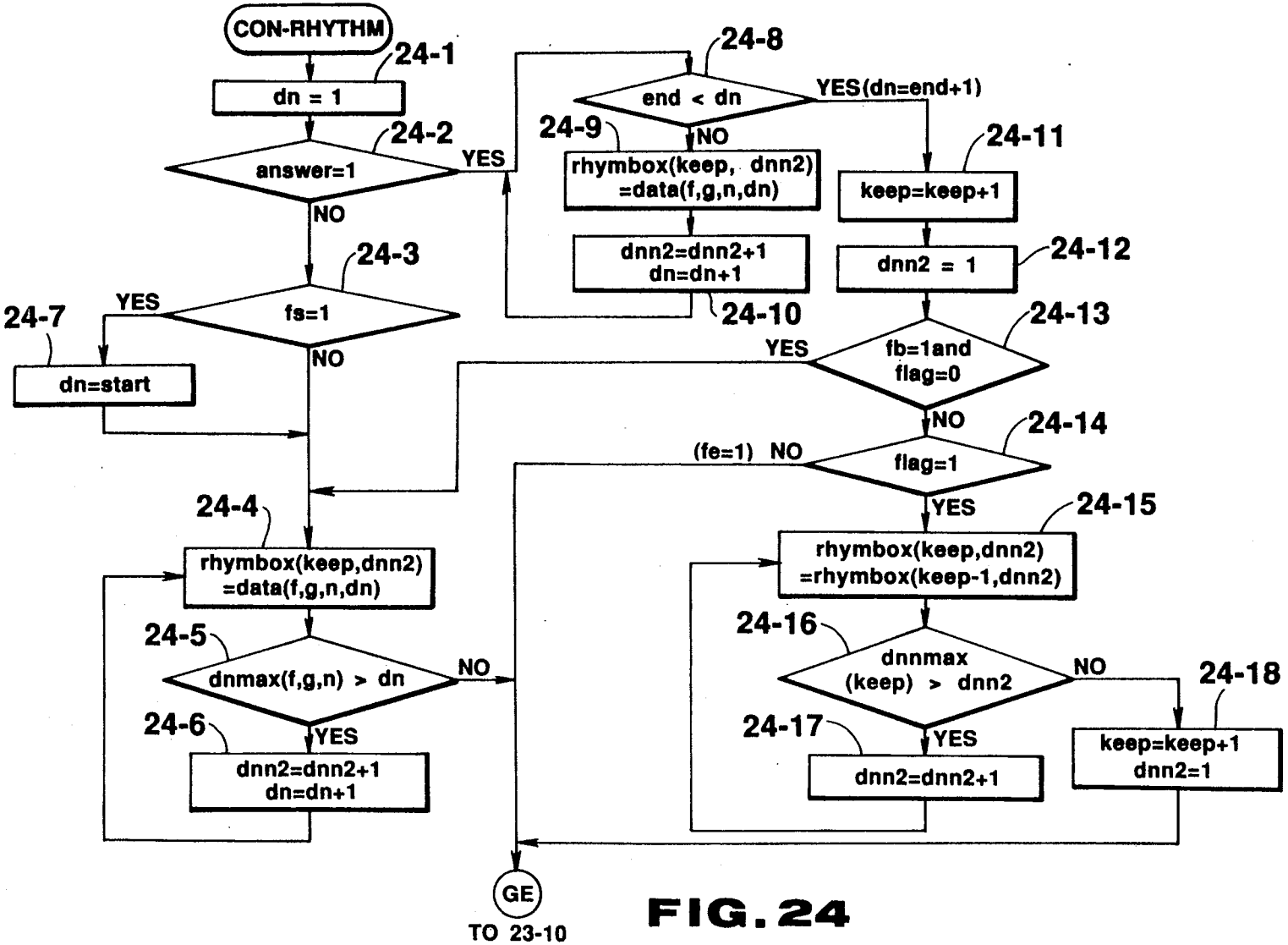

The determined rhythm pattern is concatenated to rhymbox(keep,dnn) in a block 23-9 in FIG. 23. FIG. 24 shows details of the rhythm pattern concatenating block 23-9. In an normal operation the selected functional chord pattern contains no phrase-updating condition. Therefore, neither answer=1 (user's acknowledgement of ending the current phrase) nor fs=1 (start of music) is satisfied (24-2 and 24-3). Thus, blocks 24-4 to 24-6 successively concatenate every duration data(f,g,n,dn) of the rhythm pattern selected this time into array rhymbox(keep,dnn2) of the current phrase chord durations. When rhythm pattern data has been corrected in blocks 23-2 to 23-8 according to the user's judgement, the corrected rhythm pattern is concatenated to rhymbox(keep,dnn2). Although not shown in FIG. 24, rhythm pattern data(f,g,n,dn) selected from the rhythm pattern data file may be copied to a separate array rhym(dn) in order that an element or elements of rhym(dn) may be changed to the corrected data in the rhythm pattern correction routine of 23-2 to 23-8, and the corrected array rhym(dn) may be used as data(f,g,n,dn) shown in the blocks 24-4 to 24-6 (and 24-8 to 24-10). In the case when there is a new phrase starting condition (fs=1), the block 24-7 sets dn to the phrase start position in the rhythm pattern (obtained in fcompair), and the blocks 24-4 to 24-6 extend array rhymbox(keep,dnn2) by a portion of the rhythm pattern comprising a chord duration at the phrase start position and the following chord durations.

If the routine fcompair (FIG. 17) has found that a selected functional chord pattern contains a phrase boundary condition or an end-of-music condition, and if the user's approval of the condition has been obtained in flase end( ) (FIG. 20), the block 24-2 in FIG. 24 sees answer=1. In this case, blocks 24-8 to 24-10 (corresponding to the blocks 20-5 to 20-8 in FIG. 20) execute a current phrase chord progression rhythm completion routine to concatenate a portion of the rhythm pattern located between the first and the phrase end position in to the array rhymbox(keep,dnn2). Thereafter, the phrase number keep is updated, and the chord number dnn2 in the updated phrase is set to "1" (blocks 24-11 and 24-12). Then, a block 24-13 checks as to whether fb=1 and flag=0. These conditions hold in the case in which a phrase borderline condition has been detected in fcompair and is acknowledged in flaseend ( ), but structure( ) in FIG. 21 does not find that the next phrase is a repetition phrase. Therefore, when these conditions are met, the blocks 24-4 to 24-6 load rhymbox(keep,dnn2) with the remaining portion of the rhythm pattern comprising those durations including and subsequent to that of the next phrase first chord pointed to by dn=end+1.

When the check block 24-13 provides NO, a block 24-14 tests for flag=1. This condition holds when the next phrase is a repetition phrase. To repeat the phrase blocks 24-15 to 24-19 copy the data in array rhymbox(keep-1,dnn2) of the current phrase rhythm of chord progression to the array rhymbox(keep,dnn2) of the next phrase rhythm. Then, updating of the phrase number keep and initialization of the chord number dnn2 in the phrase are executed (block 24-18).

The block 24-14 finds flag=0 when an end-of-music condition has been detected in fcompair (fe=1) and acknowledged in flase end( ). This terminates the rhythm pattern generation process.

Figure 25:
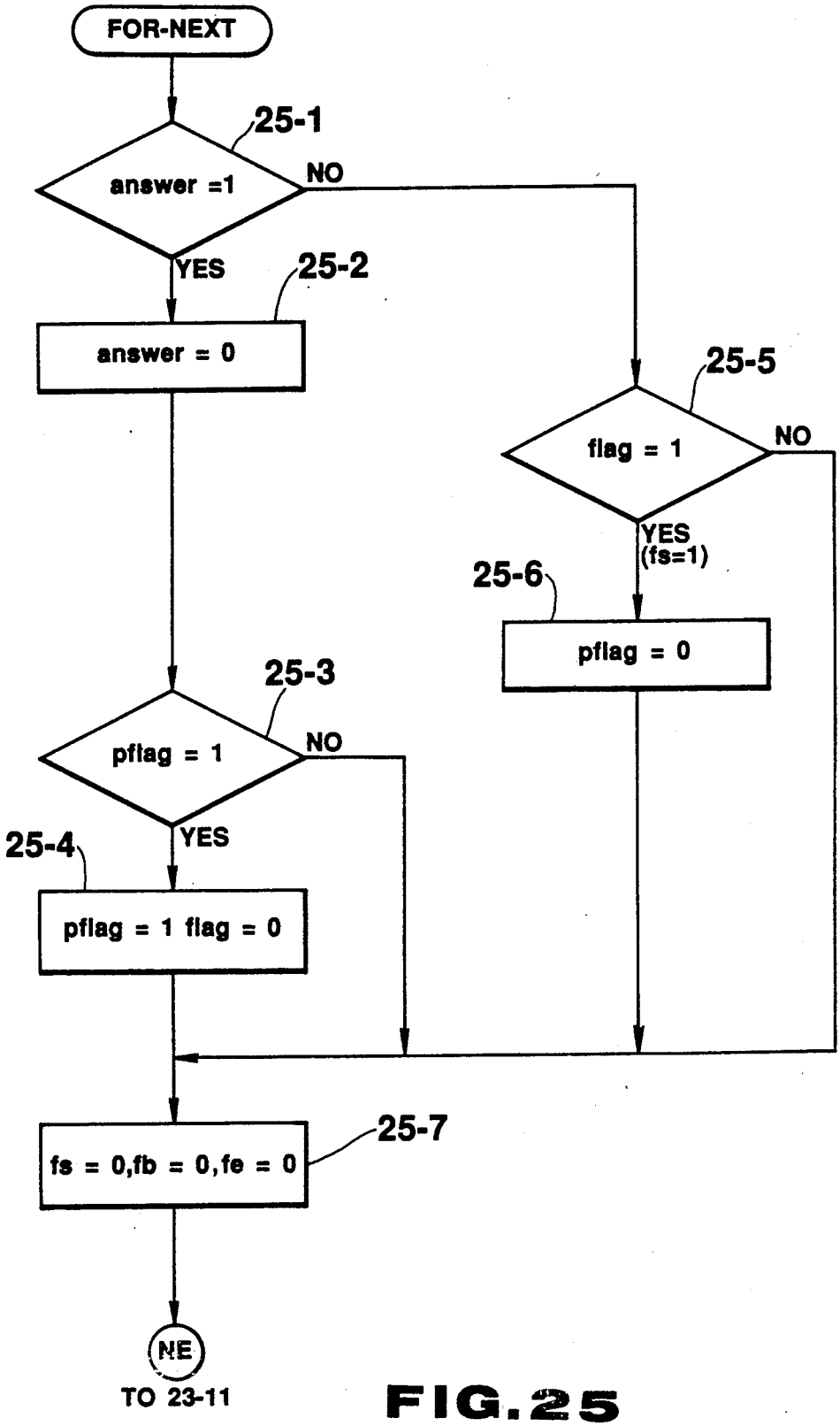

Finally, for preparation of the next pass of the chord progression process a flag processing block 23-10 is executed, as best shown in FIG. 25. When a block 25-1 finds answer=1, the current phrase has been completed. Therefore, a block 25-2 resets answer=0. In addition, when a block 25-3 sees flag=1, a recurring phrase has been completed. Therefore, flag is reset to flag=0, and pflag=1 is set for generating a new phrase chord progression in the next F-progression pass. When pflag=1 (25-5), a chord progression of a new phrase has been generated in the current F-progression pass. Therefore, pflag is reset to pflag=0 (25-6). The last block 25-7 restores other flags fs, fb and fe to the normal values.

This concludes the description of the production of a chord progression based on the F-progression.

(S-progression and D-progression)

The S-progression block 15-13 (FIG. 15) and the D-progression block 15-16 are provided for generating a chord progression to be added to a chord progression based on the F-progression described above. In a broad sense, S- and D-progressions also constitute chord patterns. Therefore, it is made possible to add S- and D-progression function subfiles to the functional chord pattern data file f4 noted before and also to add S- and D-progression chord pattern subfiles to the chord pattern data files f5 and f6 so that a chord progression of S- or D-progression may be appropriately inserted in or between the chord progression of an F-progression. In this embodiment, however, no dedicated subfiles of S- or D-progressions are provided, but an S- or D-progression is obtained according to the user's chord designation or through computation.

The S-progression block 15-13 and D-progression block 15-16 do not substantially differ from each other in respect of processing. Thus, as representative, the generation of D-progression-based chord progression will be mainly described hereinafter with reference to FIGS. 29A to 32, while taking up only different aspects of the S-progression generation. Details of the S-progression generation are shown in FIGS. 26A to 28.

Figure 29A:
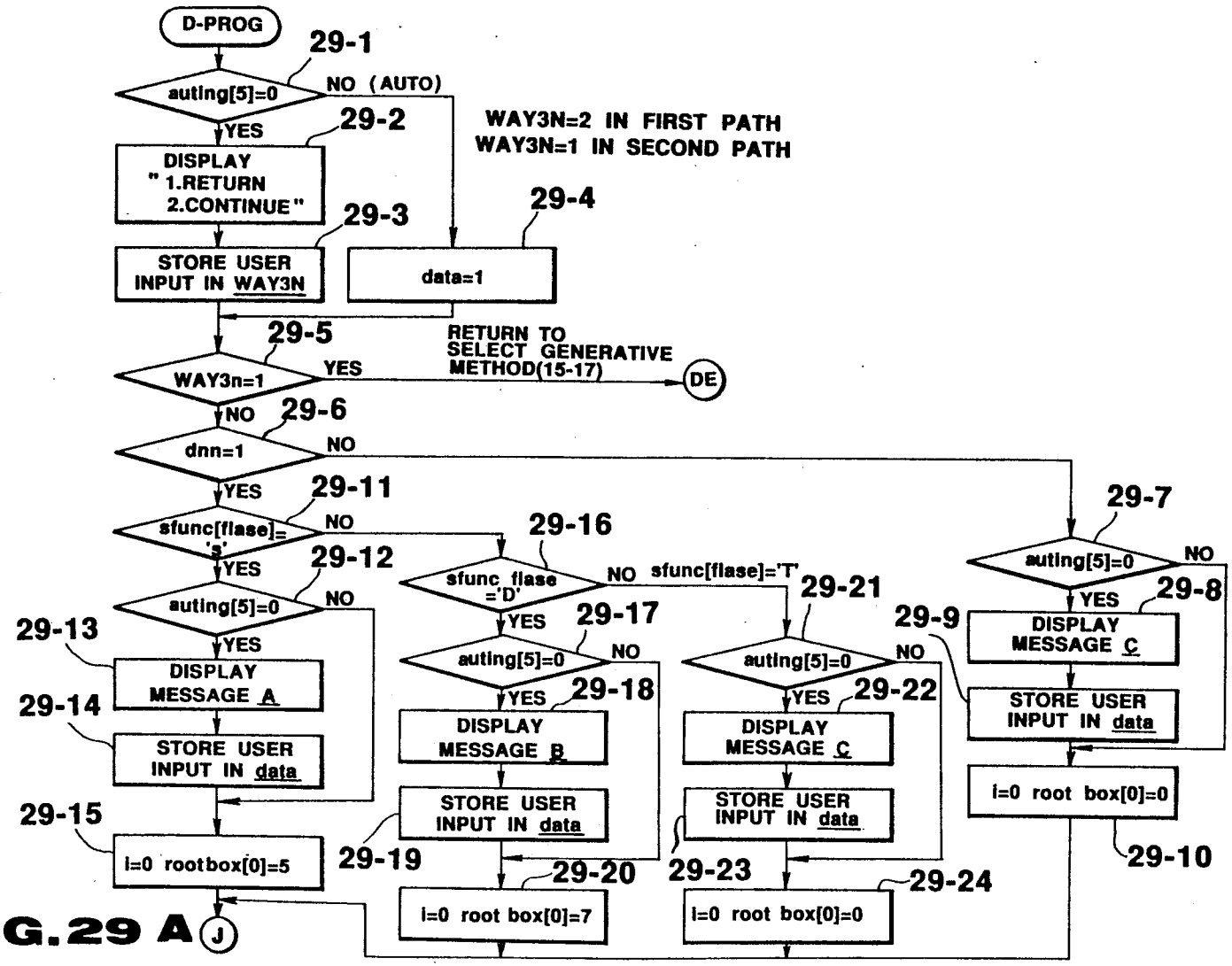
FIGS. 29A, 29B, 30, 31A, 31B and 32 are detailed flowcharts for generating a chord progression based on dominant progression.
Figure 29B:
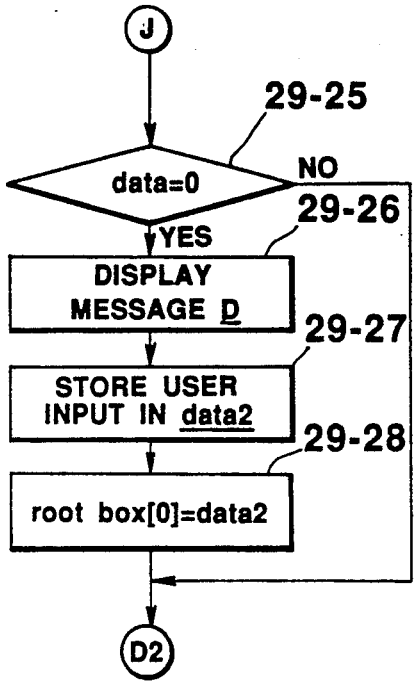

FIGS. 29A and 29B show a first portion of the D-progression generation process. The first portion is arranged to check as to whether to continue the D-progression and to determi the root of the first chord of D-progression.

A block 29-1 checks the content of auting(5) to see whether chord pattern generation (here D-progression generation) is to be done automatically or manually. In the manual mode, an inquiry is made to the user as to whether S-progression is to be continued or ended (block 29-2). The user's response is set in WAY3N. When the user's answer is "RETURN", i.e., WAY3N=1 (block 29-5), the program goes back to the chord progression generation method determination process (block 15-1 in FIG. 15). When the answer is the continuation, i.e., WAY3N=2, blocks 29-6 to 29-28 select a first chord root in D-progression. In the automatic mode, WAY3N=2 is given when entering the illustrated flow for the first time, while WAY3N=1 indicative of return is given when re-entering the flow in the second pass.

In general, the root selection blocks 29-6 to 29-28 are arranged to select as the first chord root, first scale degree or I (e.g., C in the tonality of C major) normally, fourth scale degree or IV (F) when the associated phrase starting function is an S function (including a subdominant minor function), and fifth scale degree or V (G) when a phrase starting function is a D function. However, in the case of the manual generation of D-progression, i.e., when auting(5)=0, change of the root to a different root can be made by the user. More specifically, in the block 29-6, dnn=1 represents the time to select the first chord of phrase. If not the first chord time, the block 29-7 tests as to whether auting(5)=0. If this is the case, i.e., manual mode, an inquiry is made to the user for confirmation as to whether I is appropriate for the first chord root of D-progression (block 29-8). If the user's answer is NO, i.e., data=0 (blocks 29-9 and 29-25), an input of a different root is requested (block 29-26), and the user's specified root is set in rootbox(0) (block 29-27 and 29-28). When the user approves (29-9, 29-25) the root I (here numeric data of 0) set in rootbox(0) by block 29-10 is finalized. The same applies to the case when auting(5)=1, "AUTO", and data=1 (blocks 29-4, 29-7, 29-10 and 29-25). When a chord to be generated is the first chord of a phrase, the block 29-6 yield YES. When the phrase starting function of that phrase is S-function, the block 29-11 provides YES. When the function is D-function, the block 29-16 provides YES. In this manner, when the phrase starting function is S-function, IV is selected normally as the first chord root rootbox(0) (block 29-15), V is typically selected when the phrase starting function is D-function (29-19), and I is normally selected when the phrase starting function is the other function or T-function (block 29-24).

Figure 30:
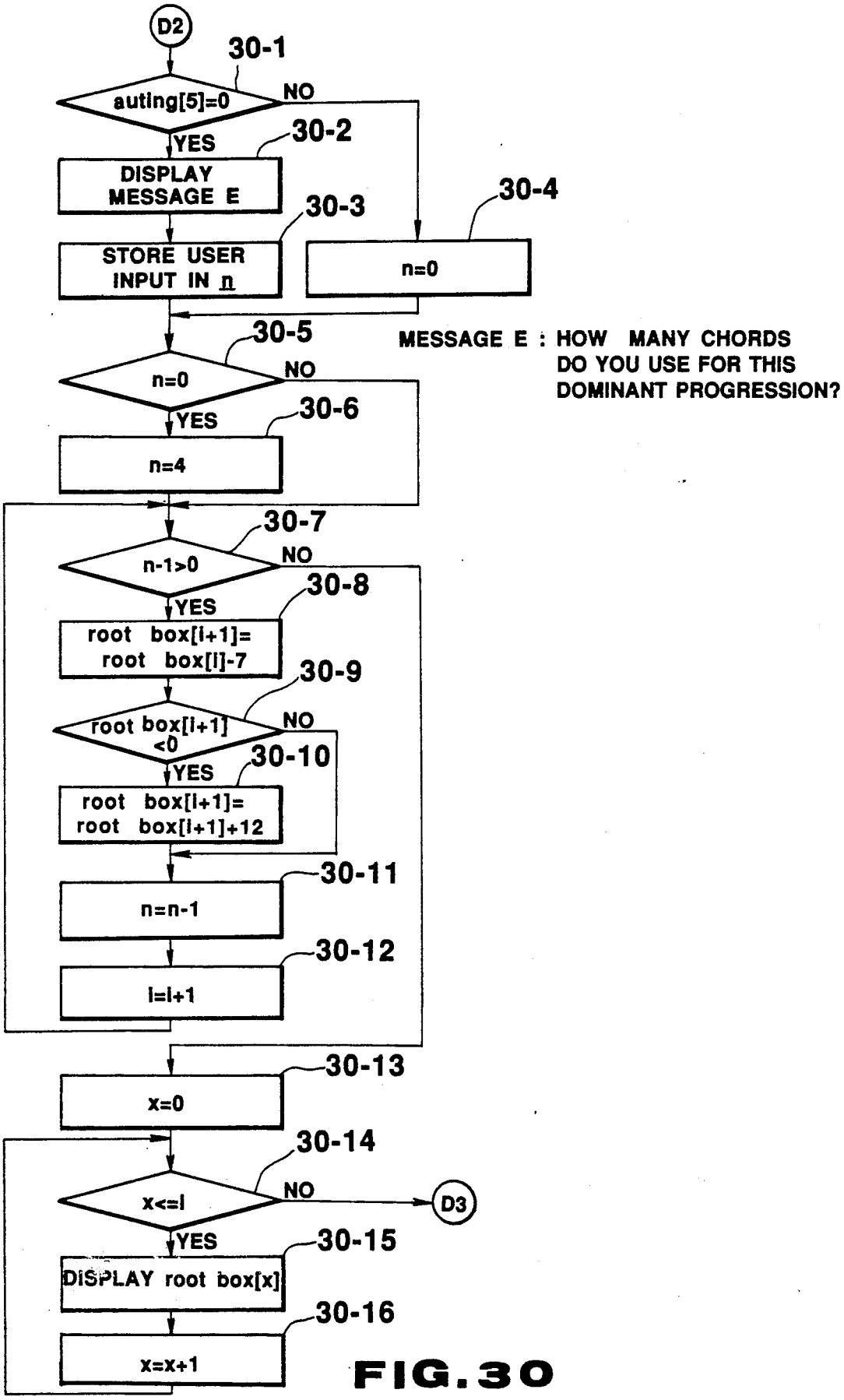

Having selected the root of the first chord of D-progression, the flow of FIG. 30 is executed, according to which the length of D-progression (i.e., the number of chords to be contained in the D-progression) and the roots of the respective chords of the D-progression are determined and displayed. More specifically, a block 30-1 checks as to whether the chord progression is to be generated automatically (auting=1), or manually. In the manual mode, an input of the length of D-progression is asked to the user (block 30-2), and the input is set in n (block 30-3). When the length of D-progression is not designated by the user or when in the automatic mode, the length of 4 is set in n (block 30-4 to 30-6). Then, blocks 30-7 to 30-12 loads array rootbox(i) with root data for the length n of D-progression such that each chord root is five degrees below (or four degrees above) the immediately preceding chord root. Thus, a note 5 degrees below the first chord root rootbox(0) of the D-progression is the second chord root rootbox(1) and so on. In this way, successive chord roots are set in a D-progression relationship in which each chord is 5 degrees down (or 4 degrees up) the immediately preceding chord root. A corresponding process of S-progression block is designed instead to generate each chord root having 5 degrees above (or 4 degrees below) the immediately preceding chord root. The routine of the blocks 30-8 to 30-10 is based on a root data format in which root data ranges from "0" to "11", with "0" representing C, "1" C#, "2" D and so forth and "11" B.

Having generated all chord roots of D-progression, blocks 30-14 to 30-16 display these chord roots on the display unit 6.

Figure 31A:
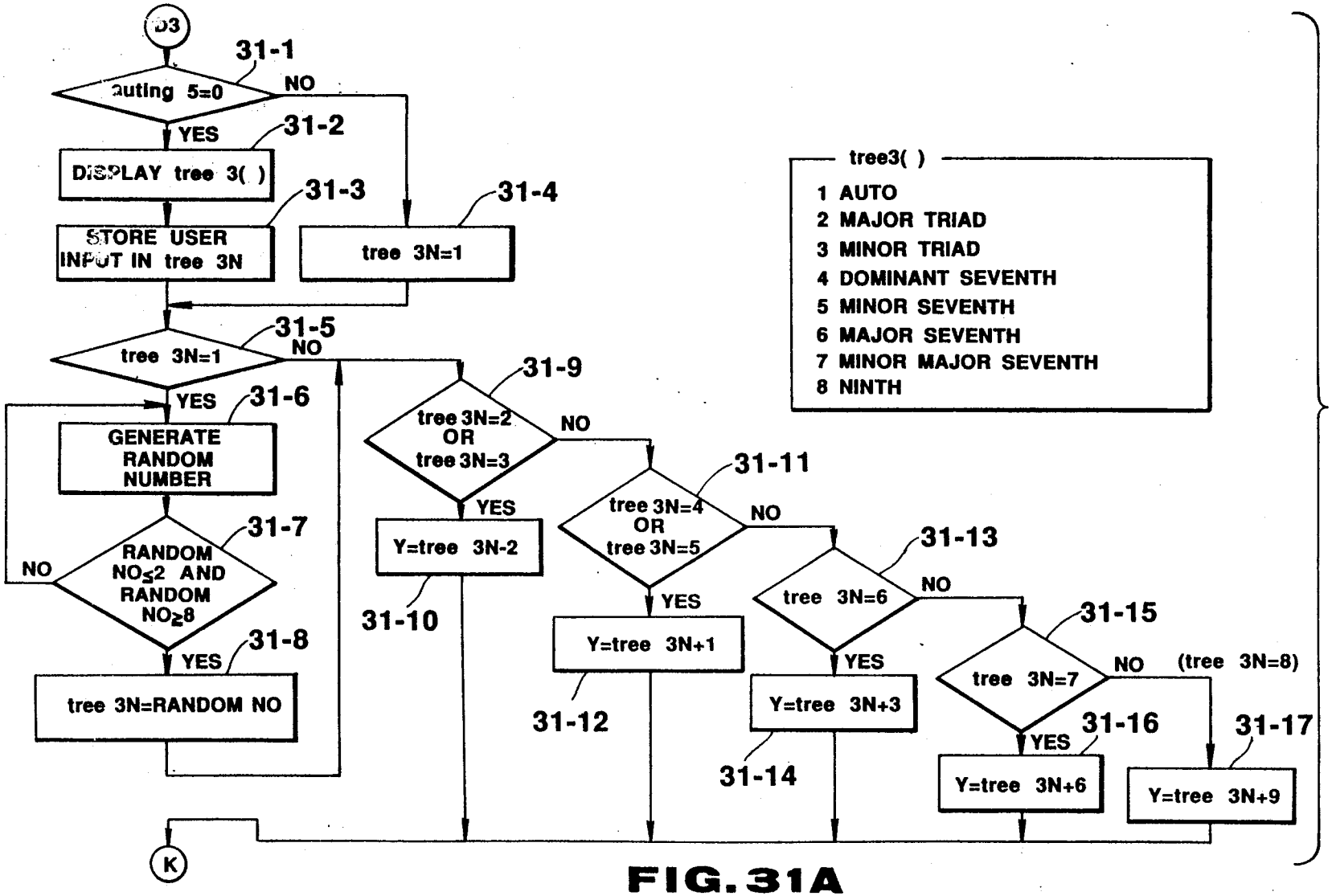
Figure 31B:
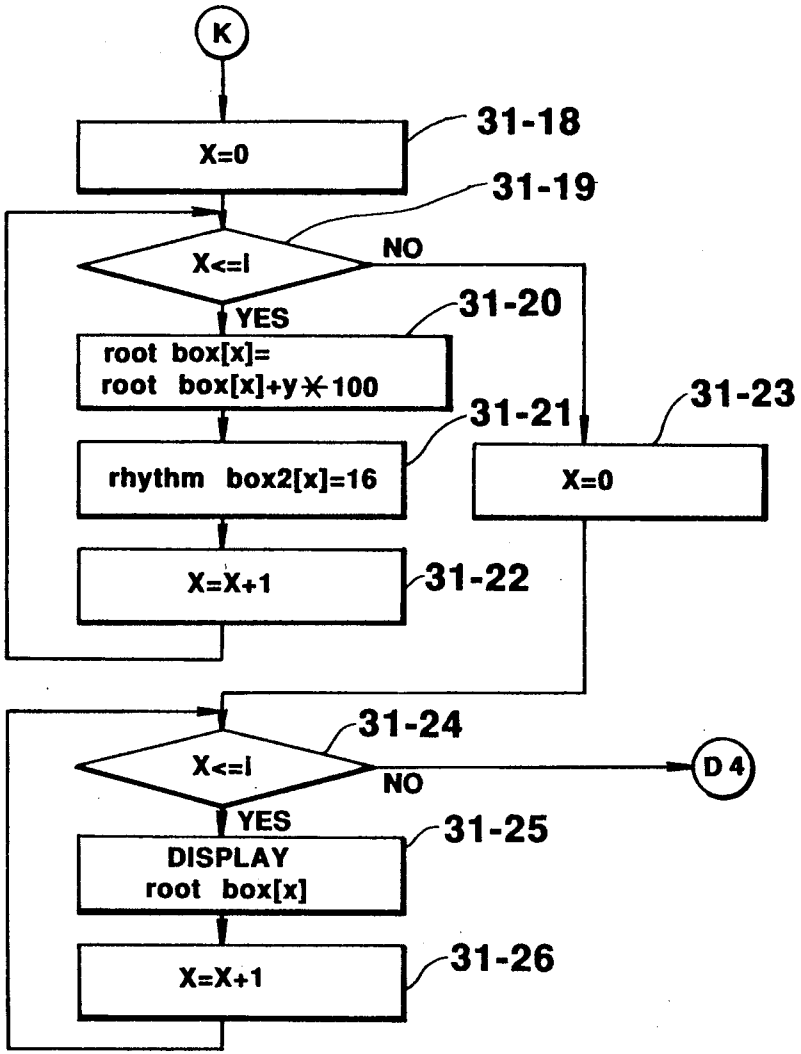
Figure 32:
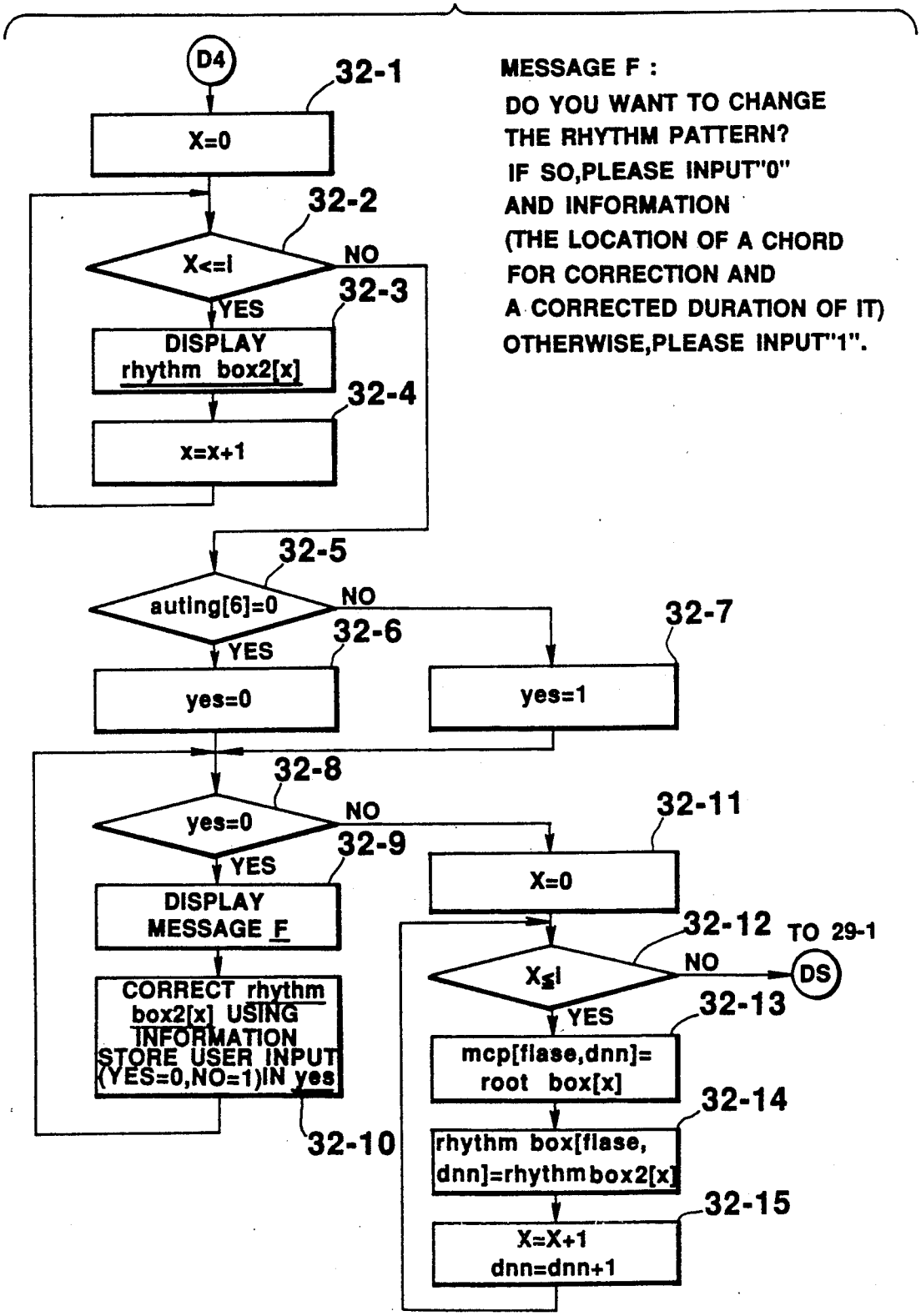

The program then goes to the flow of FIGS. 31A and 31B to determine chord types of the D-progression to set in array rootbox(x) the determined types together with the chord roots already determined in FIGS. 29A, 29B and 30, and to display the result in a row of chord names (for instance A7-$D_m$7-G7-C7). The time duration of each chord is also generated here. Blocks 31-1 to 31-17 in FIG. 31 determine the type of D-progression. First, the block 31-1 checks as to whether the D-progression is to be generated automatically (auting(5)=1), or manually. In the manual mode, a chord type menu tree3( ) is displayed (31-2), and the user's selection input is received (31-3). When (1) "AUTO" in the menu is selected (31-2, 31-3, 31-5) or when the automatic mode (auting(5)=1) has already been selected (see 31-4 and 31-5) with respect to D-progression, blocks 31-6 to 31-8 generate a chord type tree3N according to a random number. The routine of blocks 31-9 to 31-17 is to convert chord type data in tree3N to another format Y used in the system. In a system data format, for instance, major triad is represented by "0", and minor triad by "1" and so on. Blocks 31-18 to 31-22 set the array rootbox(x) so as to include the chord type data Y in combination with the chord root data already obtained, thus defining a chord. In the flow of FIGS. 31A and 31B a single chord type is commonly set for all the chords of the D-progression. However, it is readily possible to set a chord type for each of the chords. Such a modification may include means for automatically limiting or restricting chord types available in consideration of the tonality by excluding, for example, those chords including members outside a scale of the tonality. Further, the blocks 31-19 to 31-22 also set time durations of the respective chords of the D-progression into rhythm pattern rhythmbox2(x) of D-progression (see block 31-21). The rhythm pattern generation process here is only to allot a duration of a whole note (numerically expressed by 16) to each chord. If this rhythm pattern is not desired, a manual correction will be made in the flow of FIG. 32. Blocks 31-24 to 31-26 display the respective chord name data or chord pattern rootbox(x) of the D-progression, and then blocks 32-1 to 32-4 in FIG. 32 display the corresponding rhythm pattern rhythmbox2(x).

Next, a block 32-5 checks auting(6) to see which mode, either auto (auting(6)=1) or manual mode has been selected with respect to the process of rhythm pattern. In the manual mode, YES=0 (block 32-6), and an inquiry is made to the user as to correction of the rhythm pattern (32-9). If the user provides a desired rhythm input for correction, a corresponding element in the arry rhythmbox2(x) is changed accordingly (block 32-10). In the automatic mode, this causes YES=1 (block 32-7), and skips the rhythm pattern correction blocks 32-8 to 32-10. In the operations so far, the chord pattern rootbox(x) and rhythm pattern rhythmbox2(x) of the D-progression have been obtained so that they are concatenated respectively to the chord name array mcp(flase,dnn) and chord duration array rhmbox-(flase,dnn), of the final chord progression (blocks 31-11 to 32-15). Thereafter, the program goes back to the block 29-1 of FIG. 29A and, if "RETURN" is selected, this terminates the D-progression generation routine returning to the chord generation method determination process.

Data in File Memory 3 (Example)

Tables shown at the end of the detailed description illustrates data stored in the file memory 3 in FIG. 1. The table entitled "List. Dt File" lists names or addresses of data files. There are seven data files: "file 1.dt" for storing a file of phrase structures for various music pieces arranged in groups by musical forms; "scon.dt" for storing a file of phrase-starting functions of respective phrases arranged in groups by the phrase structures; "econ.dt" for storing a file of phrase-ending functions of respective phrases arranged in groups by the phrase structures; "function.dt" for storing a file of functional chord patterns; "caden.dt" for storing a file of chord patterns for use in major music in a root-type specifying form, arranged in groups by the functional chord patterns; "mcaden.dt" for storing a file of chord patterns for use in minor music in a root-type specifying form, arranged in groups by the functional chord patterns; and "rhymfile.dt" for storing a file of rhythm patterns i.e., time durational series of each chord pattern, arranged in one-to-one relationship with "function.dt" file. The table of "HIE-STRUCTURE" illustrates data in files of "file 1.dt" for phrase structure, "scon.dt" for phrase-starting function and "econ.dt" for phrase-ending function, jointly representative of musical hierarchical structures in various music pieces by hierarchic relationships among a musical form, phrase structure, phrase-starting function and phrase-ending function. For example, in the table, the first music piece species belonging to a binary or two-part form has a phrase structure of A-A'-A-A". This indicates that the first phrase is of A type, the second phrase of A' type (similar to the first phrase), the third phrase of A type, and the fourth phrase of A" type. The first phrase A starts with T or tonic function and ends with D or dominant function, the second phrase A' starts with D and ends with D, the third phrase A starts with T and ends with S or subdominant function, and the fourth phrase starts with T and ends with T. The data shown in "HIE-STRUCTURE" may be stored in the musical structure database 150 in FIG. 33, which will be referred to later in conjunction with a dialogue aspect of the invention.

The table "function.dt" illustrates a file of functional chord patterns, arranged in two groups, one for major music, at lines 2-8 in the table, and the other for minor music at lines 10 to 12. In the table "function.dt", T indicates a tonic function of a chord, D indicates a dominant function, S indicates a subdominant function, and Sm indicates a subdominant minor function. Thus, for example, a pattern of T-D-T means that the first chord has a tonic function, the second chord has a dominant function and the third chord has a tonic function.

The table "caden.dt" illustrates a file of more specific chord patterns for major music while the table "mcaden.dt" illustrates a file of chord patterns for minor music. Each file "caden.dt", "mcaden.dt" is divided into groups according to each functional chord pattern in "function.dt". For example, in the file "caden.dt" the first five chord patterns of:

| | | |
|---|---|---|
| 0 | 507 | 0 |
| 0 | 501 | 0 |
| 0 | 60b | 0 |
| 0 | 307 | 0 |
| 0 | 208 | 0 |

form a group of chord patterns belonging to the first functional chord pattern of T-D-T in the file "function.dt" for major music. In each table of "caden.dt" and "mcaden.dt", each three or one digit number indicates a chord by a root and a type. The one digit expression is an abbreviation of three digits with the highest two digits equal to zero (e.g. "0"="000", "5"="005"). The highest digit (actually, the highest 8 bits of a 16 bit word) indicates a type of a chord while the lowest 8 bits of the 16-bit word indicates a root of chord (see the tables). For example, a pattern of data 0-507-0 represents a chord pattern of a first chord of C major followed by a second chord of G dominant seventh followed by a third chord of C major.

The table "rhymfile.dt" illustrates a file of chord time durational or chord rhythm patterns, arranged in a one-to-one relationship with the file "function.dt". In the file "rhymfile.dt", each numeric data represents a duration or length of a chord in terms of an integer multiple of a musical elementary time duration. For example, the numeric data of "16" may correspond to a length of one measure or whole note, and then the data "8" indicates half of one measure or the length of a half note.

Figure 33:
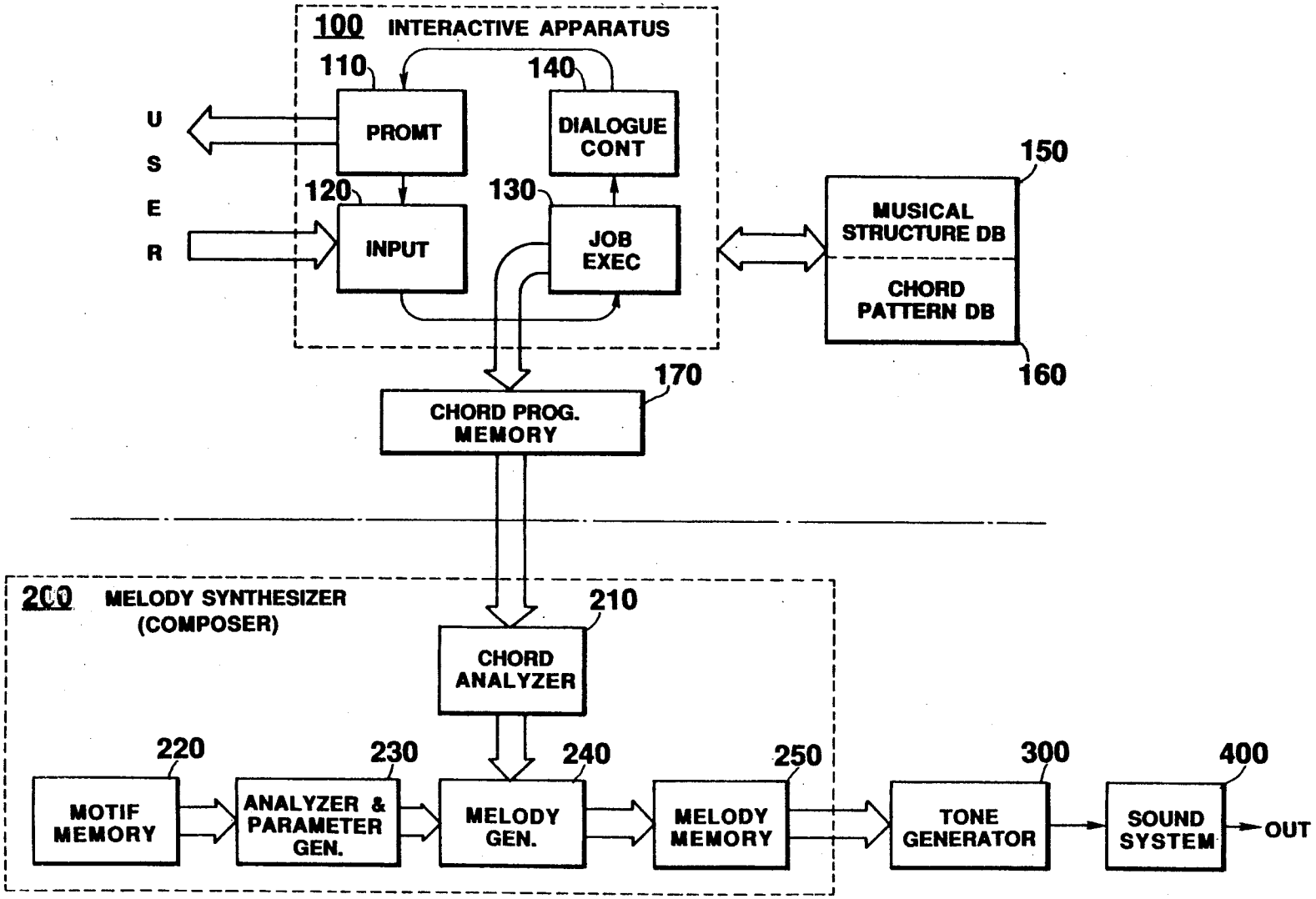
FIG. 33 is a block diagram of an automatic composer for producing a melody based on a chord progression generated in a dialogue between the user and the apparatus in accordance with an aspect of the invention.

The files of "function.dt", "caden.dt", "mcaden.dt" and "rhymfile.dt" may be stored in the chord pattern database 160 in FIG. 33.

Features of the Embodiment

The features and advantages of the above embodiment have been obvious from the foregoing description. For example:

(A) Because a chord progression is generated based on featuring structures of music schemed and extracted from a piece of music, a chord progression thus generated will be rendered musicality, naturalness, unity and variety.

(B) For example, the phrase starting and ending functions of chord progression can be controlled for each phrase such that they are identical with respective phrase starting and ending functions structurally planned in advance.

(C) In the case when the planned and preset phrase structure data of music contain a plurality of phrases which are similar in type to each other and have the same phrase starting and ending functions as one another, repeat control acts upon these phrases so that they have the identical chord progressions, thus accomplishing repetition or recurrence of a chord progression.

(D) Knowledge about structures in music can be represented by the stored data in the file memory 3 in which multi-leveled hierarchical structure data of music are operatively linked together from one level to another.

(E) Therefore, any choice of data from the file memory 3 will construct a hierarchically well-ordered structure in music. This assures musicality in a chord progression generated thereby.

(F) Selection of data from the file memory 3 can be made either automatically or manually. The choice as to whether the selection is done automatically or manually is up to the user for each item or domain. It is thus possible to widely vary an extent of user's participation in the chord progression generation depending on the taste, experience and skill of the user, from a full automatic production of a chord progression to a user-driven chord progression which fully reflects the user's intentions.

(G) The user of the present progression production apparatus will understand a characteristic of the nature of music in which a chord progression does not exist alone but is produced or created with the structure or dynamism of music as background. Further, the user may approach, if desired, a chord progression from an aspect of functional or abstractive level. Thus, the apparatus may serve as an educational chord progression machine useful to many users.

(H) The present chord progression apparatus may also be utilized as a chord progression generation function in an automatic composer of a type which generates or synthesizes a melody of music based on a chord progression.

(I) The chord progression apparatus provides an advantageous enviroment in which a chord progression is produced in the course of a dialogue conducted between the apparatus and the user on a menu-driven basis.

Menu-driven Chord Progression Apparatus & Application To Musical Composer

From an aspect of man-machine interface, the present apparatus may be regarded as a menu-driven system which conducts a dialogue with the user for production of a chord progression desired by the user. This feature is shown in the upper half of FIG. 33 by an arrangement of a menu-driven interactive apparatus 100, musical structure database 150, chord pattern database 160 and a chord progression memory 170, wherein the interactive apparatus 100 selectively retrieves data from the musical structure database 150 and chord pattern database 160 and stores a resultant chord progression into the chord progression memory 170. The arrangement may be identical with the described and shown apparatus (see FIGS. 2 and 3, for example) for producing a chord progression, though at a glance different in appearance because the arrangement of FIG. 33 primarily focuses on an aspect of dialogue capabilities. The interactive apparatus 100 comprises a prompting module or section 110 which presents the user with a list of choices. An example of the list of choices may be a list of musical forms stored in the musical structure database 150. Another example of the list may be a group of musical phrase structures retrieved from the musical structure database 150. Still another example of the list may be a group of chord patterns at either of functional level and root-type specifying level selected from the chord pattern database 160. A further example of the list may be a query requiring a Yes or No response from the user with respect to a particular problem. In addition to a group of data items (e.g., musical forms, phrase structures, chord patterns), a typical list of choices further comprises a choice of return to a dialogue cycle corresponding to the previous dialogue cycle and a choice of automating according to which selection of a data item from the group of data items is automatically carried out for the user. The return function permits a dialogue between the user and the interactive apparatus 100 to be conducted in a to-and-fro manner so that the user can easily and freely change the data item that the user once selected into another and better item in pursuit of a more desirable chord progression. The user takes advantage of the automating function only when and whenever he or she wishes to do so; some users may select everything all by themselves while some other users may select some items by themselves but let some other items to be automatically selected by the automating function. In this manner, the selectively operable automating facility provides a user-interface environment useful for any user including both of a layman and a person of good experience in music.

The list of choices presented at a time depends on the system status at that time as to what dialogue cycle is in progress and therefore, the phase of a dialogue between the user and the system. From the presented list of choices, the user selects an alternative (e.g., a musical form, a phrase structure, a chord pattern, an answer of Yes) and input it as the user's response to a input section 120. The user's input response is then passed to a job executing or performing section 130 which carries out a job specified by or associated with the alternative selected by the user. For example, in a dialogue cycle of selecting a musical form, the user's response is a particular musical form. In this case the associated job may be to determine or confirm that the particular musical form has been selected from a set of musical forms in the musical structure database 150 so that the particular musical form will be a musical structure at the broadest or largest structure level in a music piece for which a chord progression is to be formed. This may be implemented by storing the data of the particular musical form into a dedicated memory or register (not shown) in the interactive apparatus 100. In case that the user's response is a particular phrase structure, the associated job may be to determine or confirm that the particular phrase structure has been selected from a group of phrase structures stored in the musical structure database 150 as belonging to the musical form already selected in a dialogue cycle of selecting a musical form so that the particular phrase structure will be a musical structure at a phrase level in the music piece for which a chord progression is to be produced. This may be implemented by storing data of the particular phrase structure into another memory (not shown) in the interactive apparatus 100, dedicated for storage of a selected phrase structure. In a dialogue cycle of selecting a phrase-starting/ending function of respective phrases of a music piece, the user's response is a particular one selected from a group of phrase-starting/ending function structures belonging to the phrase structure already determined in the dialogue cycle of selecting a phrase structure. In this case, the associated job may be carried out by storing the data of the particular phrase-starting-/ending function structure selected by the user into another dedicated memory (not shown) in the interactive apparatus 100. In case where the user's response is a particular chord pattern at a functional level in terms, for example, of tonic, dominant and subdominant functions, the associated job may be to determine that the particular functional chord pattern has been selected for concatenation with a functional chord progression generated so far for a current phrase, and to check as to whether the particular functional chord pattern includes a musical function identical with the ending musical function of the current phrase which was already determined in the dialogue cycle of selecting a phrase-starting/ending function of respective phrases of the musical piece so that if the check holds, the chord progression for the current phrase may end at a point of the particular chord pattern which matches the predetermined ending function of that phrase.

In either case, after the job executing section has carried out the job associated with the user's response, one dialogue cycle completes and the next dialogue cycle is initiated by the dialogue continuing section 140 for continuation of a dialogue with the user. To this end, the dialogue continuing section 140 creates a list of choices based on the job result of the job performing section 130 and passes it to the prompting section 110 so that the prompting section presents the list to the user. The creation of the list selectively involves data retrieval from either of the musical structure database 150 and the chord pattern database 160.

In a sequence of the dialogue actions, the job execution section 130 carries out a succession of jobs, as a result of which a chord progression of a music piece is produced which comprises a concatenation of the chord patterns selected from the chord pattern database 160 and bears a compatible relationship with the musical hierarchic structure (e.g., musical form, phrase structure, and phrase-starting/ending function) selected from the musical structure database 150. The data of the produced chord progression is stored in the chord progression memory 170.

FIG. 33 also illustrates a melody synthesizer or musical composer apparatus 200 for utilizing the above-mentioned arrangement as a source of a chord progression. The melody synthesizer 200 may be of the type disclosed in U.S. patent applications Ser. Nos. 07/177,592, filed on Apr. 4, 1988, and 07/288,001, filed on Dec. 20, 1988, both assigned to the same assignee as the present application and incorporated herein as reference. The melody synthesizer 200 composes a music piece or a melody part thereof by synthesizing a melody based on the chord progression in the chord progression memory 170. The illustrated composer 200 comprises a motif memory 220 for storing a motif (relatively short melody) which originally may have been inputted by the user. A motif analyzer and parameter generating section 230 analyzes the motif, produces melody featuring parameters (e.g., arpeggio featuring pattern, distribution of nonharmonic tones, pitch range for each musical segment such as measure) and supplies them to a melody generator 240. A chord analyzer 210 (optional) may be provided which evaluates the chord progression in the chord progression memory 170 to provide additional featuring parameters (e.g., musical hierarchic structure) to the melody generator 240. For each measure of a music piece, the melody generator 240 converts associated melody featuring parameters into a melody based on the associated chord or chords in the chord progression from the chord progression memory 170. For example, the arpeggio featuring pattern which represents a pattern of harmonic tones each expressed by an octave class identifying number and a chord member indentifying number is transformed into a pattern of harmonic tones each expressed by a pitch, using the pitch class collection of the associated chord in the supplied chord progression. The data of the generated melody of the music piece is stored in a melody memory 250. In a music performing mode, each note of the stored melody is supplied to a tone generator 300 which may of any conventional type. In response to each note arrival the tone generator 300 synthesizes a tone waveform signal which is then delivered to a conventional sound reproduction system 400 for reproducing and emitting a corresponding sound.

Modification

A modification of an apparatus for producing a chord progression of a music piece will be described with reference to FIGS. 34 to FIG. 47C. In this modification, there is provided a file of chord patterns. Each chord pattern in the file is associated with at least one chord pattern defined in another file called next chord pattern candicate file in such a manner that the at least one chord pattern is grouped to form a set of chord pattern candidates or choices each of which can come next after the associated chord pattern. In accordance with this modification, once a chord pattern included in the file of chord patterns has been selected and determined to be the current chord pattern, symbolized here by CP(i), in a chord progression of a music piece which is here assumed to have developed up to CP(i), a set of chord patterns defined in the next chord pattern candidate file as being associated with the current chord pattern CP(i) is retrieved and presented to a user as a list of choices for the next chord pattern that succeeds CP(i). From the list, the user selects an alternative. The (finally) selected chord pattern, which may be symbolized by CP(i+1), is concatenated to the current chord pattern CP(i). Now, it may be appropriate to call CP(i+1) the current chord pattern because the chord progression has just been created up to CP(i+1). Assume here that CP(i+1) is included in the above-mentioned file of chord patterns. Then, the user is presented again with a set of chord patterns in the next chord pattern candidate file which can follow the current chord pattern CP(i+1), and a chord pattern in the set is selected and determined as CP(i+2) for concatenation with CP(i+1) in a similar manner described above. By repeating the process, there is grown and completed a chord progression of a music piece which comprises a selected concatenation of chord patterns.

Figure 34:
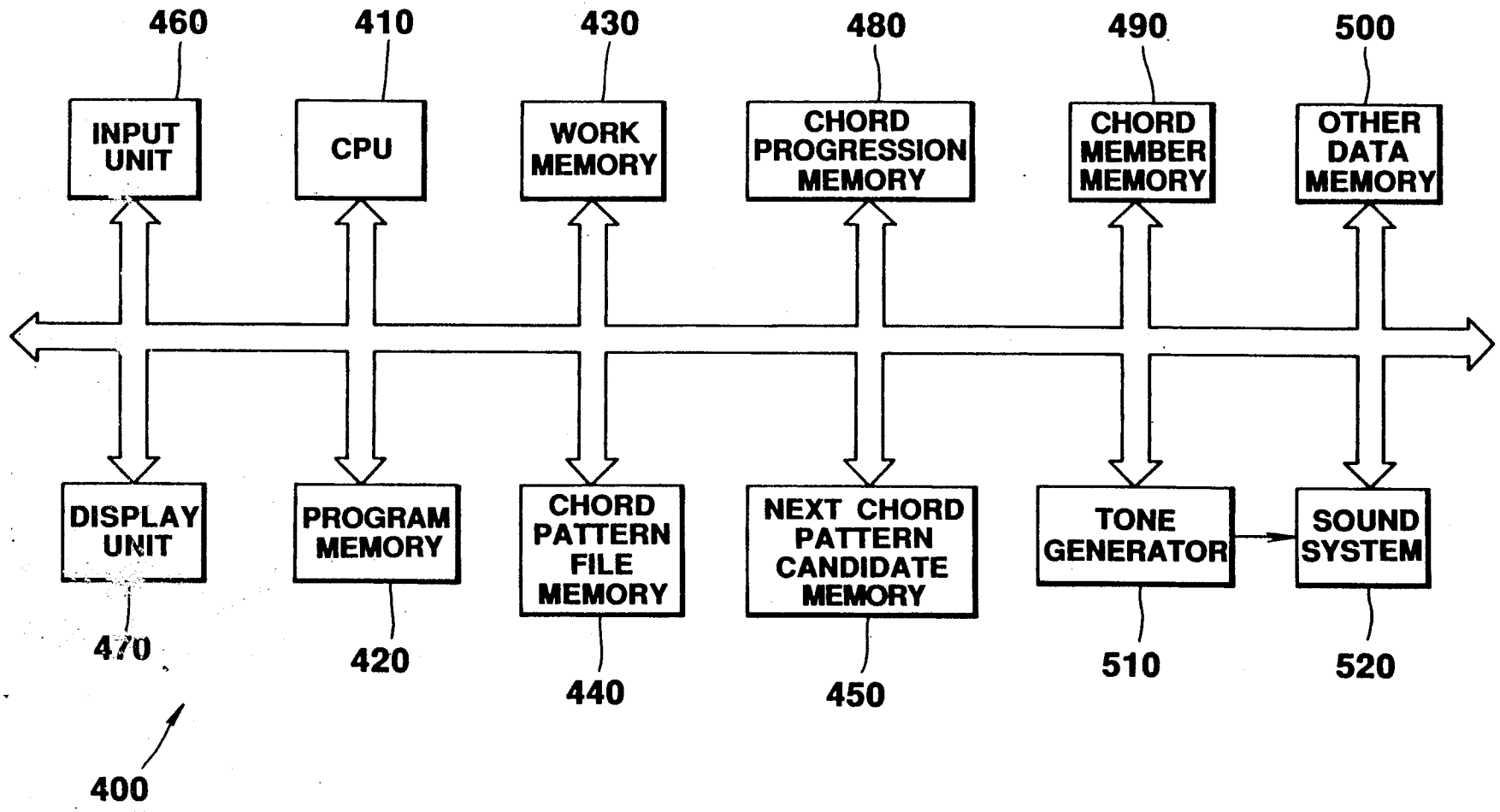
FIG. 34 is a block diagram of an apparatus for producing a chord progression in accordance with a modification of the invention.

FIG. 34 shows an overall arrangement of such a modified apparatus designated here by 400 for producing a chord progression of a music piece in a manner generally described above.

CPU 410 is operable according to a program stored in a program memory 420. A work memory 430 is accessed by CPU 410 for temporary storage of data. A chord pattern file memory 440 stores a file of chord patterns each serving as a unit of a chord progression of a music piece to be produced. Each chord pattern in the file 440 is associated with a group of chord patterns in a next chord pattern candidate file 450 in such a manner that the group defines a set of next chord pattern candidates each of which can follow the associated chord pattern.

Figure 35:
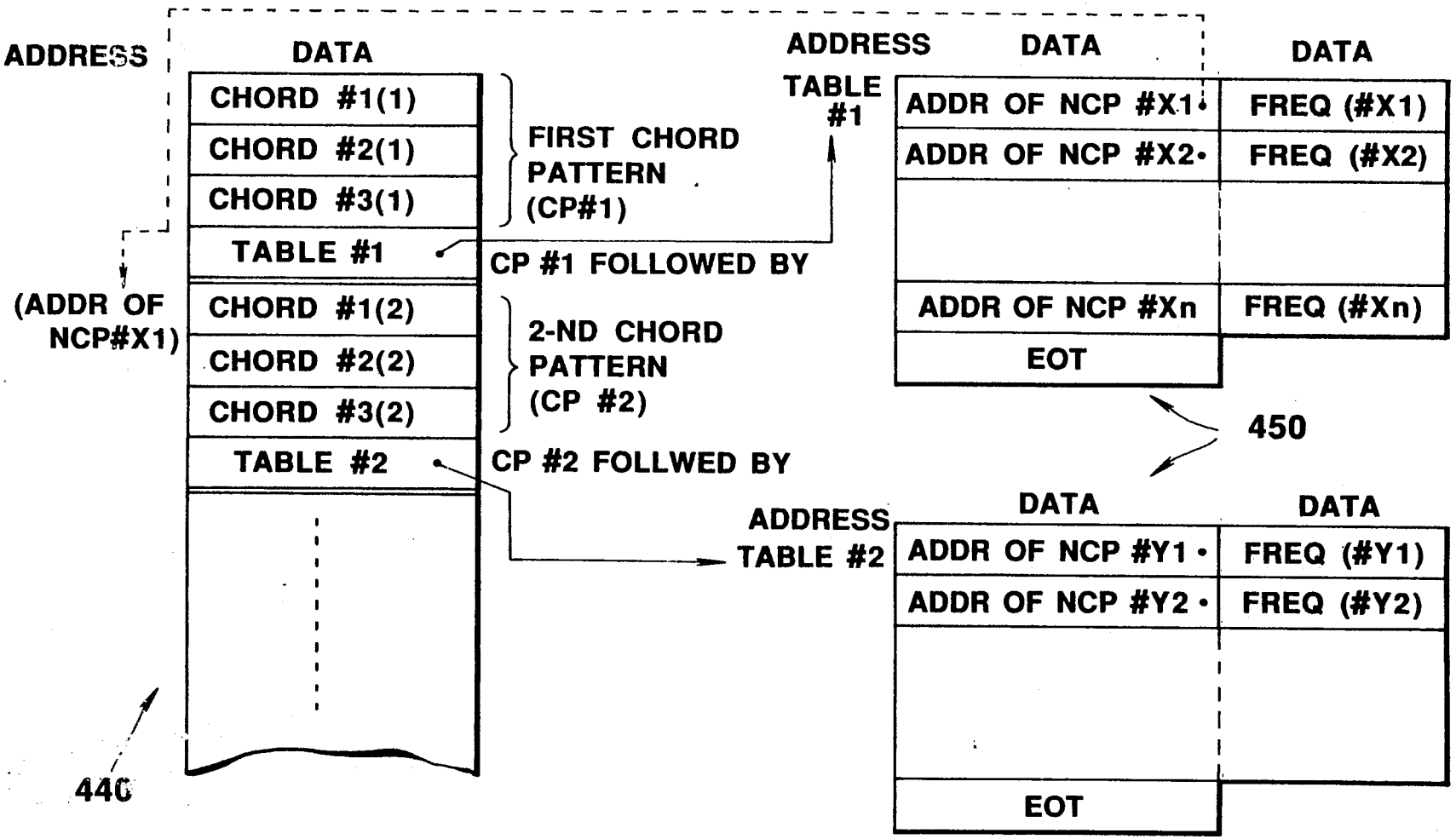
FIG. 35 shows data structures of the files 440 and 450 in FIG. 34 as well as the relationship therebetween.

FIG. 35 shows data structures or formats in the chord pattern file memory 440 and the next chord pattern candidate file memory 450 as well as the relationship therebetween. In the chord pattern file memory 440, a plurality of chord data stored in consecutive addresses represents a chord pattern comprising these chords connected in this order. For example, three chords of CHORD#1(1), CHORD#2(1), and CHORD#3(1) stored in the first three locations constitute a first chord pattern in the file 440. It should be noted that each chord pattern may comprise any number of chords which may be equal to or more than two. Further, different lengths of chord patterns may reside in the file 440.

To associate each chord pattern in the file 440 with a group or table of next chord pattern candidates in the file 450, there are provided pointer areas in the file 440 which stores pointers generally designated TABLE# pointing to respective tables in the file 450. In FIG. 35, each such pointer is placed at the end of a chord pattern. For example, pointer TABLE#1 stored in the fourth location in the file 440 serves to associate the first chord pattern CP#1 comprising CHORD#1(1), CHORD#2(1) and CHORD#(3) with a next chord pattern table designated also TABLE#1 in the file 450. Each table in the file 450 stores information about a group of chord patterns each of which can come next after the associated chord pattern in the file 440. In order to save the storage capacity of the file 450, such information may advantageously take the form of pointers each pointing to a chord pattern in the file 440 as shown in FIG. 35. By way of example, TABLE#1 as the next chord pattern table to the first chord pattern CP#1 comprises a N number of next chord pattern candidates in the form of pointers designated ADDR OF NCP#X1 to ADDR OF NCP#Xn. The first pointer called ADDR OF NCP#X1 indicates an address of the file 440 with respect to the first candidate for the next chord pattern to the first chord pattern CP#1 in such a way that the pointer locates where on the file 440 the first candidate data for the next chord pattern begins. In FIG. 35, ADDR OF NCP#X1 happens to be a pointer to the second chord pattern CP#2 in the file 440 as shown by a dotted line. This means that the first chord pattern CP#(1) can be followed by the second chord pattern CP#2.

Each table in the file 450 further stores information about frequencies of respective next chord pattern candidates generally designated by FREQ. Each frequency data indicates a relative frequency or count of the associated chord pattern which has been used over time as a unit of a chord progression or progressions. In the course of producing a chord progression, each time a chord pattern is selected from a next chord pattern candidate table in the file 450 and determined to be the next chord pattern, the frequency data of that chord pattern is incremented as will be described in more detail. Each table in the file 450 ends with a code of EOT.

Turning back to FIG. 34, an input unit 460 is used to provide user's responses and commands such as starting and ending the process of producting a chord progression of a music piece, selecting a chord pattern to be used in such a chord progression, and so on. A display unit 470 is used to provide a visual presentation of messages and data such as a list of chord pattern candidates from which the user selects an alternative by means of the input unit 460. A chord progression memory 480 is arranged to store a generated chord progression or progressions. A chord member memory 490 stores chord member data in terms of note numbers indicative of pitches for each chord used in a chord progression. In the course of producing a chord progression, the chord member memory 490 is accessed by CPU 410 for converting into chord performance data having a format appropriate for the operation of a tone generator 510 from a generated chord progression in the memory 480 in which each chord is specified by a root and a type; CPU 410 decomposes such root-type specifying chord into chord member pitches by referencing the chord member memory 490.

A memory 500 stores other data such as those necessary for the operation of the tone generator 510 (e.g., tone timbre data) and those for the operation of the display unit 470.

The tone generator 510, which may be of any conventional type, is provided to electronically synthesize tones. In the course of producing a chord progression, when a chord pattern is selected, the chord performance data corresponding to the selected chord pattern and a generated chord progression or part thereof in the memory 480 preceding the selected chord pattern are produced by CPU 410. Then CPU 410 processes (decodes) the chord performance data and transfers the decoded performance data including note on/off commands to the tone generator 510 which in turn produces corresponding tones to be delivered to a sound system 520 from which corresponding acoustic signals are emitted. In this manner, a selected chord pattern is played in continuation of the pre-play of the preceding chord progression of interest. This function makes it easier for the user to judge whether the selected chord pattern is really appropriate for connection to the chord progression generated so far in the memory 480.

Figure 36:
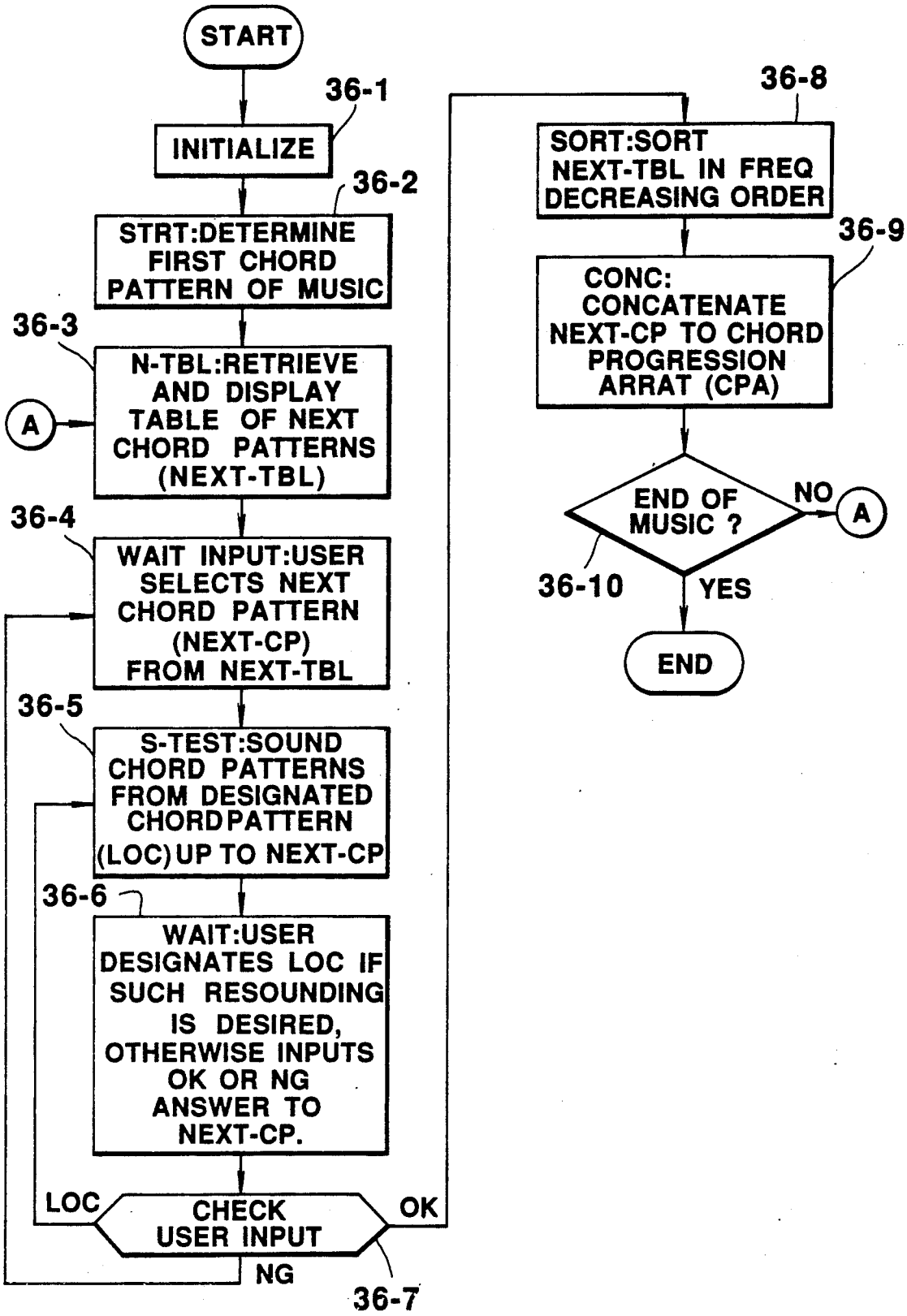
FIG. 36 is a general flowchart of the operation of the modification in FIG. 34.

According to a general flowchart of FIG. 36, the apparatus 400 produces a chord progression of a music piece.

In block 36-1, the system 400 is initialized for the production of a chord progression. In block 35-2, the first chord pattern of music is determined. This may be accomplished as follows. Under the control of CPU 410, all chord patterns in the chord pattern file memory 440 are read out and displayed in an appropriate visual format on the display unit 470. Then the user selects one of the displayed chord patterns by means of the input unit 460. If desired, the selected chord pattern may be played for user's confirmation. The chord pattern thus selected and determined is stored in the chord progression memory or array 480 as the first chord pattern.

In the following blocks 36-3 to 36-10, chord patterns will be selected, determined and concatenated one after another until a chord progression of a music piece is completed in the array 480. In the description to follow, the current chord pattern refers to a chord pattern last determined and stored in the chord progression array 480.

Block 36-3 retrieves from the memory 450 a table of the next chord pattern candidates (NEXT-TBL) each of which can come next after the current chord pattern and displays the information of the table on the display unit 470. Next-select block 36-4 waits for the user to select, as a next chord pattern, one of the chord patterns presented on the display unit 470. After the user has selected a chord pattern (NEXT-CP), the program advances to a sound-test block 36-5 in which the selected chord pattern together with at least part of the chord progression preceding the selected chord pattern is played for the user's confirmation (in the first path directly after the block 36-4, only the current and next or selected chord patterns are played). After the sound test, block 36-6 waits for the user's response. At this point, if the user thinks it necessary to hear again the chord performance which may, however, begin at a different point, the user will designate such a play-starting location (LOC) for further judgement of the selected chord pattern NEXT-CP. In this case, block 36-7 identifies the location LOC and the program returns to the sound-test block 36-5 which plays the chord performance from the designated location LOC.

In the case of dissatisfaction with the selected chord pattern, the user inputs an NG answer. This is detected in the block 36-7 from which the program branches and goes back to the next-select block 36-4 in which the user will select a different next chord pattern.

Having been satisfied with the selected chord pattern, the user provides an OK answer. This is confirmed in the block 36-7 and the program goes to block 36-8 which sorts the elements of the next chord pattern table NEXT-TBL in the frequency decreasing order. Then, block 36-9 concatenates the selected and determined NEXT-CP with the chord progression array (CPA) so that the NEXT-CP is placed at the end of CPA as the last chord pattern thereof, and is now called the current chord pattern.

Block 36-10 asks the user as to whether a chord progression of a music piece has been completed, and will receive the user's response. If the user's response indicates continuation of the production of a chord progression, the program goes back to block 36-3. Otherwise, the program exits from the flowchart of FIG. 36 with a complete chord progression of a music piece stored in the chord progression array 480.

Before turning to the details of several blocks in the flowchart of FIG. 36, description will be made of main registers and memories referenced in those blocks.

Figure 37A:
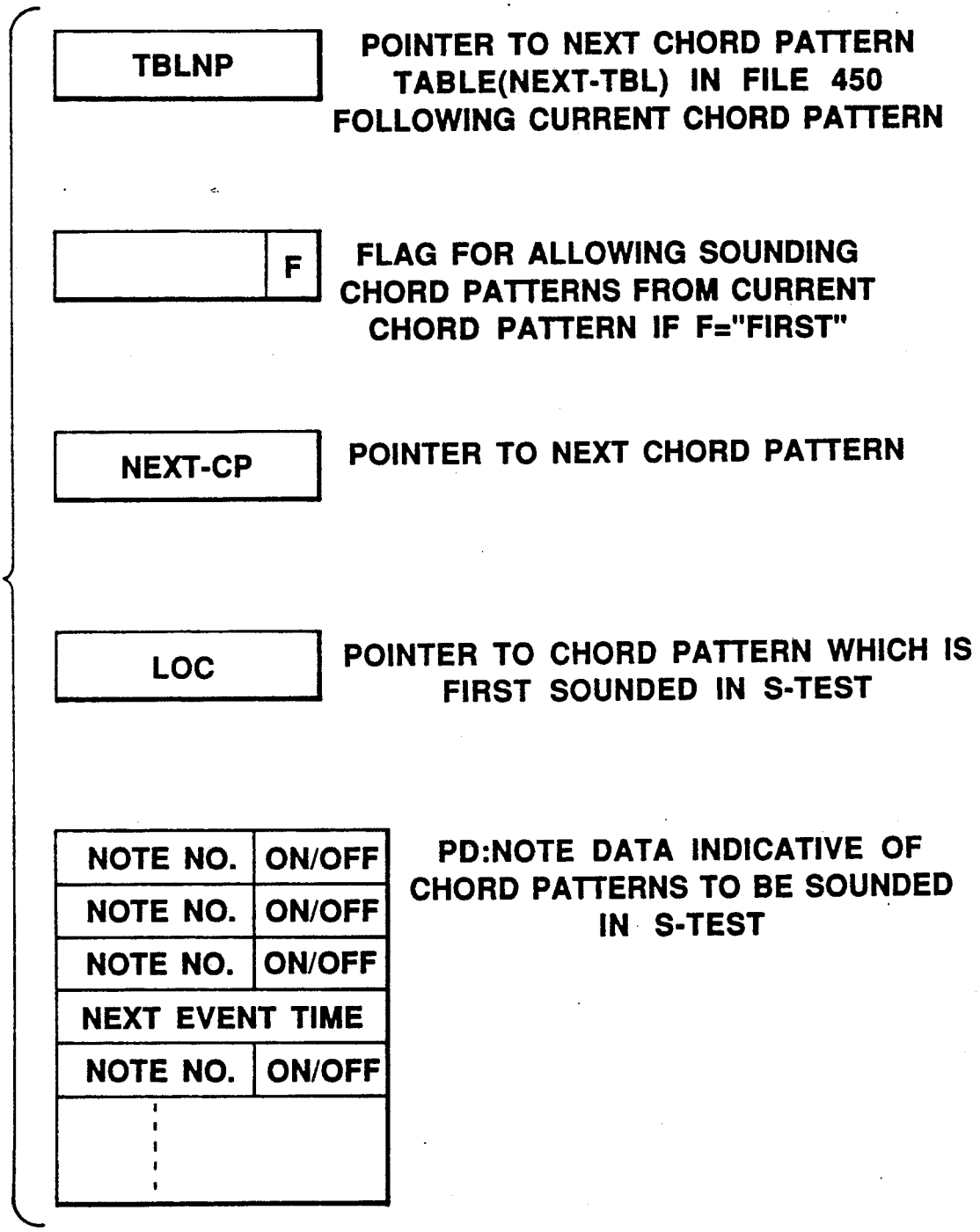
FIGS. 37A and 37B shows formats of several registers and memories involved in the flow of FIG. 36.
Figure 37B:
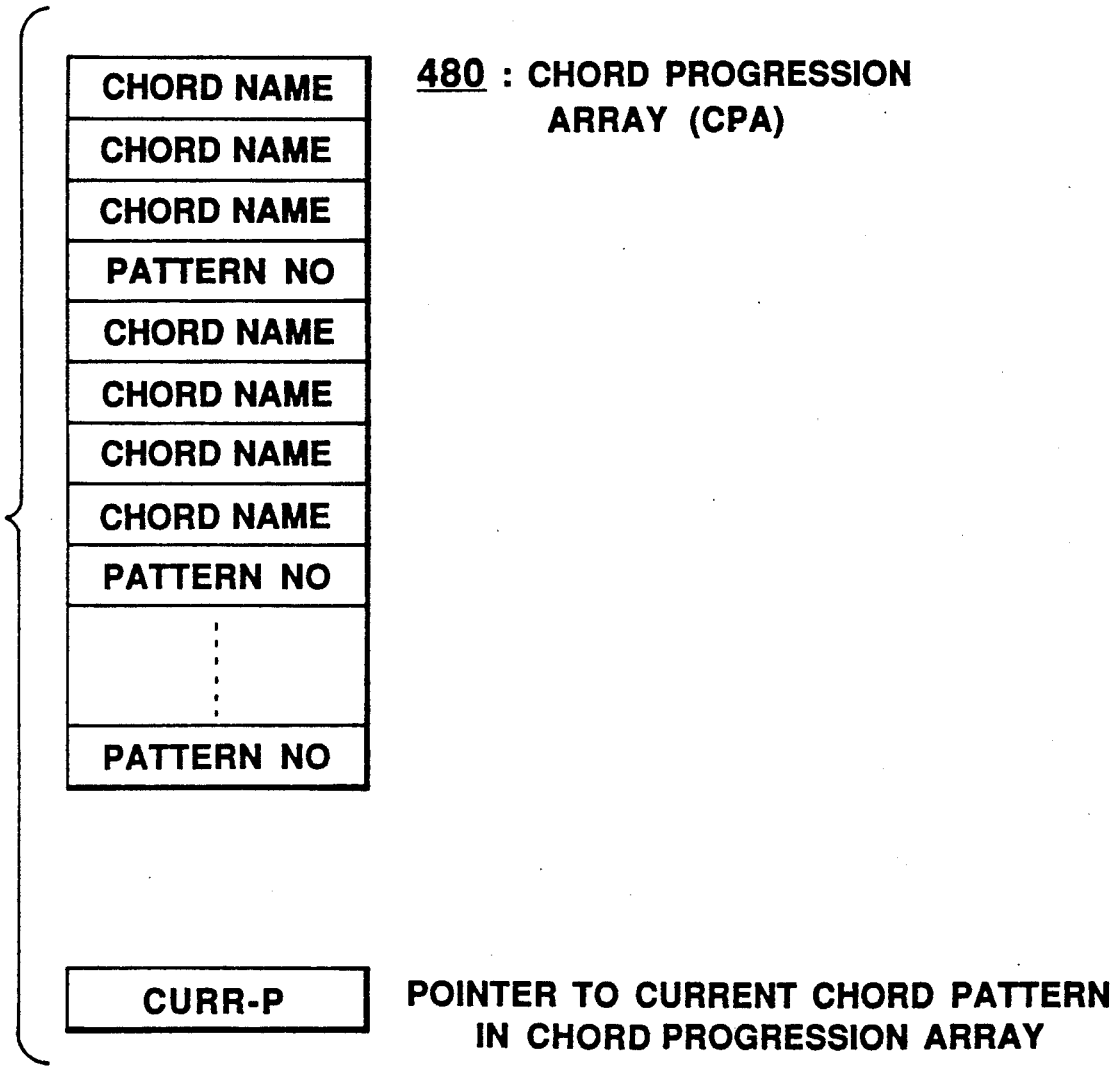

FIGS. 37A and 37B show such registers and memories. TBLNP register is a pointer to the next chord pattern candidate table NEXT-TBL in the file 450. F flag, which carries a single bit of information, is referenced in the sound-test block 36-5. F has a logic "1" or "first" when the sound-test block 36-5 is performed just after the selection of a chord pattern NEXT-CP in block 36-4. F has a logic "0" or "not first" when the block 36-5 is performed in a return path from the block 36-7. With F="first", the block 36-5 plays a chord performance from the current chord pattern while with F="not first" it plays a chord performance from the location LOC designated by the user in block 36-6. A register NEXT-CP is a pointer to a next chord pattern selected from next chord pattern candidate table NEXT-TBL. More specifically, NEXT-CP pointer locates an address in the chord pattern file 440 where the first chord data of the next chord pattern is placed (see FIG. 35). LOC register is a pointer to a chord pattern which is first played in the sound-test block 36-5.

A memory PD stores data of the chord performance which is created and played in the sound-test block 36-5. The data PD comprises note numbers each indicative of a pitch or pitch class of a chord tone. Associated with each note number is an ON/OFF bit which indicates either a note-on or note-off event of a tone of a pitch specified by the associated note number. Data of NEXT EVENT TIME are inserted between groups of event data (i.e., note numbers with ON/OFF bits) and each indicates an event-to-event time i.e., a time left for the next events to occur. In FIG. 37A, each NEXT EVENT TIME data location precedes the next event data locations.

All registers and memories shown in FIG. 37A as well a. CURR-P register in FIG. 37B are provided in the work memory 430 in FIG. 34.

The data structure of the chord progression array (CPA) or memory 480 is shown in FIG. 37B. CPA is produced in the flowchart of FIG. 36 as stated. CPA data comprises a concatenation of chord patterns in which each chord is specified by a root and a type. To facilitate the play of the chord performance from any particular chord pattern, each chord pattern in CPA is numbered by data of PATTERN NO placed after the associated chord pattern. CURR-P register is a pointer to the current or last chord pattern in CPA.

Figure 38:
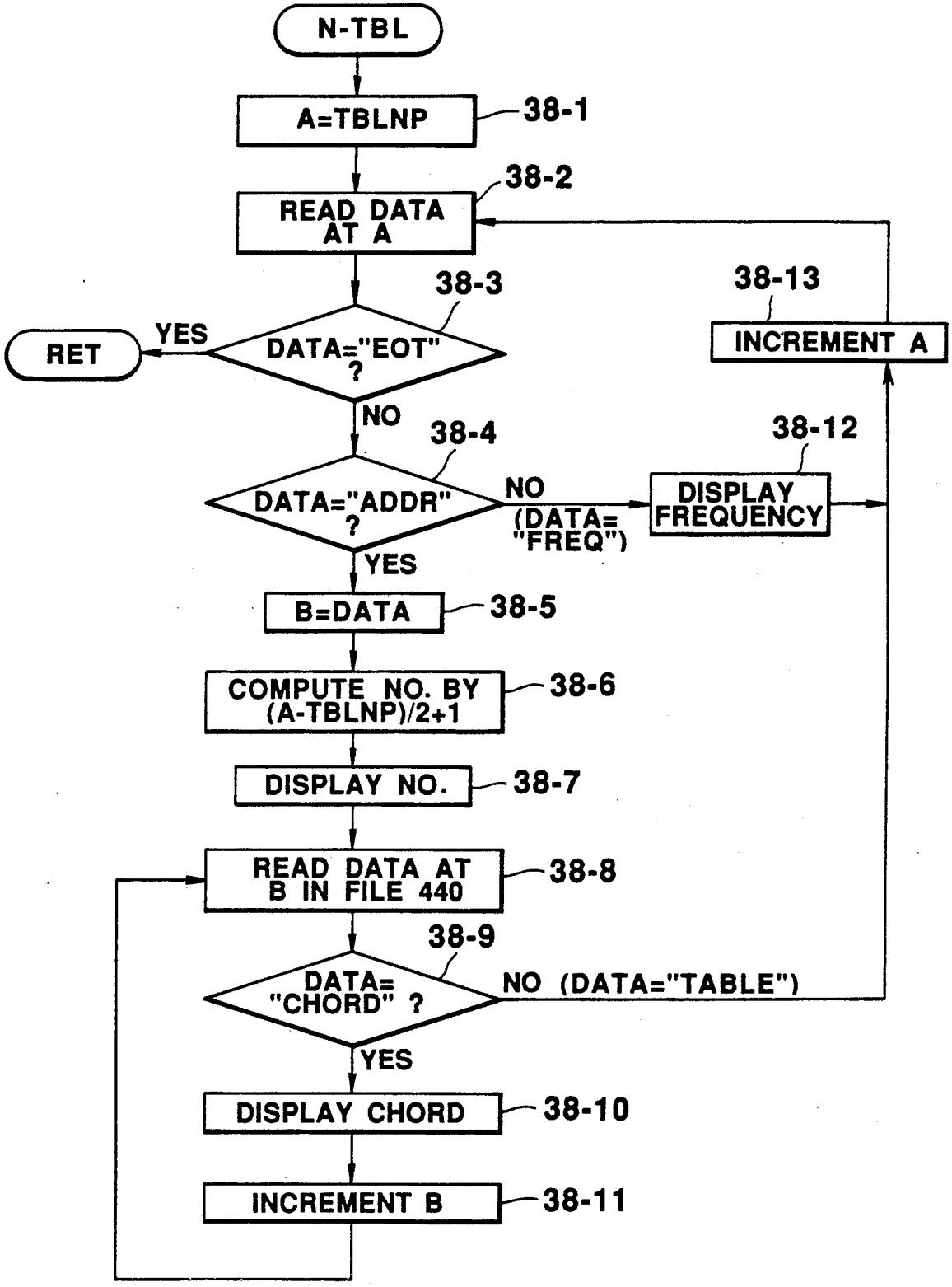
FIG. 38 is a detailed flowchart of the block 36-3 in FIG. 36 for retrieving and displaying a next chord pattern table.

FIG. 38 shows details of the block 36-3 in FIG. 36 for retrieving and displaying the next chord pattern candidate table NEXT-TBL. The flowchart of FIG. 38 is arranged to retrieve a table of next chord pattern candidates pointed to by TBLNP pointer and display on the display unit 470 the table information as a list of next chord pattern candidates so that respective next chord pattern candidate are numbered according to frequencies in the table NEXT-TBL.

More specifically, A register is initialized to TBLNP (38-1). Data at A in the table of NEXT-TBL (e.g., TABLE#1 in FIG. 35) is read out (38-2) and checked as to data type (38-3, 38-4). If the data is found to be "ADDR" pointer to the next chord pattern data stored in the file 440, B register is set to the pointer value (38-5). Block 38-6 calculates, with respect to the next chord pattern pointed to by B pointer, a number by (A-TBLNP)/2+1, and block 38-7 displays the computed number on the display unit 470. The number indicates a rank of the frequency of the next chord pattern; for example, a next chord pattern with the highest frequency in the table NEXT-TBL is given NO. 1, a next chord pattern with the second highest frequency is given NO. 2 and so on. The block 38-8 reads data in the file 440 at the address designated by B pointer. If the read data is a chord (38-9), that chord is displayed in terms of a chord name (e.g., G7, Dm) in block 38-10. Then, B pointer is incremented (38-11) and the process of reading data at B pointer and displaying a chord (38-8 to 38-11) continues until the block 38-9 encounters a TABLE pointer to the file 450 (see FIG. 35). At this point, the display unit 470 has presented on its screen a series of chord names indicative of a next chord pattern candidate, headed by a number. Then, block 38-13 increments A pointer in the NEXT-TBL and the program goes back to the block 38-2.

If the block 38-4 finds that the data in NEXT-TBL at A pointer indicates a frequency, the block 38-12 displays that frequency near the associated chord pattern presented on the display unit 470, and the program goes to block 38-13 for incrementing A pointer.

If the block 38-3 finds that the data in NEXT-TBL at A pointer is EOT indicative of end of the table NEXT-TBL(see FIG. 35), the program exits from the flowchart of FIG. 38. At this point, a list of next chord pattern candidates with frequencies has been presented on the display screen.

Figure 39:
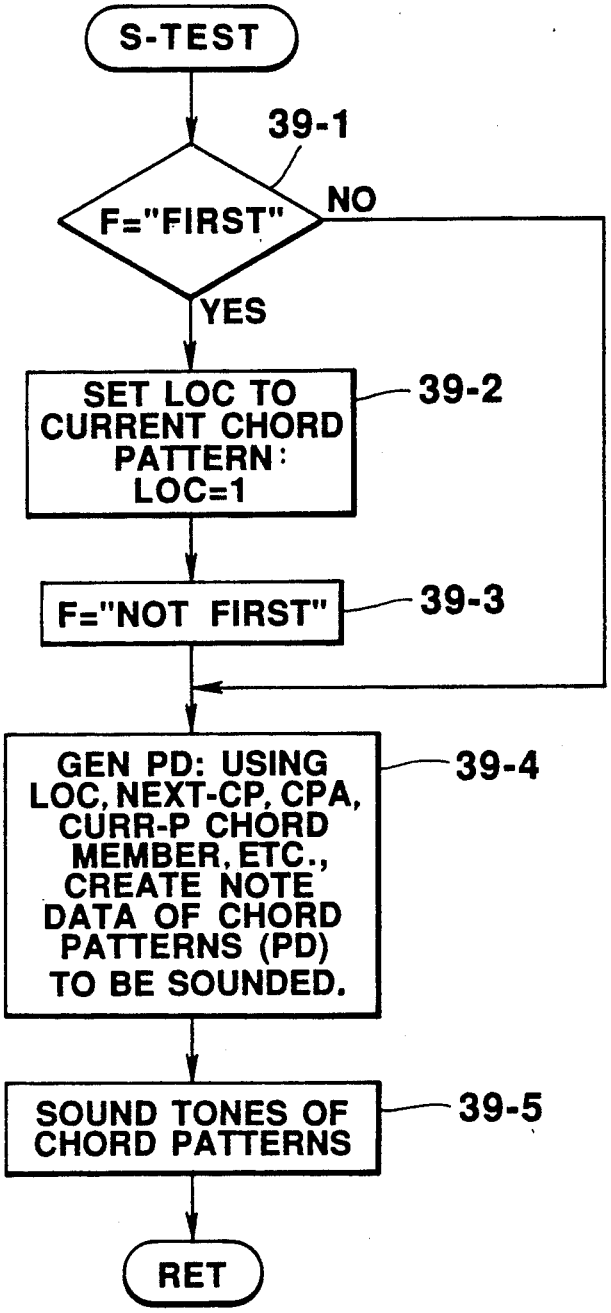
FIG. 39 is a flowchart of the block 36-5 in FIG. 36 for sound-test of a selected chord pattern.
Figure 40:
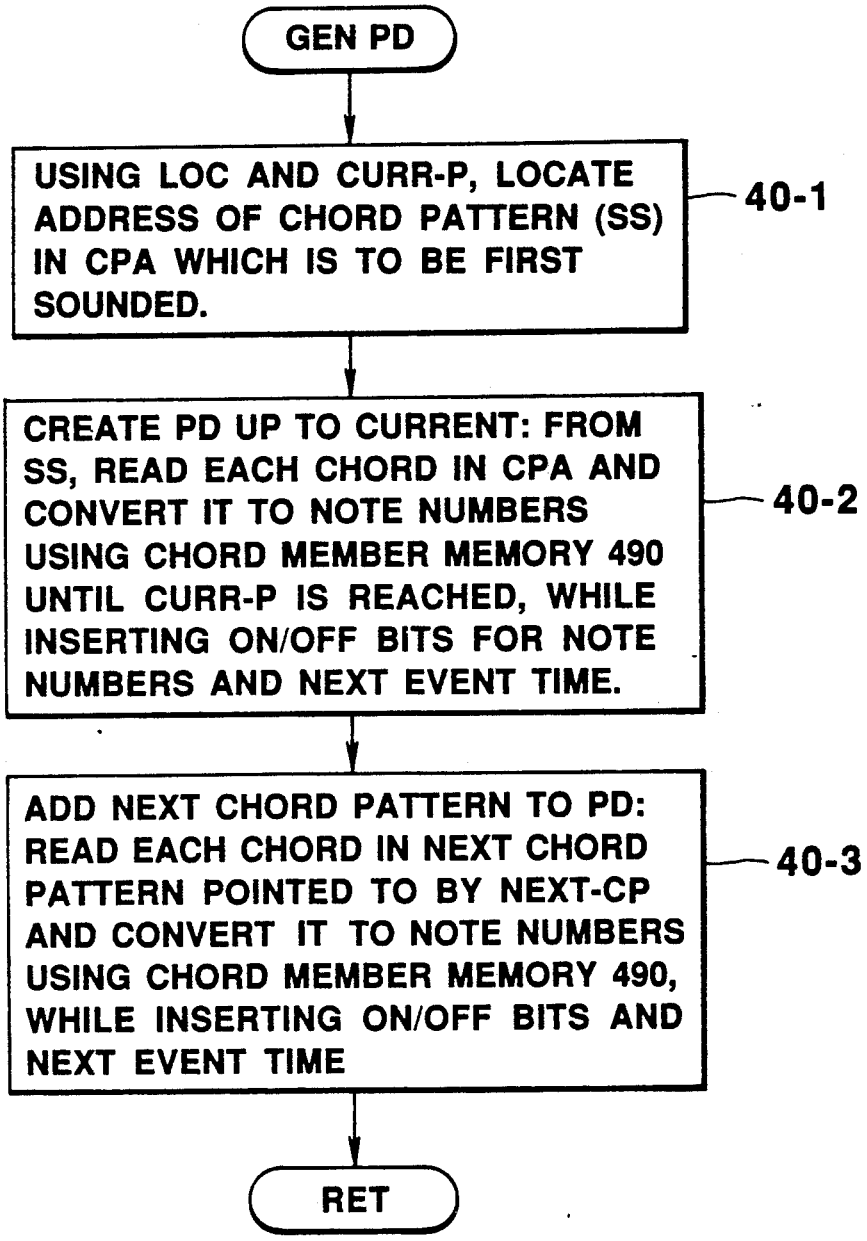
FIG. 40 is a flowchart of the block 39-4 in FIG. 39.

FIG. 39 shows details of the sound-test block 36-5 in the general flowchart of FIG. 36. Block 39-1 checks as to whether F flag indicates "first". This holds when the sound test block 36-5 plays a chord performance in the first path directly after the selection of a next chord pattern in block 36-4. If this is the case, block 39-2 sets LOC to a value of "1" or "current" which indicates that the chord performance is to start from the current chord pattern. Then block 39-3 changes F flag to "not first" so that in a return path from the block 36-7, the sound-test block 36-5 will start a chord performance from a position LOC designated by the user in block 36-6 and perhaps different from the position of the current chord pattern. Block 39-4 is to create chord performance data PD such as shown in FIG. 37A, by using contents of LOC, NEXT-CP, CPA, CURR-P, chord member memory 490, etc. This is illustrated in more detail in FIG. 40

Figure 41:
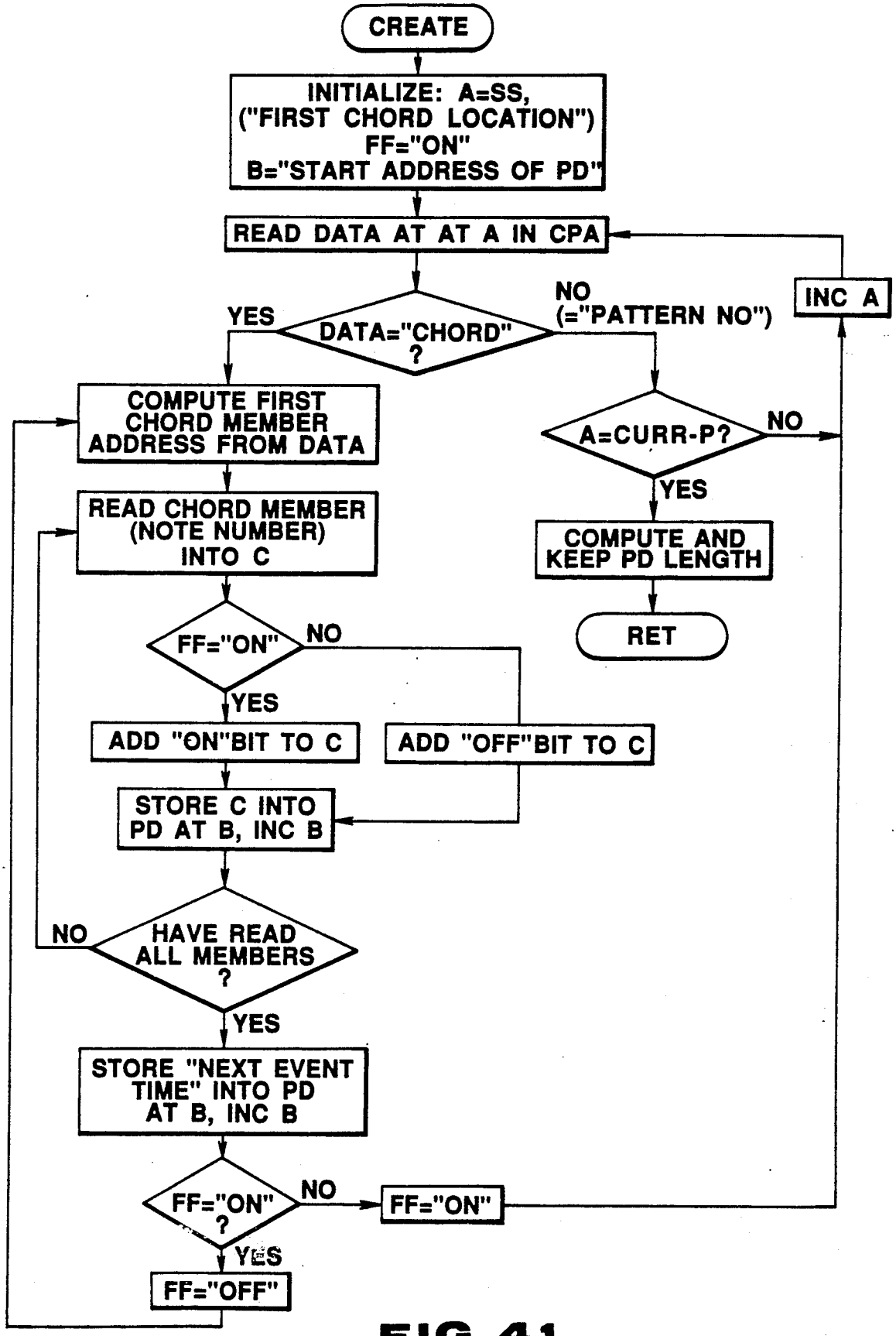
FIG. 41 is a detailed flowchart of the block 40-2 in FIG. 40.

Using LOC and CURR-P, block 40-1 searches for a chord pattern in CPA (see FIG. 37B) which is to be first sounded: For example, (LOC-1) is subtracted from the current chord pattern number at CURR-P. The resultant number is a chord pattern number assigned to the chord pattern to be first sounded. Search is made for a location in CPA where the computed chord pattern number is stored. The required chord pattern data are stored in consecutive locations between (the computed pattern number-1) and the computed pattern number locations. The next block 40-2 creates chord performance data PD up to the current chord pattern. This may be accomplished as follows. Assume that A pointer has been set (by block 40-1) to an address in CPA where is stored data of a first chord that is to be sounded first. Those chord data placed in CPA between the first chord location (initial setting of A pointer) and the last chord location (specified by CURR-P) are converted into note numbers by referencing the chord member memory 490. After the convertion, ON and OFF bits are added to each of the converted note numbers to define note-on and note-off events, and next event time data are inserted therebetween so as to form chord performance data PD (see FIG. 37A) up to the current chord pattern. A detailed flow of the block 40-2 is illustrated in FIG. 41 in a self-explanatory manner. The chord performance data PD is further extended in block 40-3 so as to include those performance data with respect to the next chord pattern NEXT-CP selected from NEXT-TBL. The data format of PD shown in FIG. 37A is a mere example. A person skilled in the art may adopt any other conventional format for the performance data.

Turning back to FIG. 39, block 39-5 sounds tones according to the chord performance data produced in the block 39-4. The block 39-5 involves the process of decoding PD and sending the decoded data to the tone generator 510 for generation of associated tones. Such process is well known in the art of electronic musical instruments with automatic music performing capabilities (as in U.S. Pat. Nos. 4,344,345, 4,129,055), so further description will be omitted.

The function of the sound-test block 36-5 makes it easy for the user to judge whether the selected chord pattern NEXT-CP is best suited for connection to the current chord pattern.

Figure 42:
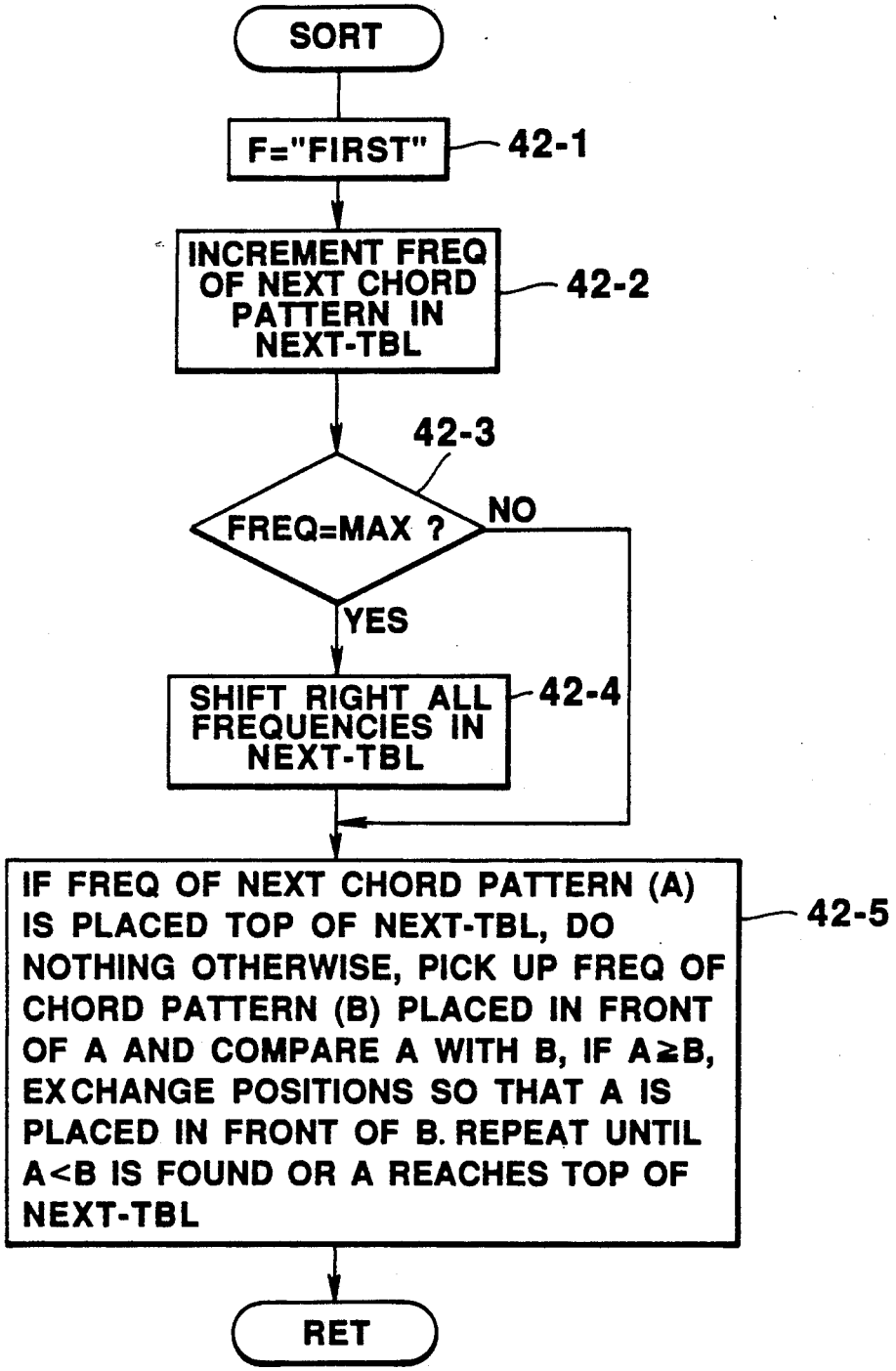
FIG. 42 is a flowchart of the block 36-8 in FIG. 36 for sorting a next chord pattern table.

FIG. 42 shows details of the block 36-8 in FIG. 36 for sorting a next chord pattern candidate table NEXT-TBL. Block 42-1 sets F flag to "first" for allowing the block 36-5 (FIG. 36) in the next path to start to play a chord performance from the current chord pattern. Block 42-2 increments the frequency data of the next chord pattern NEXT-CP in NEXT-TBL, because the NEXT-CP has just been determined by the user's judgement in block 36-6. Block 42-3 checks whether the incremented frequency has reached the maximum or largest value representable by the data format employed. If this is the case, block 42-4 shifts right all frequency data in NEXT-TBL, thus dividing all frequencies by two. If not, block 42-4 is skipped. Block 42-5 constitutes a body of sorting NEXT-TBL. The sorting may be done as follows: Assume that before enterring the block 36-8, all elements in the NEXT-TBL have been arranged in frequency decreasing order from the top to the bottom of NEXT-TBL. In the block 42-5, a top test is made to see whether the next chord pattern NEXT-CP with its frequency updated in block 42-2 is placed at the top of NEXT-TBL. If this is the case, do nothing. Otherwise, pick out the frequency data of a chord pattern placed in front of (immediately preceding) that of NEXT-CP. Compare the two frequencies, and if the frequency of NEXT-CP is less than the frequency of the immediately preceding chord pattern (ICP), do nothing. Otherwise, exchange the positions so that NEXT-CP is placed where the ICP was, and the ICP is placed where the NEXT-CP was. Repeat the above process until a stopping condition is met which is either the NEXT-CP having reached the top of NEXT-TBL or encountered a new ICP with a higher frequency than that of the NEXT-CP.

Figure 43:
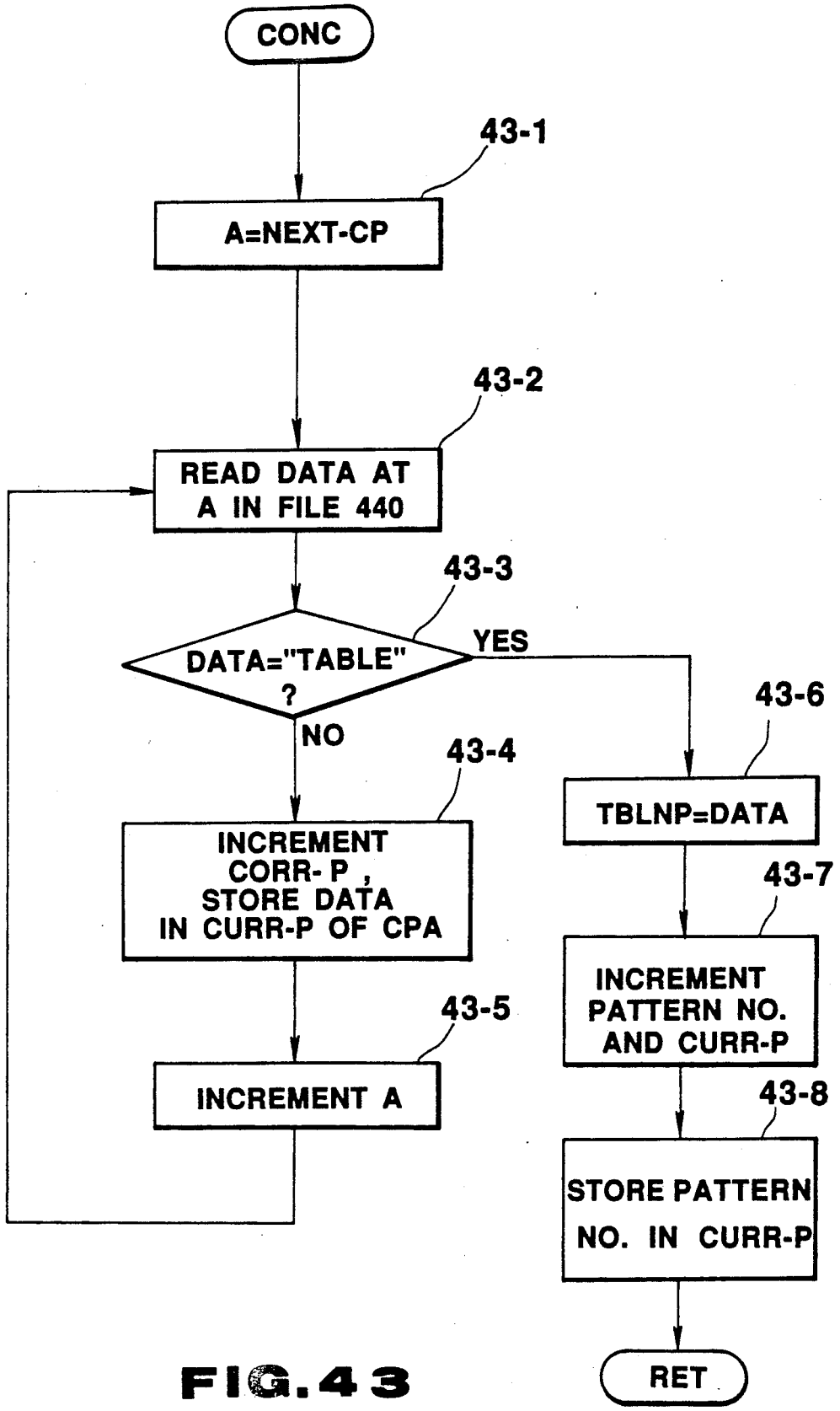
FIG. 43 is a detailed flowchart of the block 36-9 in FIG. 36 for concatenating a determined chord pattern into a chord progression array.

FIG. 43 illustrates details of the concatenation block 36-9 in FIG. 36. In the flowchart of FIG. 43, block 43-1 sets A register to the content of NEXT-CP pointer indicative of a location in the file 440 where the next chord pattern data begins. In blocks 43-2 to 43-5, the respective chord data of the next chord pattern in the file 440 are succesively copied onto the chord progression arrary CPA at CUUR-P pointer while incrementing A and CUUR-P pointers until a TABLE pointer is encountered on the file 440 (43-3). In this manner, the determined next chord pattern is concatenated into CPA as the last elements thereof.

At this point, the next chord pattern should be renamed the current chord pattern because it now forms the last chord pattern of CPA. The TABLE pointer encountered in block 43-3 does points to a next chord pattern table NEXT-TBL in the file 450, the information of which should be displayed in the next path of the general flowchart of FIG. 36 at block 36-2 for further development of a chord progression. In view of these points, block 43-6 stores the encountered TABLE pointer content into TBLNP pointer. Block 43-7 increments the chord pattern number and CURR-P pointer. Block 43-8 stores the incremented pattern number into CPA at the CURR-P pointer.

Figure 44:
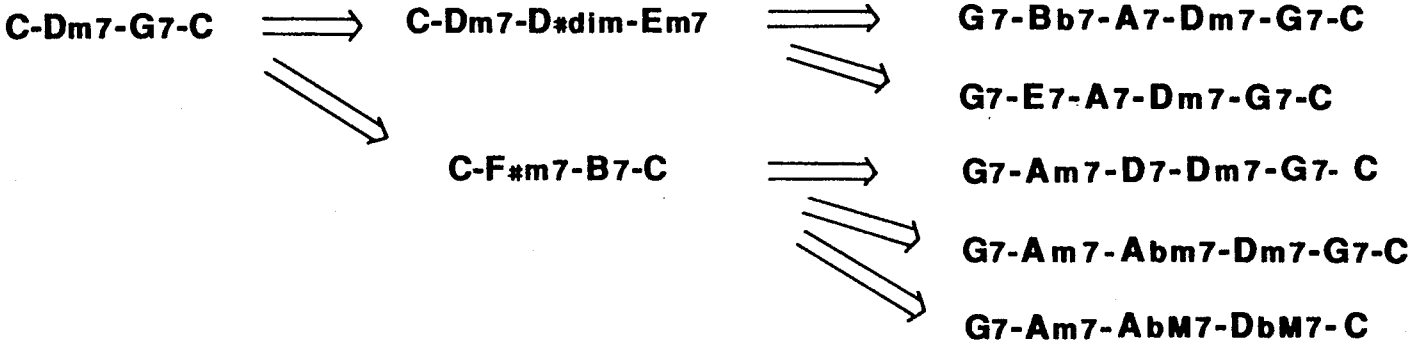
FIG. 44 shows a hierarchical network of chord patterns.
Figure 45:
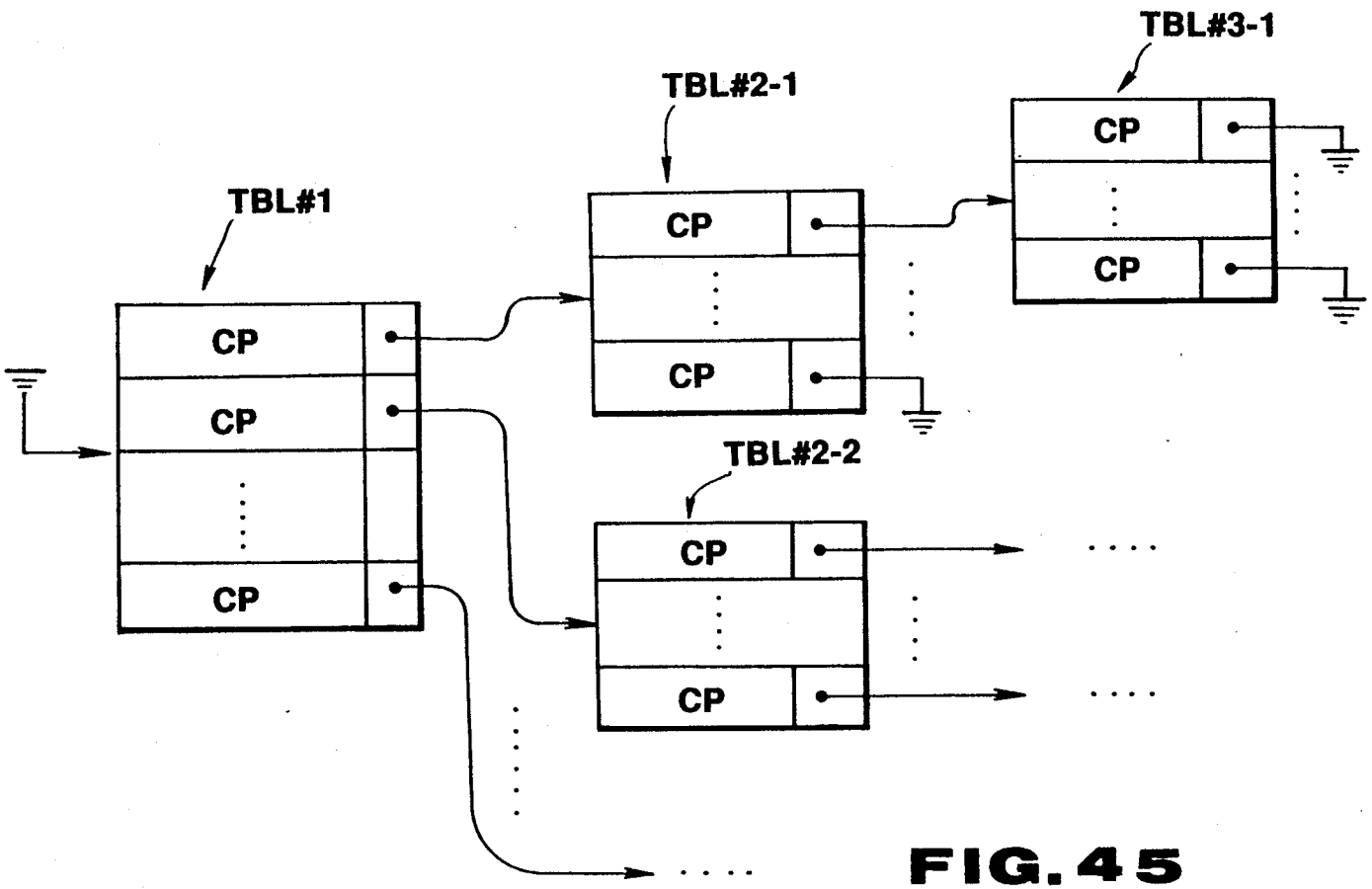
FIG. 45 schematically illustrates a chord pattern file organization implementing a hierarchical structure of chord patterns exemplified in FIG. 44.

FIG. 44 illustrates a tree structure of chord patterns in which the first chord pattern is given by C-$Dm_7$-$G_7$-C. Each arrow in FIG. 44 indicates a connection from one chord to another. For example, the chord pattern of C-$Dm_7$-$G_7$-C is shown followed by either C-$Dm_7$-D#dim-$Em_7$, or C-F#$m_7$-$B_7$-C. It is understood that each table pointer in the file 440 and the associated ADDR OF NCP in the file 450 constitute an arrow in FIG. 44. It should be noted, however, that a "logical" structure or connection of chord patterns such as shown in FIG. 44 may be implemented in several different ways. FIG. 45 schematically illustrates an implementation example. In FIG. 45, TBL#1 denotes a first chord pattern table in the form of a memory for storing a set of chord patterns each denoted by CP. Attached to CP is a pointer denoted by a dot mark pointing to a next chord pattern table. For example, TBL#1 is linked to TBL#2-1, TBL#2-2 etc. The table TBL#2-1 is then linked to TBL#3-1 etc. In this manner, the arrangement of FIG. 45 essentially constitutes a hierarchic data structure of chord patterns but not a pure one. There are shown some pointers of a dot mark connected to a ground-like symbol, the other side of which is connected to the first chord pattern table TBL#1. This indicates that these chord patterns with grounded dot marks can be followed by one of the chord patterns in the first table TBL#1. Thus, the arrangement of FIG.

45 includes return paths which provide an advantage in storage capacity savings over an arrangement without any return path. In addition, the grounded pointers may be used to indicate when a chord progression of a music piece comes to an end, assuming that each chord pattern with a grounded pointer (actually the data pointing to TBL#1) contains a harmonic cadence or closing formula. For example, after concatenating such a chord pattern with the chord progression array, the system may tell the user a message such as: "The system sees that the chord progression may be ended at this time. Do you agree?" In response to the message, the user provides the system with either NG answer requiring further development of the chord progression of OK answer confirming the termination. If should also be noted that the sound-test block 36-5 described in conjunction with FIGS. 37A, 37B, 39-41 is by way of example only. In some circumstances, it may be desirable to play a chord performance with rythms (having variable chord tone durations) suited for a music piece intended.

Figure 46:
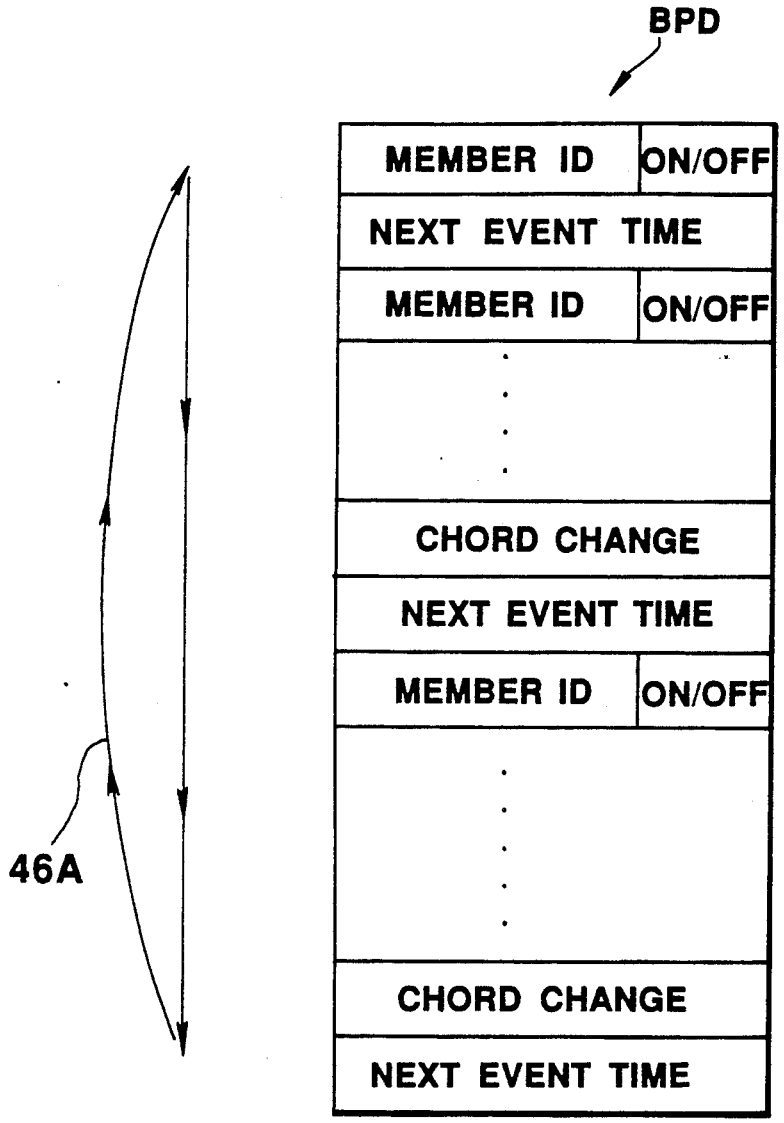
FIG. 46 shows a structure of basic chord performance data (BPD)
Figure 47A:
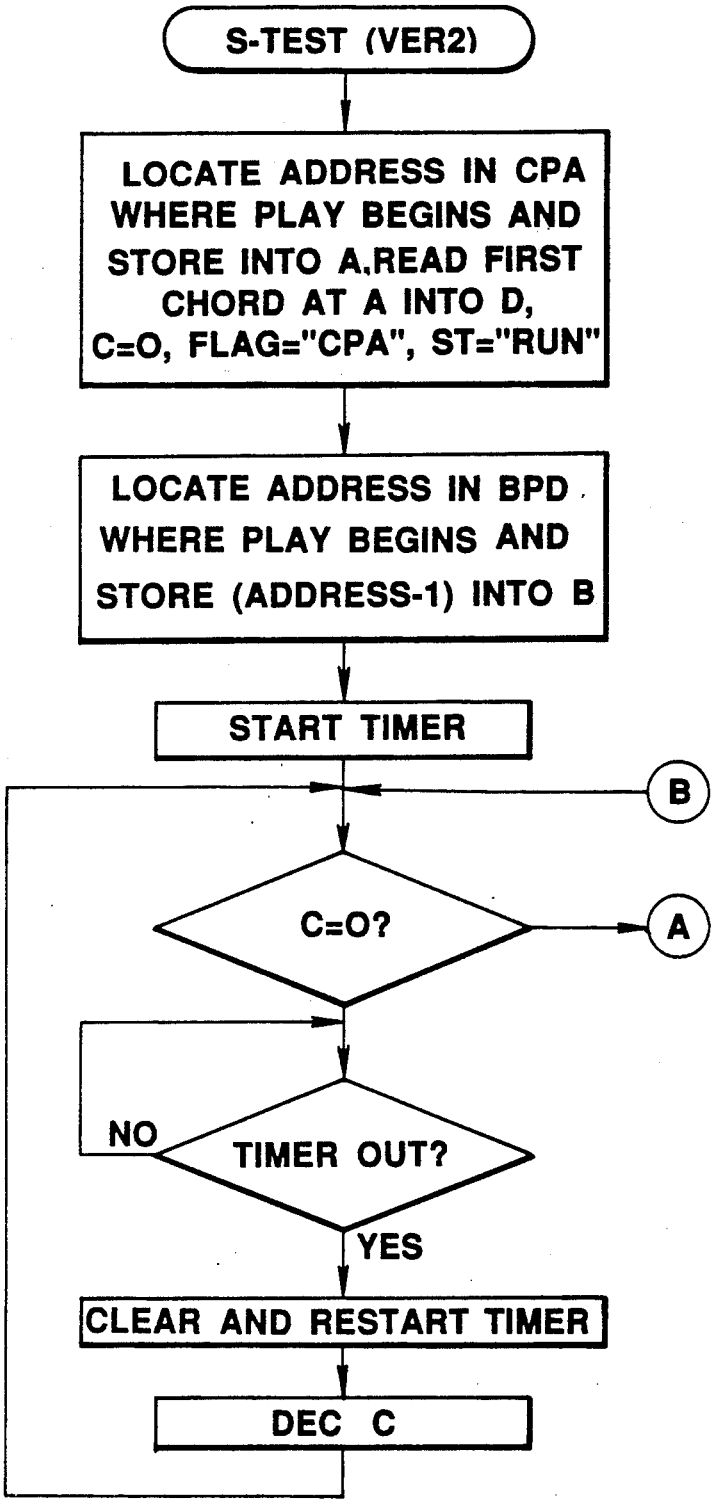
FIGS. 47A, 47B and 47C are modified flowcharts of the blocks 39-4 and 39-5 in FIG. 39 for playing a chord performance using BPD in FIG. 46 for sound-test of a selected chord pattern.
Figure 47B:
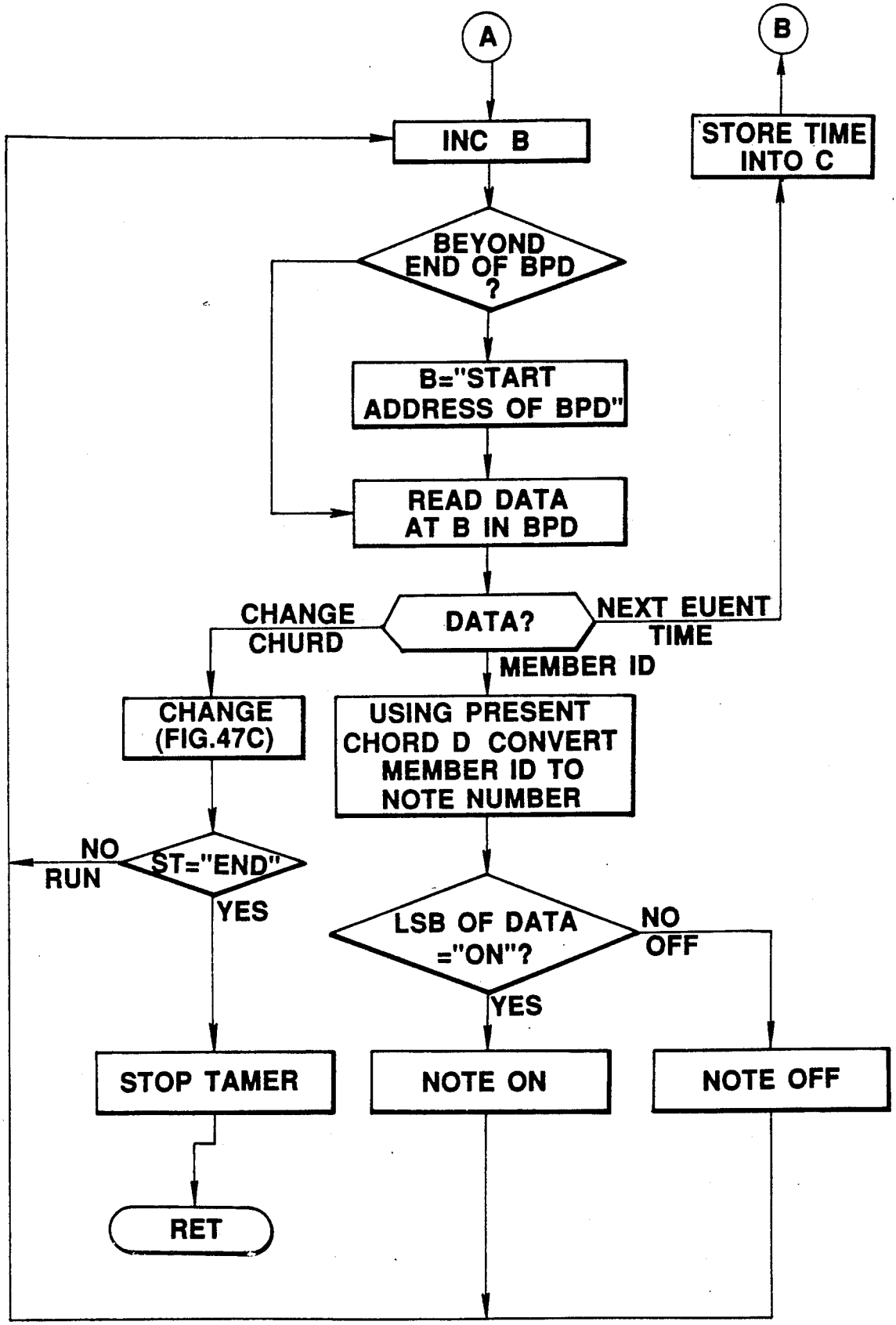
Figure 47C:
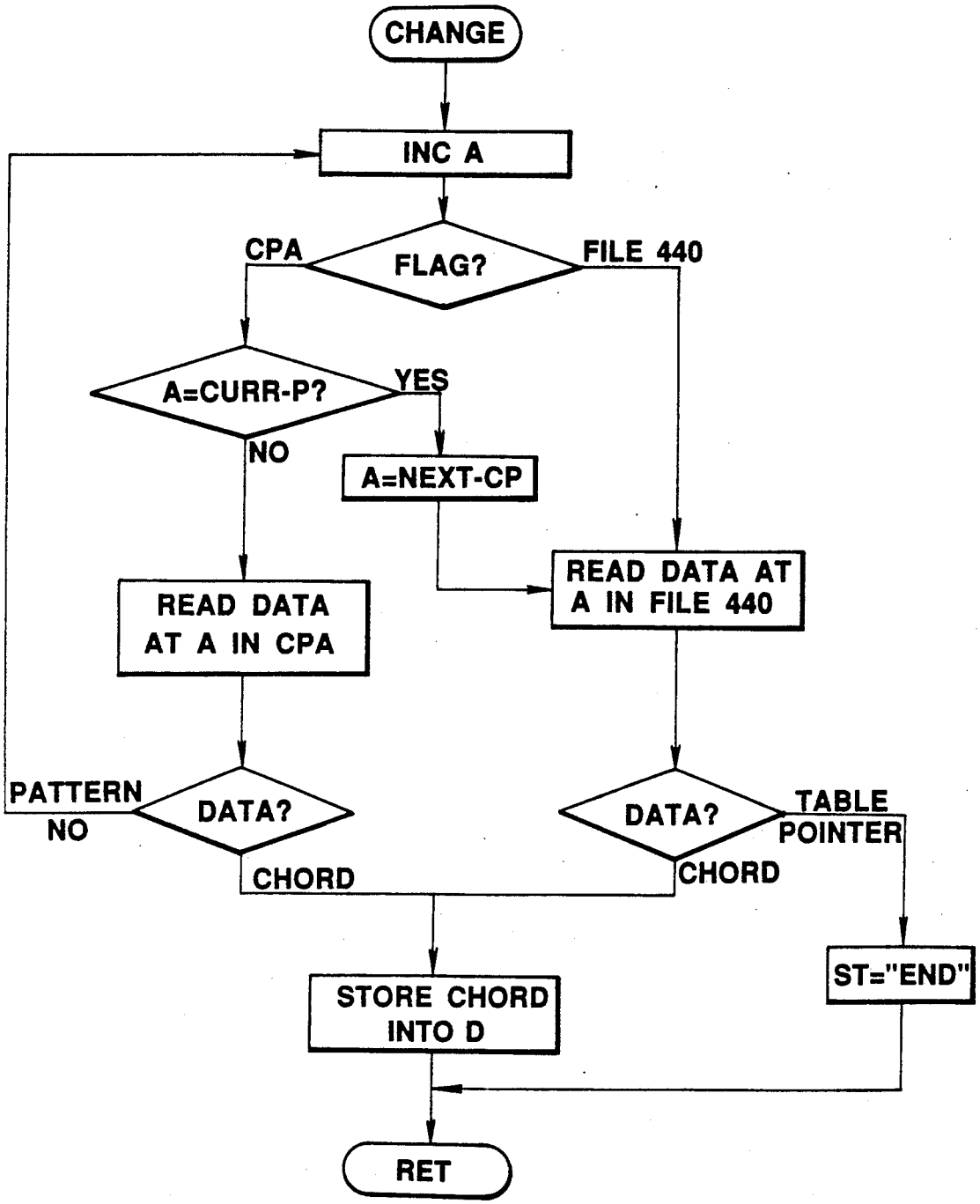

FIG. 46 illustrates basic chord performance data BPD which may be selected from a set of BPDs before or during the process of producing a chord progression. BPD serves as a basis for the chord performance data such as PD shown in FIG. 37A. To transform BPD format to PD, each MEMBER ID contained in BPD, which identifies a particular chord member (e.g., "1" for the lowest chord member, "2" for the second lowest chord member and so on), is converted by a modified sound-test block to specific pitch data or note number by referencing the chord member memory 490, obtaining note numbers of a chord (which is specified in a manner discribed below), and selecting a note number of a chord member identified by the MEMBER ID of interest. Since PD size can be longer than BPD size, the sound-test block may cyclically read out BPD pattern as shown by an arrowed loop 46A for continuation of playing a chord performance. Each CHORD CHANGE data in BPD indicates a timing of changing a chord. Each time the sound-test block encounters a CHORD CHANGE on BPD memory, it selects a next chord from CPA (including NEXT-CP) for sound-test. The selected chord is then used to convert MEMBER ID to a note number until a CHORD CHANGE is encountered again. Each time the sound-test block visits NEXT EVENT TIME on BPD, it waits until the time designated thereby has elapsed. Then, the associated events are executed by converting each associated MEMBER ID to a note number and transferring a note-on/off command including the note number to the tone generator 510. Detailed flowcharts of the sound-test process discussed above are illustrated in FIGS. 47A to 47C in a self-explanatory manner.

Other Modifications

While preferred embodiments of the invention have been described in the foregoing, various changes and modifications thereof are obvious to a person having ordinary skill in the art without departing from the scope of the invention.

For example, while in the above embodiment selection of multi-leveled musical structure data is done in the order from higher to lower hierarchic levels, it may be arranged to provide any order of selecting the data if desired. Supposing that a phrase-starting and ending function of each phrase has been selected, then a group or groups in the file f2 or f3 (3B) can be readily specified which contain the selected phrase-starting and ending function. For example, if the selected starting function data are found in data(f2,g,n,dn) for dn=1 to dnmax(f2,g,n), the value of the g indicates an intended group. This group number may be used to compute a corresponding location or locations in the phrase structure file f1 (3A) where the immediately higher leveled structure data reside. In the alternative, for each of the phrase-starting and ending function data in the file f2, f3 there may be provided a pointer to such a corresponding location in the phrase structure file f1.

Data in the corresponding location constitutes a phrase structure linked to the selected phrase-starting and ending function. In the case where the selected phrase-starting and ending function data reside in a plurality of different subfiles or groups in the phrase starting/ending function data file, there are a corresponding number of phrase structures in the phrase structure file. In this case, one of these phrase structure candidates may be selected either automatically or manually.

A system of storing or accumulating musical structures on files or database such as exemplified in FIG. 2 of the embodiment has an advantage in that it can successfully represents knowledge of musical structures in various pieces of music. This will give musical guarantee for any choice of musical structures from these files (e.g., musical form, phrase structure and phrase starting and ending functions) to reflect characteristics of a music piece. However, computation means such as rule-based inference system could be employed instead to generate or select featuring structures of respective hierarchic levels. For example, when a musical form is given, such means creates a plurality of phrase structures according to generative rules or algorithms of phrase structures associated with the given musical form and selects one of these phrase structures according to a random number. Computation means may also be used to generate or compute a plurality of chord patterns from a functional chord pattern and select one of these chord patterns.

If there is no automatic mechanism of generating structures of music, the user may directly and specifically designate a phrase structure and phrase-starting and ending functions from an input unit.

In addition to the phrase structure file and phrase starting/ending function file noted above, the file memory 3 may further comprise larger structure (e.g., movement structure) files for a long piece of music. Further, a file of data representing other characteristics of phrase may be provided to use such characteristic data to restrict a group of functional chord patterns in the functional chord pattern data file 3D, or limit a set of specific chord patterns in the chord pattern file 3D so that the restricted set or group is available for a chord progression intended. For example, there may be provided a file of data representing a prevailing tonality of each predetermined segment or block of music which may or may not span the same duration with a phrase in phrase structure. In the course of producing a chord progression of a music piece, when the process moves to a new segment, a corresponding prevailing tonality is retrieved from the tonality structure file. Thereafter, chord pattern control proceeds such that when and only when a functional chord pattern from a functional chord pattern bears a compatible relationship with the prevailing or current tonality (for instance, a major functional chord pattern in the case of the major tonality and a minor functional chord pattern in the case of minor tonality), such a pattern may be adopted as available chord pattern. Further, the keynote data of the current tonality data may be utilized to convert functional chord pattern data to specific chord pattern data.

Further, repetition of phrase chord progression in the chord progression generation may be effected under a simplified condition that the phrase structure data contain a prior phrase of the same type as the phrase in question without requiring identical phrase-starting and ending functions in these phrases.

Oppositely, a duration or length requirement of phrase (for instance, number of chords) may be added to the condition for updating a phrase. For example, there may be provided a storage which stores duational range data for controlling a phrase duration. According to one scheme, each phrase chord progression must last for a period of musical time or a number of chords indicated by the control range data before transition to the next phrase occurs.

Further, it is possible to first determine a chord progression for those portions which the user thinks or feels important or impressive before handling the remaining chord progression. Of course, an editing function can be readily implemented which provides partial correction of a chord progression of music after the generation.

Therefore, the scope of the invention should be defined solely by the appended claims.

| LIST.DT FILE |
|---|
| 1 filel.dt |
| 2 scon.dt |
| 3 econ.dt |
| 4 function.dt |
| 5 caden.dt |
| 6 mcaden.dt |
| 7 rhymfile.dt |

| FORM | STRUCTURE | START | END |
|---|---|---|---|
| | HIE-STRUCTURE (part 1) | | |
| one-part | A—A—A—A | T—T—T—T | T—T—T—T |
| two-part | 1. A—A'—A'—A'' | 1. T—D—T—T | 1. D—D—S—T |
| | 2. A—B—A—B | 2.1 T—T—T—T | 2.1 D—D—D—D |
| | | 2.2 T—D—T—D | 2.2 S—T—S—T |
| | 3. A—B—A'—B' | 3. T—T—T—T | 3. D—T—D—T |
| | 4. A—A—B—B | 4. T—T—T—T | 4. T—T—T—T |
| | 5. A—A'—B—B' | 5. T—T—T—T | 5. S—T—T—D |
| | 6. A—A—B—A | 6. T—T—T—T | 6. T—T—T—T |
| | 7. A—A'—A—A'—B—B—A—A' | 7.1 T—S—T—S—T—T—T—S | 7.1 T—T—T—T—D—D—D—T—D |
| | 8. A—B—A—B—C—A—B | 7.2 T—D—T—D—S—T—T—D | 7.2 S—T—S—T—T—D—S—T |
| | | 8.1 T—T—T—T—S—T—T | 8.1 T—T—T—T—D—T—T |
| | | 8.2 T—T—T—T—T—T—T | 8.2 S—D—S—D—D—S—D |
| | 9. A—B—A—B—C—C'—A—B | 9. T—T—T—T—T—T—T—T—T | 9. D—T—D—T—T—D—D—D |
| | 10. A—A'—A''—B—A—A'—A''—B | 10. T—D—T—T—T—D—T—T—D—T—D—T | 10. T—T—T—T—T—T—T—T—S—S—T—T—T |

-continued

| FORM | STRUCTURE | START | END |
|---|---|---|---|
| | C—C'—A—A''—A''—B | T | T |
| | HIE-STRUCTURE (part 2) | | |
| two-part | 11. A—A'—A—A'—B—B'—A—A' | 11. T—T—T—T—S—T—T—T | 11. D—T—D—T—S—D—D—T |
| | 12. A—A—A—A—B—A—A | 12. T—D—T—D—T—T—D | 12. S—T—S—T—D—S—T |
| | 13. A—A'—B—A | 13.1 S—T—S—S | 13.1 D—T—T—D |
| | | 13.2 T—T—S—D | 13.2 D—T—D—T |
| | | 13.3 D—D—S—D— | 13.3 T—T—S—T |
| | 14. A—A'—B—A'' | 14.1 T—T—S—T | 14.1 D—D—D—T |
| | | 14.2 T—T—D—S— | 14.2 T—T—T—T |
| | | 14.3 T—D—T—D | 14.3 T—S—S—T |
| | | 14.4 T—T—D—T | 14.4 T—T—T—T |
| | 15. A—A'—B—A' | 15.1 T—T—S—T | 15.1 T—T—D—T |
| | | 15.2 T—T—S—m—T | 15.2 T—T—D—T— |
| | 16. A—B—C—A | 16.1 T—S—D—T | 16.1 T—T—D—T |
| | | 16.2 T—T—T—T | 16.2 T—T—D—T |
| | 17. A—B—A—B' | 17.1 T—T—T—S | 17.1 T—T—T—T |
| | | 17.2 T—T—T—T | 17.2 D—T—D—T |
| | HIE-STRUCTURE (part 3) | | |
| three-part | 1. A—B—C | 1. T—S—T | 1. T—D—T |
| | 2. A—A'—A''—A'''—B—B'—B'—A—A'—A'''—A'''' | 2. T—D—T—D—T—T—D—T—D—T | 2. D—T—D—T—T—S—D—D—T—D—T |
| | | 3.1 T—S—T—S—D—T | 3.1 T—D—S—T—T—T |
| | 3. A—A—B—B'—A—A | 3.2 T—T—T—T—T—T | 3.2 T—T—D—D—T—T |
| | 4. A—B—C—D—C—D'—A—B—C—D | 4. T—S—T—S—T—S—T—S—T | 4. T—T—T—T—T—D—T—T—T—T |
| | 5. A—A'—A''—B'—B'—A—A'—A'' | 5.1 T—T—D—D—D—T—T—D | 5.1 D—D—D—S—D—D—D—D |
| | | 5.2 D—D—T—T—D—D—D—T | 5.2 T—T—T—S—S—T—T—T |
| | 6. A—B—C—D—A—B | 6. T—T—T—T—T—T | 6. D—T—D—T—D—T |
| | 7. A—A'—B—B'—A—A' | 7. T—T—T—T—T—T | 7. T—T—D—T—T—T |
| | 8. A—A'—B—A—A' | 8. T—T—S—T—T | 8. D—T—D—D—T |

| function.dt |
|---|
| 1 NO.1(major) |
| 2 T D T |
| 3 T S T |
| 4 T Sm T |
| 5 T S Sm T |
| 6 T S D T |
| 7 T Sm D T |
| 8 T S Sm D T |
| 9 NO.2(minor) |
| 10 T D T |
| 11 T S T |
| 12 T S D T |

caden.dt (part 1)

-continued

NO.1

0 507 0
0 501 0
0 60b 0
0 307 0
0 208 0

NO.2

0 5 0
0 505 0
0 602 0
0 50b 0
0 606 0

NO.3

0 105 0
0 602 0
0 50a 0
0 508 0
0 908 0
0 901 0

NO.4

0 5 105 0
0 5 602 0
0 5 50a 0
0 5 508 0
0 5 908 0
0 5 901 0
0 505 105 0
0 505 602 0
0 505 50a 0
0 505 508 0
0 505 908 0
0 505 901 0
0 602 105 0
0 602 602 0
0 602 50a 0
0 602 508 0
0 602 908 0
0 602 901 0 caden.dt (part 2)

0 50b 105 0
0 50b 602 0
0 50b 50a 0
0 50b 508 0
0 50b 908 0
0 50b 901 0
0 606 105 0
0 606 602 0
0 606 50a 0
0 606 508 0
0 606 908 0
0 606 901 0

NO.5

0 5 507 0
0 5 1 0
0 5 60b 0
0 5 307 0
0 5 208 0
0 505 507 0
0 505 1 0
0 505 60b 0
0 505 307 0
0 505 208 0
0 602 507 0
0 602 1 0
0 602 60b 0
0 602 307 0
0 602 208 0
0 50b 507 0
0 50b 1 0
0 50b 60b 0
0 50b 307 0
0 50b 208 0
0 606 507 0
0 606 1 0
0 606 60b 0
0 606 307 0
0 606 208 0 caden.dt (part 3)

NO.6

0 105 507 0
0 602 507 0
0 50a 507 0
0 508 507 0
0 908 507 0
0 901 507 0
0 105 501 0
0 602 501 0
0 50a 501 0
0 508 501 0
0 908 501 0
0 901 501 0
0 105 60b 0
0 602 60b 0
0 50a 60b 0
0 508 60b 0
0 908 60b 0
0 901 60b 0
0 105 307 0
0 602 307 0
0 50a 307 0
0 508 307 0
0 908 307 0
0 901 307 0
0 105 208 0
0 602 208 0
0 50a 208 0
0 508 208 0
0 908 208 0
0 901 208 0

NO.7

0 5 105 507 0
0 5 602 507 0
0 5 50a 507 0
0 5 508 507 0
0 5 908 507 0
0 5 901 507 0 caden.dt (part 4)

0 505 105 501 0
0 505 602 501 0
0 505 50a 501 0
0 505 508 501 0
0 505 908 501 0
0 505 901 501 0
0 505 105 60b 0
0 505 602 60b 0
0 505 50a 60b 0
0 505 508 60b 0
0 505 908 60b 0
0 505 901 60b 0
0 505 105 507 0
0 505 602 507 0
0 505 50a 507 0
0 505 508 507 0
0 505 908 507 0
0 505 901 507 0
0 602 105 507 0
0 602 602 507 0
0 602 50a 507 0
0 602 508 507 0
0 602 908 507 0
0 602 901 507 0
0 5 105 501 0
0 5 602 501 0
0 5 50a 501 0
0 5 508 501 0
0 5 908 501 0
0 5 901 501 0
0 5 105 60b 0
0 5 602 60b 0
0 5 50a 60b 0
0 5 508 60b 0
0 5 908 60b 0
0 5 901 60b 0 caden.dt (part 5)

0 602 105 501 0
0 602 602 501 0
0 602 50a 501 0
0 602 508 501 0
0 602 908 501 0
0 602 901 501 0
0 602 105 60b 0

-continued

```
0 602 602 60b 0
0 602 50a 60b 0
0 602 508 60b 0
0 602 908 60b 0
0 602 901 60b 0
mcaden.dt
NO.1
0 607 0
0 507 0
0 50a 0
0 501 0
NO.2
0 505 0
0 901 0
0 605 0
0 602 0
0 908 0
0 508 0
0 50a 0
NO.3
0 505 607 0
0 901 607 0
0 605 607 0
0 602 607 0
0 908 607 0
0 508 607 0
0 50a 607 0
0 505 507 0
0 901 507 0
0 605 507 0
0 602 507 0
0 908 507 0
0 508 507 0
0 50a 507 0
0 505 50a 0
0 901 50a 0
0 605 50a 0
0 602 50a 0
0 908 50a 0
0 508 50a 0
0 50a 50a 0
0 505 501 0
0 901 501 0
0 605 501 0
0 602 501 0
0 908 501 0
0 508 501 0
0 50a 501 0
```

comments:
In the data of ***, the highest digit (highest 8 bits) represents a chord type as follows:
0 = "major triad"
1 = "minor triad"
2 = "diminished"
3 = "augmented"
4 = "suspended fourth"
5 = "dominant seventh"
6 = "minor seventh"
7 = "minor sixth"
8 = "sixth"
9 = "major seventh"
the lowest digit (lowest 8 bits) represents a chord root as follows:
0 = "C", 1 = "C #",
2 = "D", 3 = "E b",
4 = "E", 5 = "F",
6 = "F #", 7 = "G",
8 = "A b", 9 = "A",
a = "B b", b = "B".

```
rhymfile.dt
1 NO.1
2 16 8 8
3 16 8 8
4 16 8 8
5 16 8 8 16
6 16 16 16 16
7 16 8 8 16
8 16 16 8 8 16
9 NO.2
10 16 8 8
11 16 8 8
12 16 16 16 16
```

What is claimed is:

1. An apparatus for producing a chord progression of a music piece without requiring a melody of the music piece, comprising:

phrase characterizing means (F3 in FIG. 3) for characterizing each phrase of the music piece by setting, for said each phrase, a starting musical function with which the phrase is to begin and an ending musical function with which the phrase is to end;

mini-pattern generating means (3D in FIG. 2; F6 in FIG. 3) for generating variable mini-patterns of chords;

concatenating means (F8 in FIG. 3) for concatenating said mini-patterns generated by said mini-pattern generating means to produce a chord progression of the music piece; and start/end control means (F9 in FIG. 3) for controlling said concatenating means such that the chord progression produced by said concatenating means has, with respect to said each phrase of the music piece, a chord progression which begins with a musical function identical to said starting musical function set by said phrase characterizing means and ends with a musical function identical to said ending musical function set by said phrase characterizing means.

2. An apparatus for producing a chord progression of a music piece without requiring a melody of the music piece, comprising:

phrase structure setting means (F2 in FIG. 3) for setting a phrase structure representative of a type of each phrase of the music piece;

mini-pattern generating means (3D in FIG. 2; F6 in FIG. 3) for generating variable mini-patterns of chords;

concatenating means (F8 in FIG. 3) for concatenating said mini-patterns generated by said mini-pattern generating means to produce a chord progression of the music piece; and repeat control means (F10 in FIG. 3) for controlling said concatenating means such that the chord progression produced by said concatenating means has, when said phrase structure set by said phrase structure setting means contains a plurality of phrases similar in type to one another, the same chord progression with respect to said plurality of phrases similar in type.

3. An apparatus for producing a chord progression without requiring a melody, comprising:

musical structure knowledge storage means (3A, 3B in FIG. 2) for storing musical structures at a plurality of hierarchic levels with respect to a variety of music pieces, said musical structures being represented by a tree structured database in which musical structures at a hierarchic level are grouped according to each of musical structures at a hierarchic level higher than the first mentioned hierarchic level;

structure selecting means (FI, F2, F3 in FIG. 3) for selecting from said musical structure knowledge storage means musical structures at each of said plurality of hierarchic levels with respect to any one of said variety of music as a music piece instance;

mini-pattern generating means (3D in FIG. 2; F6 in FIG. 3) for generating variable mini-patterns of chords; and concatenating means (F9, F10, F8 in FIG. 3) for concatenating said mini-patterns generated by said mini-pattern generating means in accordance with the musical structures of the music piece instance selected by said musical structure selecting means thereby to produce a chord progression of the music piece instance.

4. The apparatus according to claim 3 wherein:

said structure selecting means comprises:

first output means (6 in FIG. 1; 11-12 to 11-22 in FIG. 11; 12-17 to 12-26 in FIG. 12B; 13-14 to 13-23 in FIGS. 13A and 13B) for calling and outputting from said musical structure knowledge storage means a list of musical structures at a hierarchic level, grouped by a musical structure at a higher hierarchic level, and first input means (5 in FIG. 1; 11-23 in FIG. 11; 12-27 in FIG. 12B; 13-24 in FIG. 13B) for inputting a musical structure selected by a user from said list; and said mini-pattern generating means comprises:

mini-pattern storage means (3D in FIG. 2) for storing a list of selectable mini-patterns of chords;

second output means (6 in FIG. 1; 18-1 to 18-14 in FIG. 18A) for calling and outputting from said mini-pattern storage means said list of mini-patterns; and second input means (5 in FIG. 1; 18-15 in FIG. 18B) for inputting a mini-pattern of chords selected by a user from said list of mini-patterns.

5. An apparatus for producing a chord progression without requiring a melody, comprising:

phrase structure file storage means (3A in FIG. 2) for storing a file of musical phrase structures, arranged in groups by musical forms;

phrase characteristic file storage means (3B in FIG. 2) for storing a file of phrase-starting and phrase-ending functions for each musical phrase, arranged in groups by said phrase structures;

functional pattern file storage means (3C in FIG. 2) for storing a file of functional patterns representing musical functions of respective chords of chord patterns;

chord pattern file storage means (3D in FIG. 2) for storing a file of chord patterns arranged in groups by said functional patterns;

form selecting means (FI in FIG. 3; 5-6 in FIG. 5; 11-2, 11-3 in FIG. 11) for selecting a musical form;

phrase structure selecting means (F2 in FIG. 3; 5-7 in FIG. 5; 11-12 to 11-23 in FIG. 11) for selecting a phrase structure from a group of phrase structures stored in said phrase structure file storage means (3A in FIG. 2) as belonging to the musical form selected by said form selecting means;

phrase characteristic selecting means (F3 in FIG. 3; 5-8 in FIG. 5; 12-17 to 12-27 in FIGS. 12B; 13-14 to 13-24 in FIGS. 13A and 13B) for selecting a phrase-starting and phrase-ending function for each musical phrase from a group of phrase-starting and phrase-ending functions stored in said phrase characteristic file storage means (3B in FIG. 2) as belonging to the phrase structure selected by said phrase structure selecting means;

functional pattern selecting means (F5 in FIG. 3; 16-4 to 16-14 in FIG. 16A) for selecting functional patterns one at a time from said functional pattern file storage means (3C in FIG. 2);

chord pattern selecting means (F6 in FIG. 3; 18-1 to 18-15 in FIGS. 18A and 18B) for selecting chord patterns one at a time from a group of chord patterns stored in said chord pattern file storage means (3D in FIG. 2) as belonging to the functional pattern selected by said functional pattern selecting means;

concatenating means (F8 in FIG. 3; FIG. 19) for concatenating the chord patterns selected by said chord pattern selecting means to produce a chord progression for a music piece; and control means (F9 in FIG. 3; FIG. 17) for controlling said concatenating means such that the chord progression produced by said concatenating means contains for each phrase of the music piece, a chord progression which begins and ends with chords whose functions as represented by associated functional patterns are respectively made identical with the phrase-starting and phrase-ending functions selected by said phrase characteristic selecting means.

6. The apparatus according to claim 5 further comprising repeat control means (F10 in FIG. 3; FIG. 21) for controlling said concatenating means such that when said phrase structure selected by said phrase structure selecting means contains a plurality of phrases similar in type to each other, and said phrase-starting and phrase-ending function selected by said phrase characteristic selecting means for each of said plurality of phrases is identical to that of each other of said plurality of phrases, the chord progression produced by said concatenating means contains the same chord progressions with respect to said plurality of phrases.

7. An apparatus for producing a chord progression without requiring a melody, comprising:

musical structure database means (3A, 3B in FIG. 2; 150 in FIG. 33) for storing a database representing musical heirarchical structures at a plurality of structural levels with respect to a variety of music pieces;

chord pattern database means (3C, 3D in FIG. 2; 160 in FIG. 33) for storing a database of chord patterns; and menu-driven interactive means (1,2,5,6 in FIG. 1; 100 in FIG. 33) for conducting a dialogue with a user in a sequence of dialogue actions which involves data retrieval from said musical structure database means and said chord pattern database means and results in production of a chord progression, said menu-driven interactive means comprising:

prompting means (6 in FIG. 1; 12-19 to 12-26 in FIG. 12B; 13-16 to 13-23 in FIG. 13B; 16-6 to 16-13 in FIG. 16A; 110 in FIG. 33; etc.) for presenting the user with a list of choices (Prisca ( ) in FIG. 9; form ( ) in FIG. 11; way ( ) in FIG. 15; etc.) from which the user selects an alternative;

user-operable input means (5 in FIG. 1; 12-27 in FIG. 12B; 13-24 FIG. 13B; 16-14 in FIG. 16A; 120 in FIG. 33; etc.) for inputting said alternative selected from the presented list of choices;

job performing means (1,2 in FIG. 1; 13-1 to 13-3 in FIG. 13A; 1@-I to 14-13 in FIG. 14; 16-16 to 16-29 in FIG. 16B; 130 in FIG. 33; etc.) in response to said user-operable input means for performing a job corresponding to said alternative, thus completing a cycle of a dialogue action; and dialogue continuing means (1,2 in FIG. 1; 13-14 in FIG. 13A; 16-1 to 16-4 in FIG. 16A; 18-1 to 18-4 in FIG. 18A; 140 in FIG. 33; etc.) in response to said job performing means for initiating a cycle of the next dialogue action by creating a list of choices and causing said prompting means to present the user with that list of choices in the cycle of said next dialogue action in order that a sequence of dialogue actions are performed by the combination of said prompting means, said user-operable input means, said job performing means and said dialogue continuing means, whereby a chord progression is produced which comprises a concatenation of chord patterns selected from said chord pattern database means and bears a compatible relationship with a musical hierarchical structure selected from said musical structure database means.

8. The apparatus according to claim 7 wherein a typical instance of said list of choices comprises a choice of return ("1.RETURN" in: 12-19 in FIG. 12B; 13-16 in FIG. 13B; 16-6 in FIG. 16A; etc.) to a cycle of a dialogue action corresponding to the one that was performed before as well as a group of data items selected from said musical structure database means or said chord pattern database means, whereby a dialogue will be conducted in a to-and-fro manner between the user and said menu-driven interactive means.

9. The apparatus according to claim 7 wherein a typical instance of said list of choices comprises a choice of automating ("2.AUTO" in: 12-19 in FIG. 12B; 13-16 in FIG. 13B; 16-6 in FIG. 16A; etc.) as well as a group of data items selected from said musical structure database means or said chord pattern database means such that when the user selects and inputs said choice of automating by said user-operable input means, said job performing means automatically selects a data item (13-4 to 13-7 in FIG. 13A; 14-4 to 14-7 in FIG. 14; 16-19 to 16-22 in FIG. 16B; etc.) from said group of data items for the user and performs a job (13-8 to 13-13 in FIG. 13A; 14-8 to 14-13 in FIG. 14; 16-23 to 16-29 in FIG. 16B; etc.) corresponding thereto whereby the user can make variable contributions to the production of a chord progression.

10. An apparatus for producing a chord-progression on a menu-driven interaction basis, comprising;

prompting means (6 in FIG. 1; 12-19 to 12-26 in FIG. 12B; 13-16 to 13-23 in FIG. 13B; 16-6 to 16-13 in FIG. 16A; 110 in FIG. 33; etc.) for presenting a user with a list of choices from which the user selects an alternative;

user-operable input means (5 in FIG. 1; 12-27 in FIG. 12B; 13-24 in FIG. 13B; 16-14 in FIG. 16A; 120 in FIG. 33; etc.) for inputting said alternative selected from the presented list of choices;

job performing means (13-1 to 13-3 in FIG. 13A; 14-1 to 14-13, in FIG. 14; 16-16 to 16-29 in FIG. 16B; 130 in FIG. 33; etc.) in response to said user-operable input means for performing a job specified by said alternative in order that a cycle of a dialogue action is completed; and dialogue continuing means (13-14 in FIG. 13A; 16-1 to 16-4 in FIG. 16A; 18-1 to 18-4 in FIG. 18A; 140 in FIG. 33; etc.) in response to said job performing means for initiating a cycle of the next dialogue action by creating a list of choices and causing said prompting means to present the user with the latter mentioned list of choices in the cycle of said next dialogue actions, whereby a sequence of dialogue actions are performed which involves a sequence of jobs done by repeated operations of said job performing means in cycles of dialogue actions, said sequence of jobs resulting in production of a chord progression.

Figure 26A:
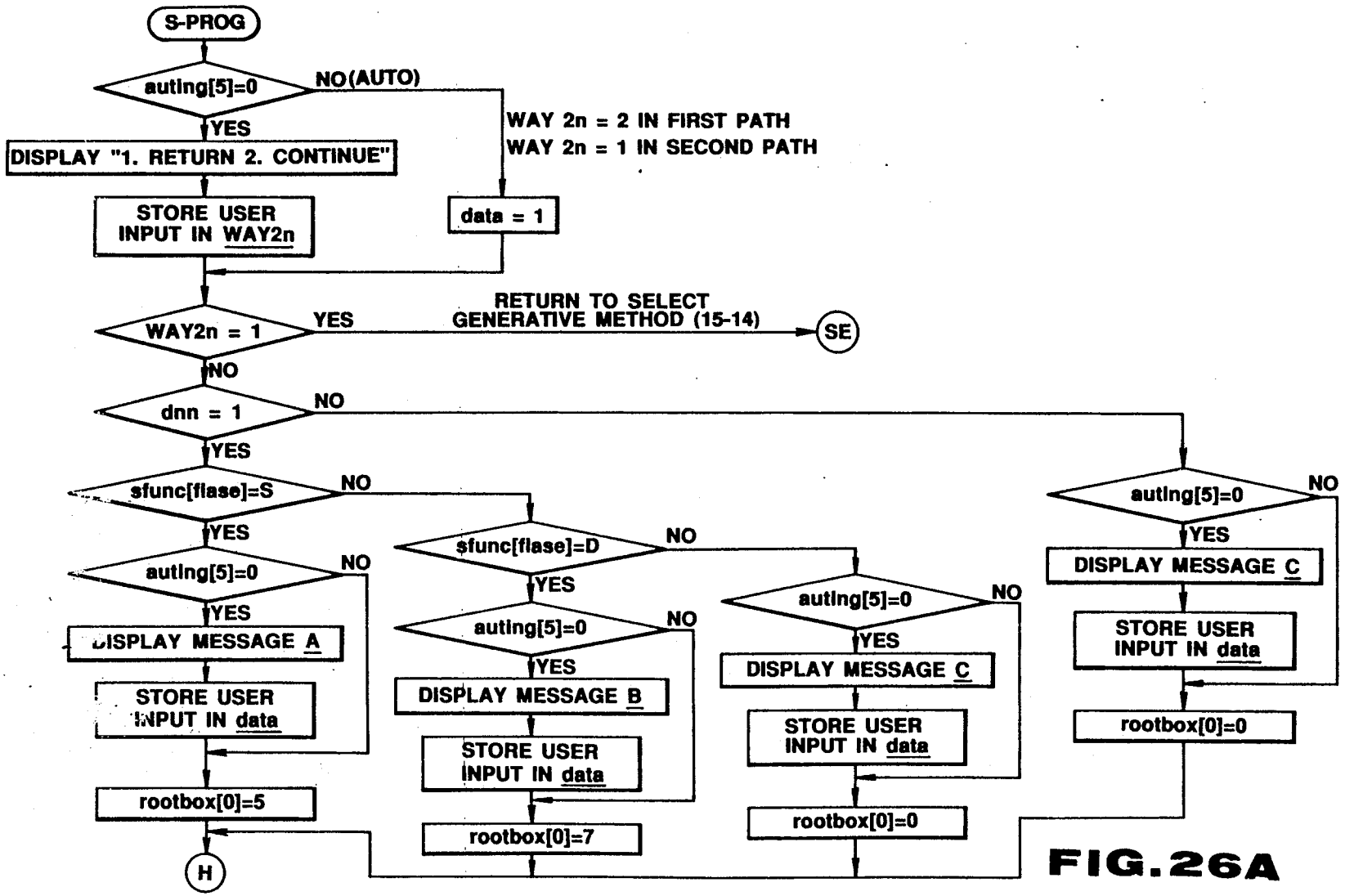
FIGS. 26A, 26B, 27 and 28 are detailed flowcharts for generating a chord progression based on subdominant progression.
Figure 26B:
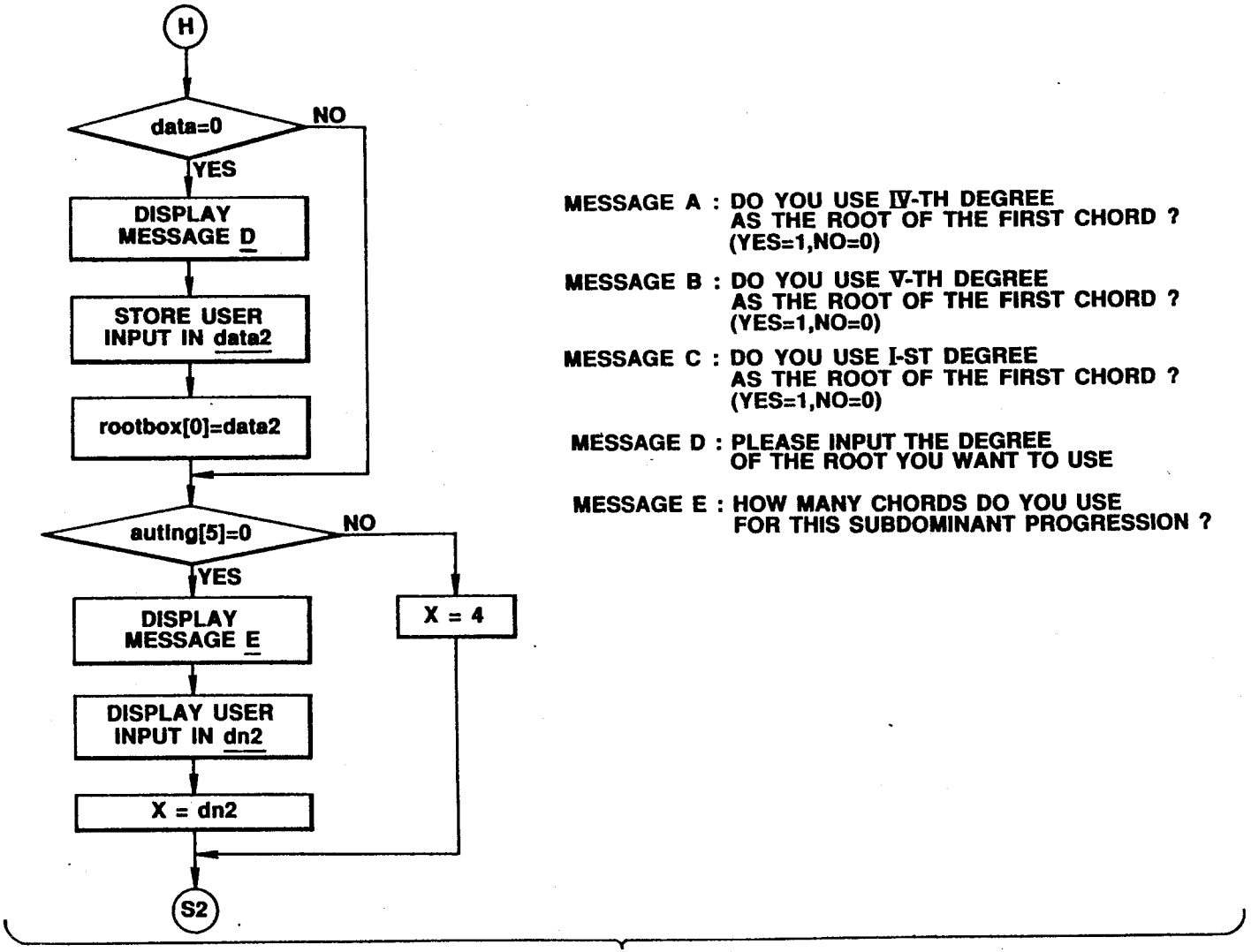
Figure 27:
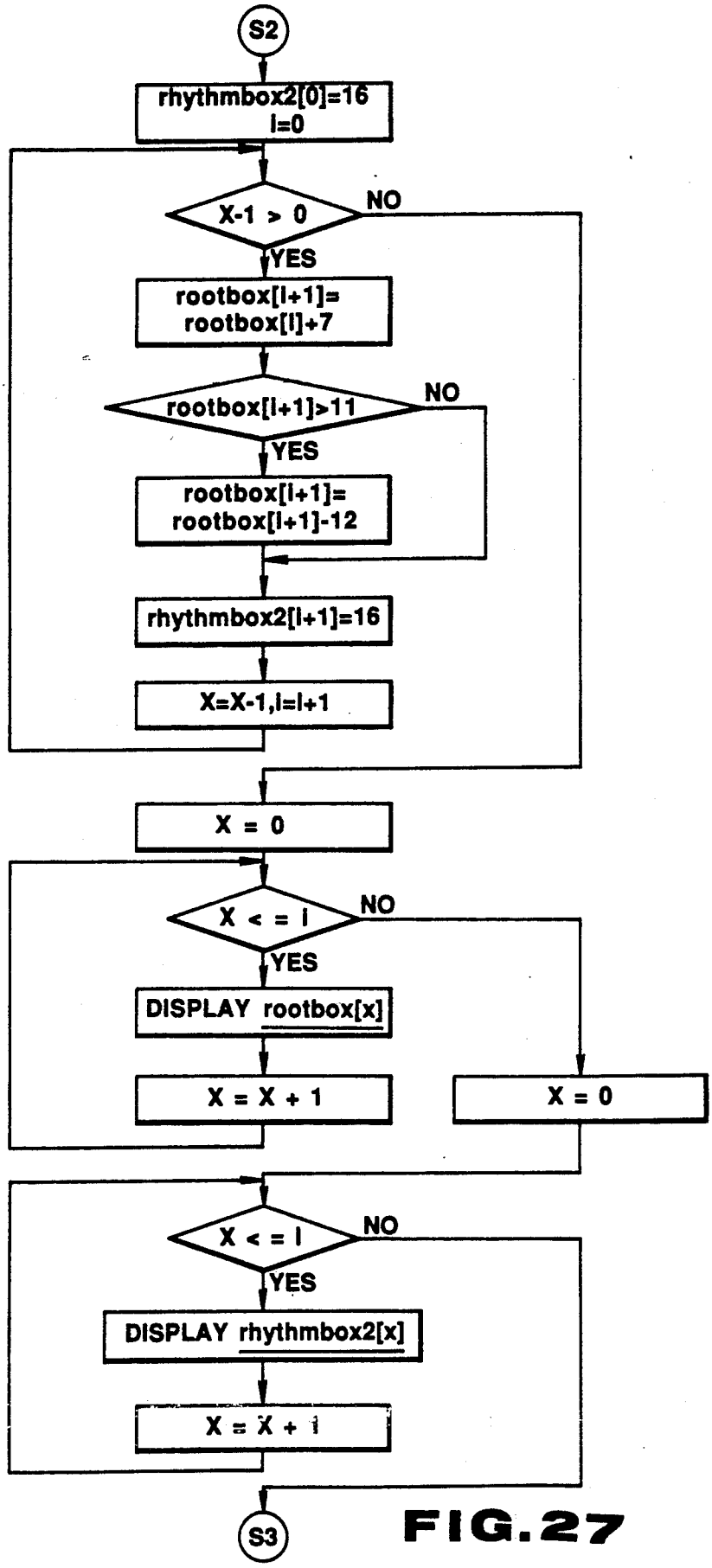
Figure 28:
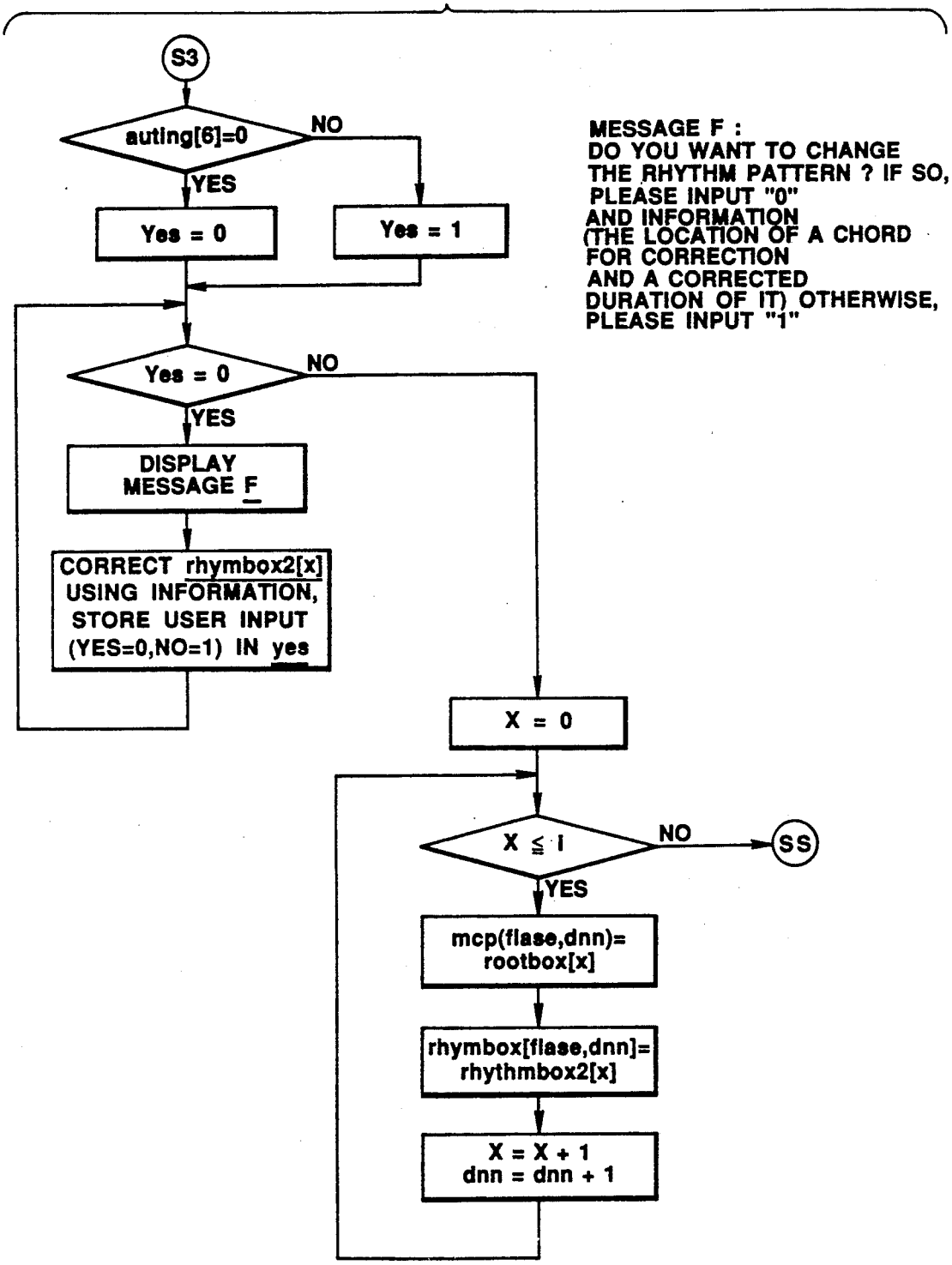

11. An apparatus for producing a chord progression without requiring a melody, comprising;

a plurality of chord pattern generating means (15-10, 15-13, 15-16 in FIG. 15) each for generating variable chord patterns belonging to a class which is different from a class of variable chord patterns generated by each other of said plurality of chord pattern generating means;

class selecting means (15-1 to 15-3 in FIG. 15) for variably selecting one chord pattern generating means at a time from said plurality of chord pattern generating means;

instance selecting means (FIGS. 18A and 18B; FIGS. 26A to 27; FIGS. 29A to 31B) for variably selecting chord patterns one at a time from the chord pattern generating means selected by said class selecting means thereby to produce a chord progression which is formed by a succession of chord patterns specified according to a series of selections by said class selection means and said instance selection means; and chord progression storage means (mcp(flase,dnn), CPA) for storing the produced chord progression.

12. The apparatus according to claim 11 wherein said plurality of chord pattern generating means include means (15-10 in FIG. 15) for generating a progression of chords of a relatively short length in which each chord functions as a tonic, dominant, or subdominant chord relative to the next succeeding chord.

13. The apparatus according to claim 12 wherein said plurality of chord pattern generating means further include dominant progression means (15-16 in FIG. 15) for generating a dominant progression of chords in which each chord serves as a dominant chord relative to the next succeeding chord.

14. The apparatus according to claim 13 wherein said plurality of chord pattern generating means include subdominant progression means (15-13 in FIG. 15) for generating a subdominant progression of chords in which each chord serves as a subdominant chord relative to the next succeeding chord.

15. A musical composer apparatus for composing a music piece comprising:

musical structure setting means (F1, F2, F3 in FIG. 3) for setting a musical structure at one or more structural levels in a musical piece;

chord pattern generating means (3D in FIG. 2; F6 in FIG. 3) for generating variable chord patterns;

chord progression generating means (F8, F9, F10 in FIG. 3) for selectively concatenating said chord patterns generated by said chord pattern generating means based on said musical structure set by said musical structure setting means to produce a chord progression of said music piece without requiring a melody so that the produced chord progression will have a structure corresponding to said musical structure; and melody synthesizing means (200 in FIG. 33) for synthesizing a melody of said music piece based on said produced chord progression.

16. An apparatus for producing a chord progression for a music piece without requiring a melody of the music piece, comprising:

chord pattern database means (3D in FIG. 2; 440, 450 in FIG. 35) for storing a database representative of a collection of chord patterns;

chord pattern selecting means (F6 in FIG. 3; 410, 420, 460 in FIG. 34; 36-4 in FIG. 36) operatively coupled to said chord pattern database means for selecting a plurality of chord patterns, one pattern at a time from said chord pattern database means;

concatenating means (F8 in FIG. 3; FIG. 19; 410, 420, 480 in FIG. 34; 36-9 in FIG. 36) operatively coupled to said chord pattern selecting means for concatenating said plurality of chord patterns thereby to produce a chord progression for a music piece; and chord progression storage means (mcp(flase,dnn),-CPA) for storing said chord progression from said concatenating means.

17. An apparatus for producing a chord progression without requiring a melody, comprising:

chord setting means (F3 in FIG. 3) for setting chords designated by a user for at least one portion of a music piece, leaving at least one blank portion thereof in which chords are to be filled, chord pattern generating means (3D in FIG. 2; F6 in FIG. 3) for generating variable chord patterns;

filling means (F8, F9 in FIG. 3) for filling chords in said at least one blank portion by selectively applying said variable chord patterns thereto so that a chord progression will be completed with respect to said music piece; and chord progression storage means (mcp(flase,dnn),-CPA) for storing said chord progression.

18. An apparatus for producing a chord progression of a music piece without requiring a melody of the music piece, comprising:

repeating block selecting means (F2, F3, in FIG. 3) for selecting a plurality of blocks in a music piece, each of which is to have the same chord progression as each other of said plurality of blocks;

chord pattern generating means (3D in FIG. 2; F6 in FIG. 3) for generating variable chord patterns;

concatenating means (F8 in FIG. 3) for selectively concatenating said chord patterns generated by said chord pattern generating means to produce a chord progression of the music piece; and repeat control means (F10 in FIG. 3) for controlling said concatenating means in such a manner that the chord progression of the music piece produced by said concatenating means contains the same chord progression with respect to each of said plurality of blocks selected by said repeating block selecting means.

19. An apparatus for producing a chord progression of a music piece without requiring a melody of the music piece, comprising:

musical structure setting means (F1, F2, F3 in FIG. 3) for setting a musical structure at least one level in a music piece;

chord pattern generating means (3D in FIG. 2; F6 in FIG. 3) for generating variable chord patterns; and chord progression forming means (F8, F9, F10 in FIG. 3) for selectively concatenating said chord patterns generated by said chord pattern generating means based on said musical structure set by said musical structure setting means to produce a chord progression of said music piece.

20. The apparatus according to claim 19 wherein said chord pattern generating means comprises:

chord pattern database (3D in FIG. 2) means for storing a database representative of a collection of chord patterns; and chord pattern selecting means (F6 in FIG. 3) operatively coupled to said chord pattern database means for selecting a plurality of chord patterns, one pattern at a time from said chord pattern database means.

21. An apparatus for producing a chord progression without requiring a melody, comprising:

chord pattern file means (440 in FIG. 34) for storing a file of chord patterns;

next candidate set defining means (450 in FIG. 34) for defining, with respect to each chord pattern in said chord pattern file means, a set of next chord pattern candidates each of which can succeed said chord pattern and is stored in said chord pattern file means; and concatenating means (410, 420, 460, 480 in FIG. 34; 36-3 to 36-9 in FIG. 36) for concatenating chord patterns successively selected from said chord pattern file means based on said next candidate set defining means to produce a chord progression (CPA in FIG. 37B) comprising a concatenation of said chord patterns.

22. The apparatus according to claim 21 wherein said concatenating means comprises:

prompting means (36-3 in FIG. 36) operable each time when a chord pattern from said chord pattern file means is determined to be a current chord pattern in a chord progression being produced for retrieving from said chord pattern file means a set of next chord pattern candidates defined by said next candidate set defining means with respect to said current chord pattern and for displaying said set on a display unit (470 in FIG. 34);

next chord pattern determining means (36-4 to 36-7 in FIG. 36) including user-operable input means (460 in FIG. 34) adapted to select an alternative from said set retrieved and displayed by said prompting means for determining said alternative to be a next chord pattern which is to succeed said current chord pattern; and chord progression extending means (36-9 in FIG. 36) for concatenating said next chord pattern determined by said next chord pattern determining means into said chord progression so that said next chord pattern will be determined to be a current chord pattern in said chord pattern after the concatenation.

23. The apparatus according to claim 21 wherein said concatenating means comprises determining means for determining chord patterns of a chord progression on a one-after-another chord pattern basis and wherein said determining means comprises:

automatic performance means (410, 420, 510 in FIG. 34; 36-5 in FIG. 36) for playing a performance of a chord pattern selected as a next chord pattern candidate from said chord pattern file means in continuation of a performance of at least part of the chord progression already produced; and user-operable input means (460 in FIG. 34; 36-6 in FIG. 36) for providing a user's response to the play by said automatic performance means, said user's response being indicative of whether said next chord pattern candidate played is determined to be a chord pattern to be newly concatenated into the chord progression.

24. An apparatus for producing a chord progression without requiring a melody, comprising:

chord pattern network means (FIG. 45; 440, 450 in FIG. 34) for storing a hierarchical network of chord patterns comprising a plurality of nodes and a plurality of links connecting between said nodes so as to define hierarchical relationships therebetween in which each node in said hierarchical network contains at least one chord pattern and in which each chord pattern in said each node in said hierarchical network is connected by an associated one of said plurality of links to another node in said hierarchical network; and network exploring means (410, 420 in FIG. 34; FIG. 36) for exploring said chord pattern network means according to a guidance of said links in said hierarchical network while concatenating chord patterns thus explored one after another thereby to develop a chord progression.

25. An apparatus for determining a chord pattern to be used in a chord progression as part thereof, comprising:

chord pattern database means (3D in FIG. 2; 440, 450 in FIG. 35; FIG. 45) for storing a database of chord patterns;

chord pattern choosing means (F6 in FIG. 3; 410, 420, 460 in FIG. 34; 36-4 in FIG. 36) for choosing a chord pattern from said chord pattern database means;

sound test means (410, 420, 510, 520 in FIG. 34; 36-5 in FIG. 36) for automatically playing said chord pattern choosing means;

user-operable input means (460 in FIG. 34) for providing a user's response to the play by said sound test means, said user's response being indicative of either acceptance or rejection of said chord pattern played by said sound test means; and determining means (410, 420 in FIG. 34; 36-7, 36-9 in FIG. 36) for determining said chord pattern played by said sound test means to be part of a chord progression when said user's response from said user-operable input means indicates said acceptance, and for concatenating the determined chord pattern with a chord progression whereby extending of a desired chord progression is facilitated.

26. The apparatus according to claim 25 wherein said sound test means is arranged to automatically play a performance of at least a portion of said chord progression in advance of the performance of said chord pattern chosen by said chord pattern choosing means.

* * * * *